US009286877B1

(12) United States Patent
Dabby

(10) Patent No.: US 9,286,877 B1
(45) Date of Patent: Mar. 15, 2016

(54) METHOD AND APPARATUS FOR COMPUTER-AIDED VARIATION OF MUSIC AND OTHER SEQUENCES, INCLUDING VARIATION BY CHAOTIC MAPPING

(71) Applicant: Diana Dabby, Somerville, MA (US)

(72) Inventor: Diana Dabby, Somerville, MA (US)

( * ) Notice: Subject to any disclaimer, the term of this patent is extended or adjusted under 35 U.S.C. 154(b) by 0 days.

(21) Appl. No.: 14/264,612

(22) Filed: Apr. 29, 2014

Related U.S. Application Data

(63) Continuation-in-part of application No. 13/192,380, filed on Jul. 27, 2011.

(60) Provisional application No. 61/367,897, filed on Jul. 27, 2010, provisional application No. 61/512,186, filed on Jul. 27, 2011.

(51) Int. Cl.

| | |
|---|---|
| ***A63H 5/00*** | (2006.01) |
| ***G04B 13/00*** | (2006.01) |
| ***G10H 7/00*** | (2006.01) |
| ***B42D 15/02*** | (2006.01) |

(52) U.S. Cl.
CPC ..... *G10H 7/002* (2013.01); *B42D 15/022* (2013.01)

(58) Field of Classification Search
CPC ..... G10H 7/002; G10H 1/0025; G10H 1/16; G10H 2210/131; B42D 15/022
USPC ..... 84/609, 634, 645
See application file for complete search history.

(56) References Cited

U.S. PATENT DOCUMENTS

| | | | | |
|---|---|---|---|---|
| 5,003,860 | A | 4/1991 | Minamitaka | |
| 5,281,754 | A | 1/1994 | Farrett et al. | |
| 5,331,112 | A | 7/1994 | Sato et al. | |
| 5,371,854 | A | 12/1994 | Kramer | |
| 5,418,323 | A | 5/1995 | Kohonen | |
| 5,606,144 | A * | 2/1997 | Dabby | 84/649 |
| 6,028,262 | A | 2/2000 | Minamitaka | |
| 6,137,045 | A * | 10/2000 | Short et al. | 84/603 |
| 6,177,624 | B1 | 1/2001 | Takahashi et al. | |
| 7,034,217 | B2 | 4/2006 | Pachet | |
| 7,135,635 | B2 | 11/2006 | Childs et al. | |
| 7,193,148 | B2 | 3/2007 | Cremer et al. | |
| 7,498,504 | B2 * | 3/2009 | Bourgeois | 84/609 |

(Continued)

OTHER PUBLICATIONS

Lorenz, E.N., Deterministic nonperiodic flow, J. Atmos. Sci., 1963, vol. 20, pp. 130-141.

(Continued)

*Primary Examiner* — Jeffrey Donels
(74) *Attorney, Agent, or Firm* — Maine Cernota & Rardin

(57) ABSTRACT

An altered but recognizable variant of an input musical composition is created by parsing the input into elements, selecting elements for replacement using a hole-selecting algorithm, and replacing the selected elements using a substitution algorithm. A plurality of tracks from the same composition, or from different compositions, can be separately varied and combined, or concatenated and varied together, or used as a seed source of a substitution algorithm, to create a remix or mash-up. Music variants can be combined with photographs, images, or videos, for distribution to recipients, or for a project presentation or story board. Greeting cards, MP3 players, mobile electronic devices, wearable electronic devices, toys, video games, websites, and ringtones can be configured to create and play a new variant of an input composition each time it is accessed. Websites can be used to host and track successive, "chain" variations of an input musical composition.

35 Claims, 61 Drawing Sheets

(56) References Cited

U.S. PATENT DOCUMENTS

| | | | | |
|---|---|---|---|---|
| 7,560,636 | B2 * | 7/2009 | Wolfram | 84/609 |
| 7,629,528 | B2 | 12/2009 | Childs, Jr. et al. | |
| 7,840,608 | B2 | 11/2010 | Kurzweil et al. | |
| 8,035,022 | B2 | 10/2011 | Wolfram | |

OTHER PUBLICATIONS

Dabby, D.S., Musical Variations from a Chaotic Mapping, 1995 MIT doctoral thesis, 162 pgs.

Dabby, D.S., Musical Variations from a Chaotic Mapping, Chaos, 1996, 13 pgs.

Dabby, D.S. Dabby, A chaotic mapping for music and image variations, Proc. Fourth Int'l. Chaos Conference, 1998, 12 pgs.

Dabby, D.S. Dabby, Creating Musical Variation, Science, 2008, 2 pgs.

Carabias-Orti, J. J. et al., Music Scene-Adaptive Harmonic Dictionary for Unsupervised Note-Event Detection, IEEE Transactions on Audio, Speech, and Language Processing 18 (3), 2010, pp. 473-486.

* cited by examiner (©2007 Diana Dabby)

Prelude No. 1 by George Gershwin, mm. 1 – 11 ( © 1927 New World Music Corporation)

"Paparazzi" (words and music by Robert Fusari and Stefani Germanotta, ©2008 Sony/ATV Music Publishing. June Bug Alley Music and House of Gaga Publishing, Inc.)

"Paparazzi" (words and music by Robert Fusari and Stefani Germanotta, ©2008 Sony/ATV Music Publishing, June Bug Alley Music and House of Gaga Publishing, Inc.)

METHOD AND APPARATUS FOR COMPUTER-AIDED VARIATION OF MUSIC AND OTHER SEQUENCES, INCLUDING VARIATION BY CHAOTIC MAPPING

RELATED APPLICATIONS

This application is a continuation in part of U.S. patent application Ser. No. 13/192,380, filed on Jul. 27, 2011. Application Ser. No. 13/192,380 claims the benefit of U.S. Provisional Application No. 61/367,897, filed Jul. 27, 2010, and U.S. Provisional Application No. 61/512,186, filed Jul. 27, 2011. All of these applications are herein incorporated by reference in their entirety for all purposes.

COPYRIGHT NOTICE

A portion of the disclosure of this patent document contains material that is subject to copyright protection. The copyright owner has no objection to the facsimile reproduction by anyone of the patent document or the patent disclosure, as it appears in a published Patent and Trademark Office patent file or record, but otherwise reserves all copyrights whatsoever.

FIELD OF THE INVENTION

The invention relates to methods for creating variations of sequences of symbols, and more particularly, to methods for creating a variation of a piece of music or another symbol sequence whereby the variation differs from the original sequence but nevertheless retains some features of the original sequence.

BACKGROUND OF THE INVENTION

The present invention is an improvement upon the computer-aided techniques of my prior U.S. Pat. No. 5,606,144, and earlier MIT doctoral thesis Musical Variations from a Chaotic Mapping, and papers "Musical Variations from a Chaotic Mapping" (*Chaos,* 1996), "A chaotic mapping for music and image variations" (*Proc. Fourth Int'l. Chaos Conference,* 1998), and "Creating Musical Variation" (*Science,* 2008). The invention is a method for extending the variation capabilities of musical compositions, including both printed and recorded versions of the same. It should be noted that the term "variation" is used herein to refer to any process by which some features of a work (such as a musical piece) change while other features remain the same, and the term "variation technique" is used herein to refer to any modification and/or compositional procedure.

The present invention is mainly described in this paper in terms of its application to musical symbols or notes, following the illustrations of my said prior patent. However, it should be noted that the present invention is not limited to variations of music, and that embodiments of the present invention are generically applicable to all types of symbols, characters, images, and such like.

In my prior patent, a chaotic mapping technique is provided for generating, for example, musical variations of a given work. This technique, based on the sensitivity of chaotic trajectories to initial conditions, produces changes in the pitch sequence of a piece. The mapping in embodiments of my prior patent utilize two chaotic trajectories from the Lorenz equations—a system comprising three nonlinear first order differential equations $$dx/dt=\sigma(y-x) \quad (1)$$

$$dy/dt=rx-y-xz \quad (2)$$

$$dz/dt=xy-bz, \quad (3)$$

where $\sigma=10$, $b=8/3$, and $r=28$ (E. N. Lorenz, "Deterministic nonperiodic flow," *J. Atmos. Sci.* 20, 130-141 (1963)). Other embodiments use other chaotic systems.

In the original chaotic mapping of my prior patent, the x-components $\{x_i\}$ of a reference chaotic trajectory are paired with a sequence of musical pitches $\{p_i\}$. Each $p_i$ is then marked on the x axis at the point designated by its $x_i$. In this way, the x-axis becomes a pitch axis configured according to the notes of the source composition. Then, a second chaotic trajectory, whose initial condition differs from the first, is launched. Its x-components trigger pitches on the pitch axis that vary in sequence from the source work, thus creating a variation. The possible variations are virtually infinite in number, and can be very close to the source, diverge substantially, or achieve degrees of variability in between these two extremes.

The Lorenz equations arise in applications ranging from lasers to private communications, and have also served as generators of "chaotic" music, where a chaotic system is allowed to free-run and its output converted into a series of notes, rhythms, and other musical attributes in order to create a piece from scratch. However, these approaches did not generate variations on an already completed piece.

The original chaotic mapping of my said U.S. Pat. No. 5,606,144 operates on the note list of a source piece, e.g., one provided by a MIDI file score, and treats each successive pitch, or simultaneous sounding of pitches (chord), as a parsed event. This represents the default parsing of the MIDI file score.

However, despite its ability to produce variations which can be delightful, appealing to musicians and non-musicians alike, the original chaotic mapping described in my previous patent has limitations. For instance, it requires that no note occur in the variation that was not already present in the input source file. While this can create a 'pitch space' link between the variation and the input source file, i.e., the variation is composed of pitches found in the input file, a richer variation technique would allow pitches outside the pitch space of the input file, if desired. Furthermore, my original chaotic mapping technique does not offer choices to apply different variation techniques within one piece.

Also, my original chaotic mapping approach applies only to a discrete-time signal representation of a source piece, e.g., a MIDI file score, prose, poetry, image, etc., but not to a continuous-time signal representation of a work, e.g., an audio recording, video, film, spoken word art, video games, and so on.

What is needed, therefore, is an improved chaotic mapping method which can introduce notes and/or symbols into a variation which are outside the pitch space of the input file, which can combine and offer choices between both new and time-honored variation and/or compositional procedures, and can generate variations not only of a discrete-time signal representation but also of a continuous-time signal representation of an existing work.

SUMMARY OF THE INVENTION

The present invention is a method for transforming an ordered input into a variant ordered output, whereby the variant output differs from but maintains a recognizable similarity to the input. Embodiments of the method include the following steps:

parsing the input into an ordered sequence of original elements $\{N_i\}$, the original elements being sequentially indexed by successive integer values of an index i from 1 to a maximum value $i_{max}$;

for each value of i, using a hole selecting algorithm to determine if $N_i$ is a candidate for modification and/or substitution, herein referred to as a "hole element"; and using a substitution and/or modifying algorithm, for at least one of the hole elements providing a substitution and/or modified element and replacing the hole element with the substitution and/or modified element, the resulting ordered set of original and substituted and/or modified elements constituting the variant output.

In embodiments, the hole-selecting algorithm includes application of a chaotic mathematical function. In some of these embodiments the chaotic mathematical function is a fourth-order Runge-Kutta implementation of a set of Lorenz equations, and in some of these embodiments the Lorenz equations are:

$$dx/dt=\sigma(y-x); \quad (4)$$

$$dy/dt=rx-y-xz; \text{ and} \quad (5)$$

$$dz/dt=xy-bz, \quad (6)$$

where $\sigma=10$, $b=8/3$, and $r=28$.

In some embodiments, numeric values from the two sets of values having the same index can be compared, and the original element can be replaced if the numeric value from the second group is larger (in some embodiments) or smaller (in other embodiments) than the numeric value from the first group.

In various of these embodiments, the chaotic mathematical function is used to generate a first set of numeric values and a second set of numeric values, where the number of values in each set equals the number of original elements. Elements of the first and second sets of numeric values are then paired according to a pairing algorithm, and the paired elements are compared to each other so as to determine if the corresponding original element is a hole element.

Still other embodiments include for each value of j from 1 to $i_{max}$ finding the value k of the index of the smallest member of the first group of values which is greater than the "j" member of the second group of values, and determining that $N_j$ is a "hole element" if $j \neq k$.

Some embodiments of the present invention are applicable to inputs that are ordered sets of discrete items, such as MIDI files or other lists of notes, note durations, and note onset times, while other embodiments are applicable to inputs which are continuously varying functions, such as recordings of music. Some embodiments include parsing a continuous recording of sound into discrete notes, note durations, and time intervals between notes.

In various embodiments an input which is a continuous function is divided into a sequential series of original elements which are segments of the input. The segments can be determined by simply dividing the input into segments of equal length. In other embodiments, starting points, and in some embodiments also ending points, are selected by a user by automated detection of time signature beats, boundaries between musical phrases, or repetitive structures.

The substitution algorithm can include scanning input segments in a forward or backward direction until another segment is located that is substantially equal in length to the hole segment. The scanning can begin at the beginning or end of the input, or at a segment that is symmetrically located with respect to the hole segment on opposite sides of a symmetry element.

A given substitution element can be restricted to replacing only one hole element. A variation procedure can be applied to a selected element. If the input is a musical input, a substitution element can be derived from music that is part of the input, distinct from the input but part of a musical composition to which the input belongs, or part of a musical composition to which the input does not belong.

A substitution element can be derived from a musical seed source or other seed source which is distinct from the input and includes an ordered set of elements. An element of the seed source can be selected which immediately follows an element which is at least similar to the element immediately preceding the hole element. A chaotic mathematical function can be applied to a seed source in order to select and/or modify a substitution element. The substitution element can be derived from a plurality of elements of the seed source, and/or an algorithm can be applied to the seed source such as scanning, stenciling, interval shift and/or insert, reversal, inversion (dynamic), repetitive beat, and/or phrase structure.

For musical inputs and/or seed sources, providing a substitution and/or modification element can include reversing pitch order, pitch duration, or pitch onset time, inverting a note (for example about a closest preceding note belonging to an element which is not a hole element), moving a note by a specified interval, and/or adding at least one note having a pitch which is offset by a specified musical interval from a pitch included in the hole element.

In some embodiments providing a substitution and/or modifying element includes application of a pitch or timing mask element to the hole element and applying at least one of "and," "inclusive or," and "exclusive or" logic between the mask and the hole element. The mask element can be another of the original elements or an outside element.

Separate tracks from a musical recording (e.g. voice, accompanying instruments, and percussion) can be treated as separate input sources for variation according to the present invention and then recombined to create a "remixed" variant. The tracks can be separately varied and then combined, and/or one track can be used as a seed source for another track. In embodiments, a website or other forum is provided for composers, artists, DJ's, and such like to post the separate tracks from their recordings, so that "fans" can remix them and create individualized and differentiated works.

Music variations created using the present invention can be uploaded to websites such as social media sites, and can also be combined with graphical works such as photographs or videos. For example, a user can take a "selfie" or other photograph, or a short video such as a "vine," using a hand-held or wearable computing device, and then associate the graphical work with a novel variation of a well-known composition before sharing/sending the combination to one or more recipients by email, tweet, or SMS message. In embodiments, the website can be programmed to generate and play a new variation of the composition each time the website is visited. In other embodiments, the present invention can be implemented in a website, allowing a user for example to make a recording or upload a song, create a variation according to the present invention, and share/send the variation to one or more friends or other recipients in combination with a message.

In embodiments, a composer or choreographer can create short variations of a musical input using the present invention that will accompany the pictures in a storyboard presentation for a project such as an ad campaign, a Broadway show, or a new movie concept, so as to win approval and commitment to the project before investing the time and effort required to create a full accompanying score. In other embodiments, short musical variations created using the present invention can be included with a PowerPoint or similar presentation, so as to add an audible component to a presentation of a concept such as a business proposal, artistic concept, or project plan. In some of these embodiments, the present invention is embedded within the software used to generate the presentation, to facilitate the creation by the presenter of unique auditory elements.

The present invention can enhance social interactions in other ways. For example, a greeting card can include a small chip that is accessible via the web or via a computing device, so that the user can store thereupon a unique and personal composition created using the present invention, to be played when the card is opened. The user can further include a recording of his or her own voice or of a synthesized voice, or another acoustic or electronic input, to further personalize the message. For example, a Valentine's Day card could include a custom variant of a romantic song where a recording of the sender's voice speaking the recipient's name is used as a seed source. Or the sender could record himself/herself sing the Happy Birthday song and use the recording as a seed source to vary a well-known composition (e.g. theme from Star Wars) to be played by a birthday card.

Websites can host "chains" of compositions where individuals create and post successive variations of a starting composition. In other words, a first user can create a first variant of a source input composition, a second user can create a second variant that is a variant of the first variant, and so forth. A visitor to the website can then enjoy listening to a succession of variations that may begin as small changes to the input composition, and then evolve to variations where the input is hardly recognizable.

In embodiments, the present invention is implemented in a small electronic chip that can be included in a larger item, such as a hand-held device (smart phone, iPod, iPad, tablet, etc), an MP3 player, a greeting card, or wearable technology such as smart watches, smart bands, or wearable computers. In some of these embodiments, the item is thereby enabled to play variations of music stored therein. For example, the chip can be instructed to create a new variation of a song every time it is played on an MP3 player. In other embodiments, the chip is included in a greeting card, so that the sender can create a unique composition to be played when the card is opened without resort to a website or separate computer. In some of these embodiments, the chip can be programmed to play a different variation each time the card is opened.

The present invention is a method practiced by a computing device for transforming an input musical composition into a variant musical composition, whereby the variant composition differs from but maintains a recognizable similarity to the input composition. The method includes parsing by the computing device of the input composition into an ordered sequence of original elements $\{Ni\}$, the original elements being sequentially indexed by successive integer values of an index i from 1 to a maximum value imax, for each value of i, the computing device using a hole selecting algorithm to determine if Ni is a candidate for substitution, herein referred to as a "hole element," and using a substitution algorithm, for at least one hole element the computing device providing a substitution element and replacing the hole element with the substitution element, the resulting ordered set of original and substituted elements constituting the variant composition.

Embodiments further include applying the method separately to at least two tracks of the input musical composition so as to create variants thereof, and recombining the variants to create a remixed musical composition.

In some embodiments, a plurality of tracks from an input musical composition are posted on a website, and the website is configured to enable visitors to the website to access subsets of the tracks and to create therefrom a remixed musical composition.

In other embodiments, the input musical composition includes a subset of a plurality of tracks included in a musical recording, and the substitution element is an element Ms derived from at least one seed track of the musical recording, wherein the at least one seed track is not included in the input musical composition, the substitution creating a remixed musical composition.

In various embodiments the input musical composition includes a concatenation of at least two subsets of a plurality of tracks included in a musical recording. And in certain embodiments the input musical composition includes a concatenation of at least two subsets of a plurality of tracks included in a plurality of musical recordings.

Selected embodiments further comprise combining the variant composition with a graphical element. In some of these embodiments, the graphical element is a graphical image. In other of these embodiments, the graphical element is a video or a part of a video. In still other of these embodiments, the graphical element is a film or a part of a film. In yet other of these embodiments, the graphical element is a video game or a part of a video game.

In certain other of these embodiments, the graphical element is a presentation slide element or presentation slide deck. Some other of these embodiments further include forwarding the combined variant composition and graphical element to at least one recipient. In various of these embodiments, the graphical element is an element of a storyboard that describes a proposal for a musically accompanied graphical work. And in some of these embodiments, the musically accompanied graphical work is a musically accompanied video.

In other of these embodiments, the graphical element is a slide presentation created by a presentation software application. And in some of these embodiments the presentation software application is configured to perform the steps of parsing, using the selection algorithm, and using the substitution algorithm.

In embodiments, the input musical composition is associated with a website, and the website is configured, each time a user visits a designated page of the website, to repeat the steps of using the hole selecting algorithm and using the substitution algorithm to create a new variant of the input musical composition, and play the new variant to the user.

In various embodiments, the input musical composition is associated with software, the software being configured, each time a user opens it, to repeat the steps of using the hole selecting algorithm and using the substitution algorithm to create a new variant of the input musical composition, and play the new variant to the user.

Certain embodiments further include storing the variant composition in a digital device included in a greeting card, the digital device being configured to play the variant composition when the greeting card is opened.

In selected embodiments, a digital device is configured to perform the steps of parsing, using the hole selecting algorithm, and using the substitution algorithm. In some of these embodiments, the digital device is included in a greeting card, a toy, an MP3 player, a cellular telephone, or a hand-held or wearable electronic device. In other of these embodiments, the digital device is configured to repeat the steps of using the hole selecting algorithm and using the substitution algorithm each time a musical composition is accessed, so that a new variant composition is played each time the composition is accessed.

In embodiments, the method is practiced by an application running in hardware or software on a hand-held or wearable electronic device. In certain embodiments, the method is practiced by a computing device that is accessible via a network to a hand-held or wearable electronic device.

In various embodiments, the method is practiced by a computing module included in a hand-held or wearable electronic device. In some of these embodiments, the hand-held or wearable electronic device is configurable to play a new variant of the input musical composition each time the input musical composition is selected. In other of these embodiments, the computing module included in a hand-held or wearable electronic device is configurable to play a new variant of the input musical composition each time the input musical composition is selected. In various of these embodiments, a plurality of tracks from an input musical composition are accessible to a hand-held or wearable electronic device, and the hand-held or wearable electronic device is configured to enable the user to access subsets of the tracks and to create therefrom a remixed musical composition. And in certain of these embodiments the input musical composition includes a subset of a plurality of tracks included in a musical recording, and the substitution element is an element Ms derived from at least one seed track of the musical recording, wherein the at least one seed track is not included in the input musical composition, the substitution creating a remixed musical composition.

In embodiments, the method is practiced via a website or computing device. In some embodiments, the method is practiced by a video game so as to play a new variant of a musical theme each time specified criteria are met during play of the game.

In other embodiments, the steps of using the hole selecting algorithm and using the substitution algorithm are repeated in a chain sequence, whereby the input musical composition for each repetition is a variant composition created by a previous repetition. In some of these embodiments, the steps of using the hole selecting algorithm and using the substitution algorithm are performed by a website, the website being configured to store the variant compositions and make them available to visitors of the website. And in other of these embodiments, the steps of using the hole selecting algorithm and using the substitution algorithm are performed by a hand-held or wearable electronic device, the device being configured to send the variant composition to another person to keep the chain of variations going from recipient to recipient.

And in various embodiments, the steps of using the hole selecting algorithm and using the substitution algorithm results in a variant composition that is so different from the original composition as to be deemed a new composition in its own right.

The features and advantages described herein are not all-inclusive and, in particular, many additional features and advantages will be apparent to one of ordinary skill in the art in view of the drawings, specification, and claims. Moreover, it should be noted that the language used in the specification has been principally selected for readability and instructional purposes, and not to limit the scope of the inventive subject matter.

BRIEF DESCRIPTION OF THE DRAWINGS

FIG. 7I is a graphical representation of an audio recording illustrating time waveforms of 4-measure phrase parsings of the first two sections of Chopin's Waltz in $A^b$, Op. 69, No. 1, produced by the duration-specific automatic parser of the embodiment of FIG. 7H;

DETAILED DESCRIPTION

Figure 1A:
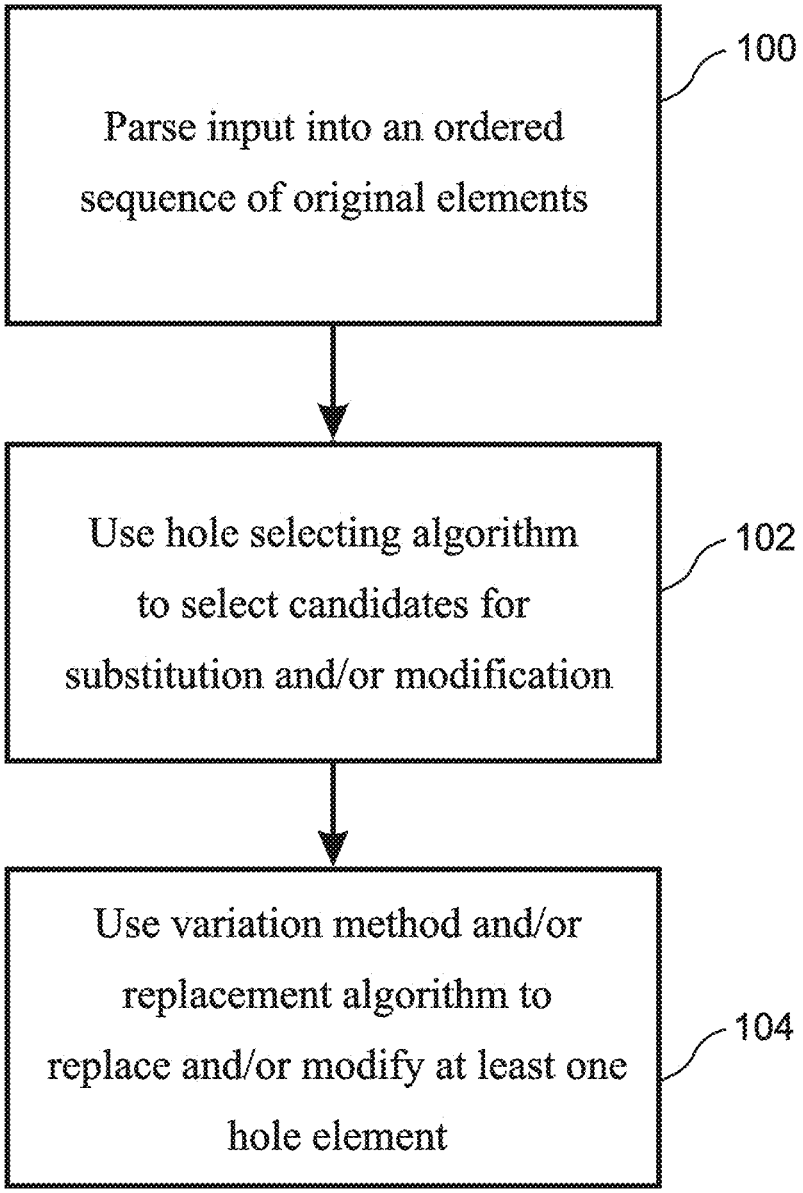
FIG. 1A is a flow diagram of the basic steps of the present invention.

With reference to FIG. 1A, the present invention is a method for transforming an ordered input into a variant ordered output, whereby the variant output differs from but maintains a recognizable similarity to the input. Embodiments of the method include the following steps:

parsing the input 100 into an ordered sequence of original elements $\{N_i\}$, the original elements being sequentially indexed by successive integer values of an index i from 1 to a maximum value $i_{max}$;

for each value of i, using a hole selecting algorithm 102 to determine if $N_i$ is a candidate for substitution and/or modification, herein referred to as a "hole element"; and using a substitution and/or modification algorithm 104, for at least one of the hole elements providing a substitution and/or modified element and replacing the hole element with the substitution and/or modified element, the resulting ordered set of original and substituted elements constituting the variant output.

Methods of various embodiments vary according to whether the input is a set of discrete elements, such as a MIDI file, or a continuous input, such as a recording of music.

Embodiments Applied to Discrete Inputs Such as MIDI File Scores

Figure 1B:
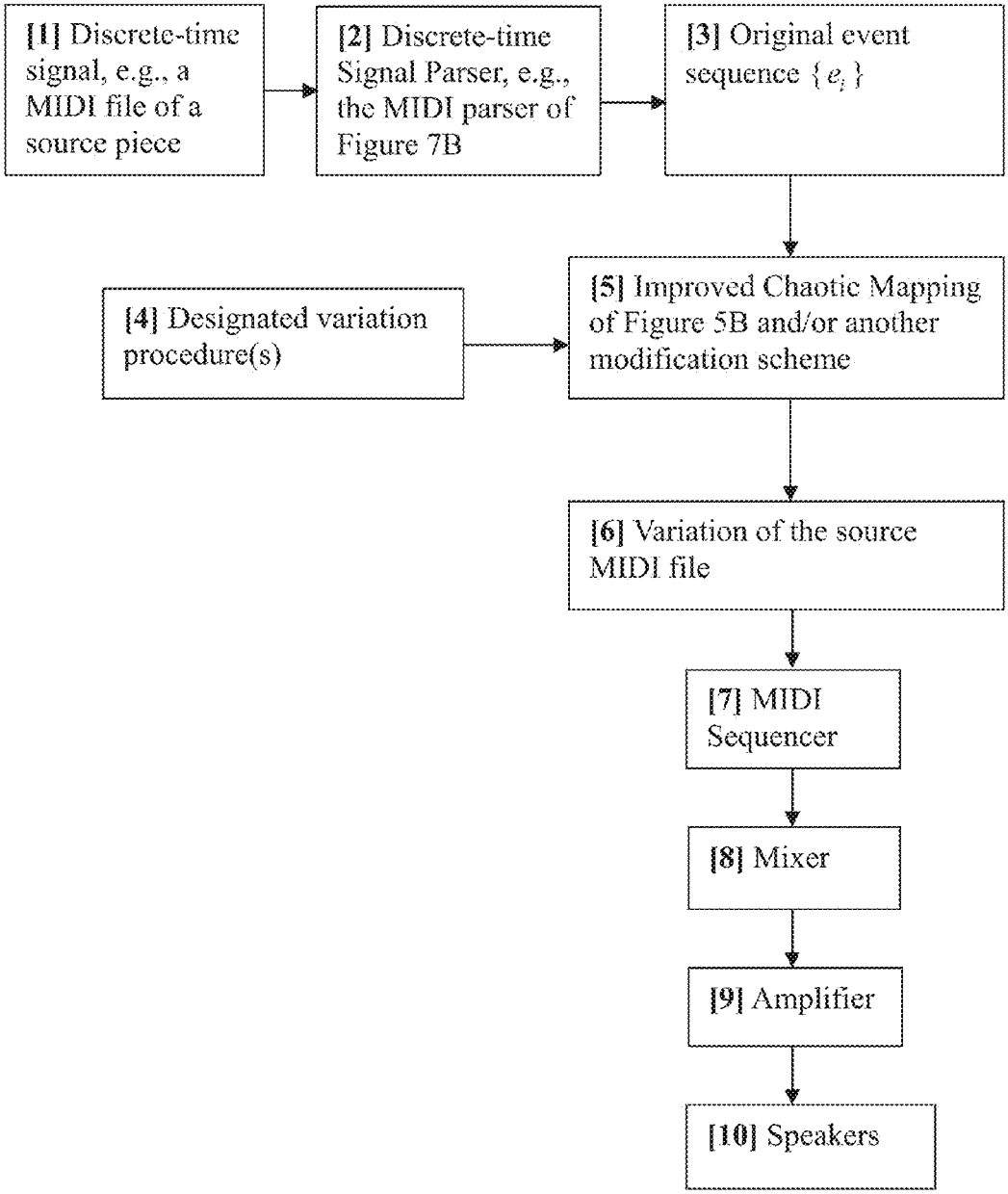
FIG. 1B is a flow diagram of an embodiment of the present invention that is adapted for application to MIDI events.

FIG. 1B presents a flow diagram of an embodiment of the present invention with respect to making variations of a discrete-time signal representation of a given work.

Block [1] represents a discrete-time signal, e.g., a MIDI file representation of a musical piece. It serves as the input to Block [2], denoting at least one parsing scheme such as the Discrete-time Signal Parser of FIG. 7B, as applied to the source MIDI file. The result of the parsing is a MIDI event list $\{e_i\}$ shown in Block [3] which is supplied to a modification scheme such as the Improved Chaotic Mapping of Block [5]. The modification scheme is used in tandem with one or more designated variation procedures (Block [4]), which are discussed in more detail below.

Figure 5A:
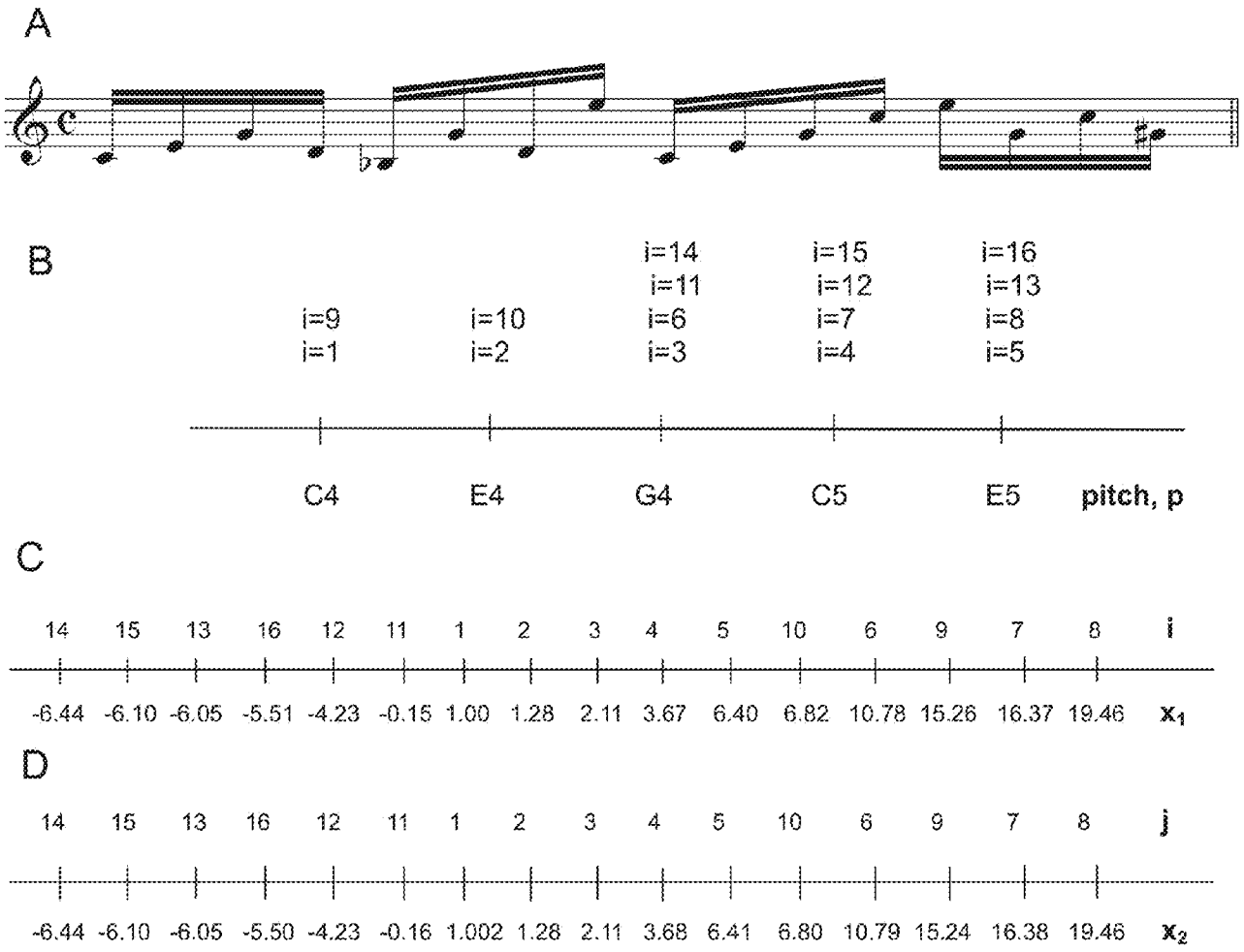
FIG. 5A illustrates the application of a Hole Template method of an embodiment of the present invention to a musical example.
Figure 5A:
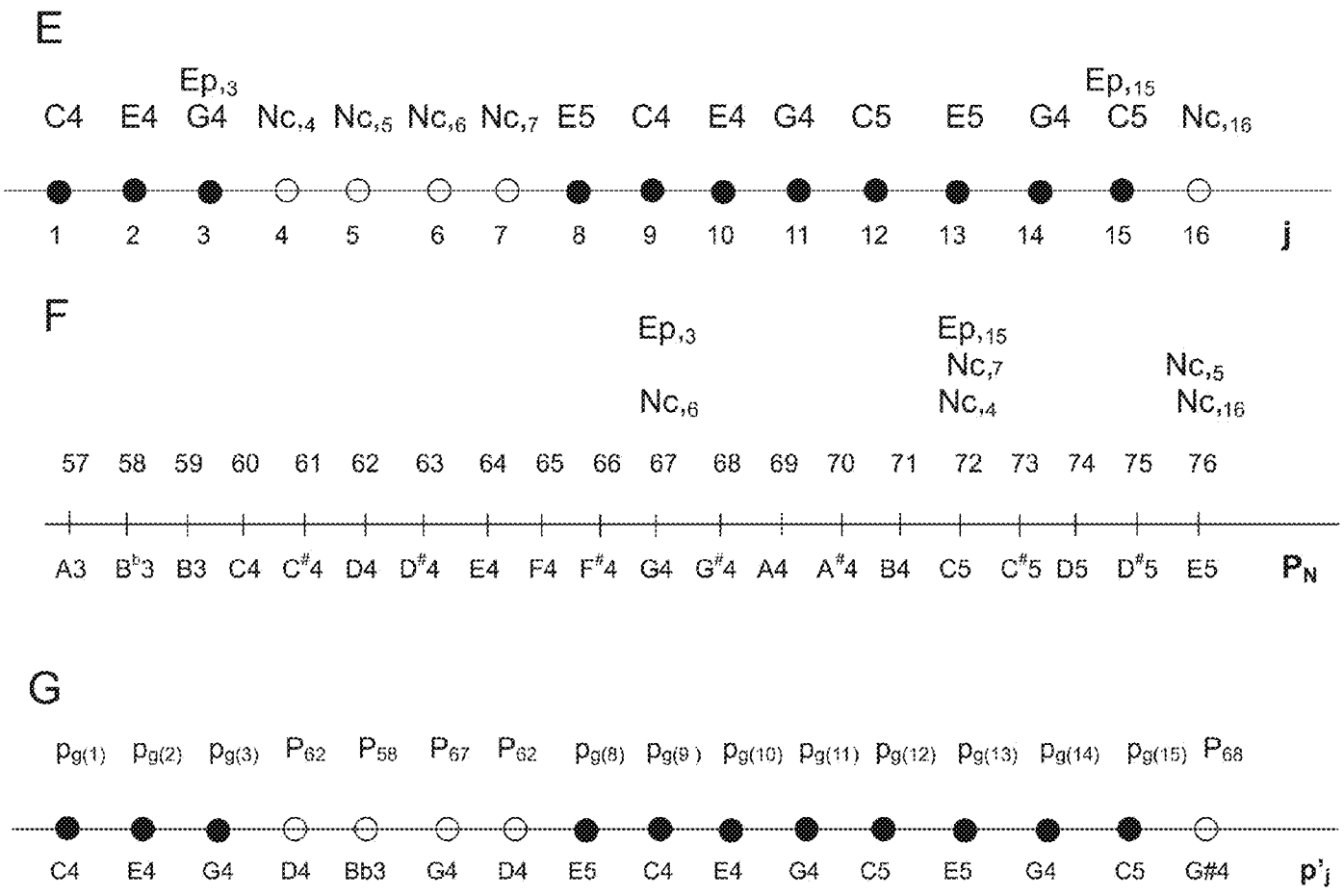
Figure 5B:
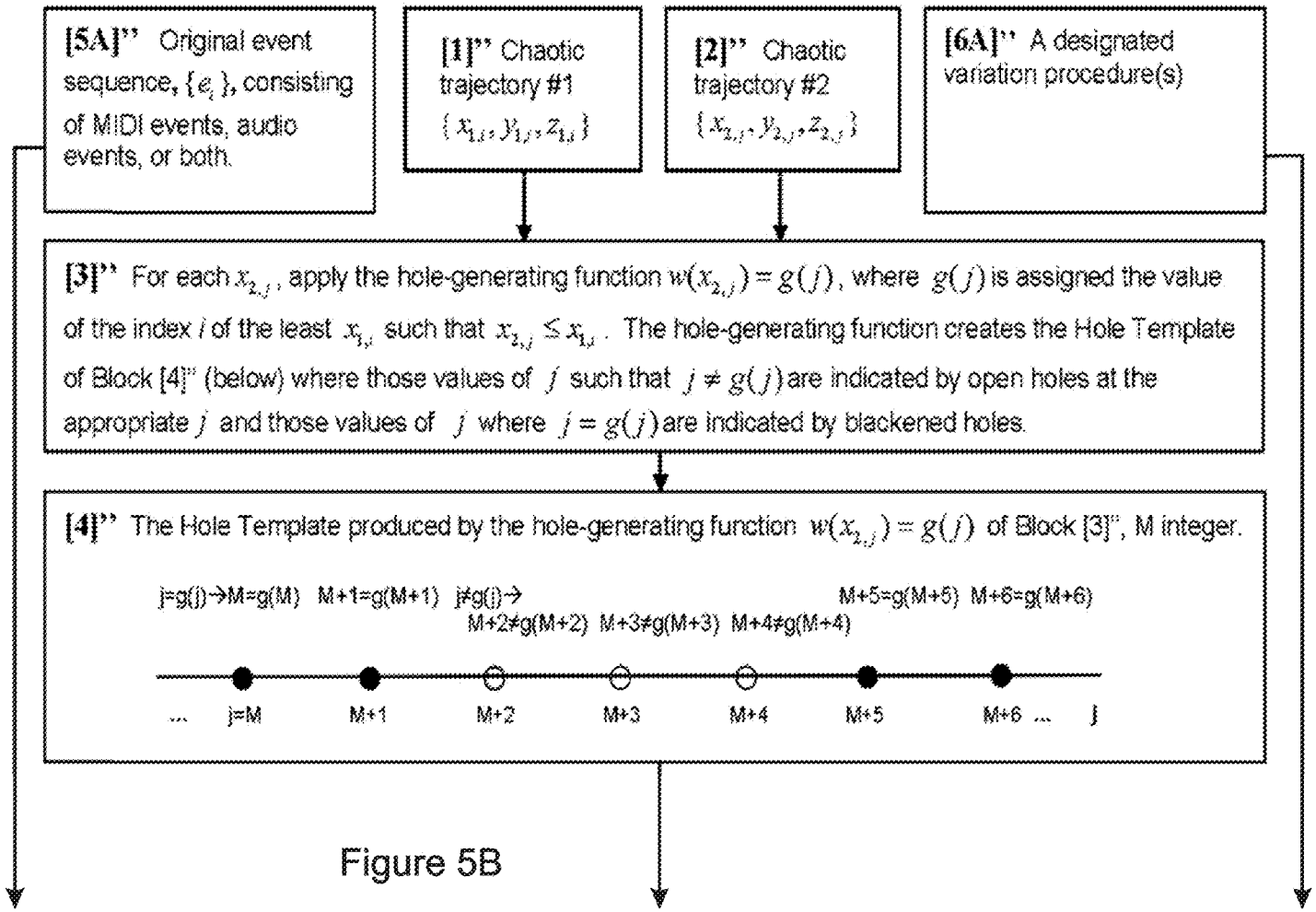
FIG. 5B is a flow diagram illustrating an Improved Chaotic Mapping algorithm of the embodiment of FIG. 5A.
Figure 5B:
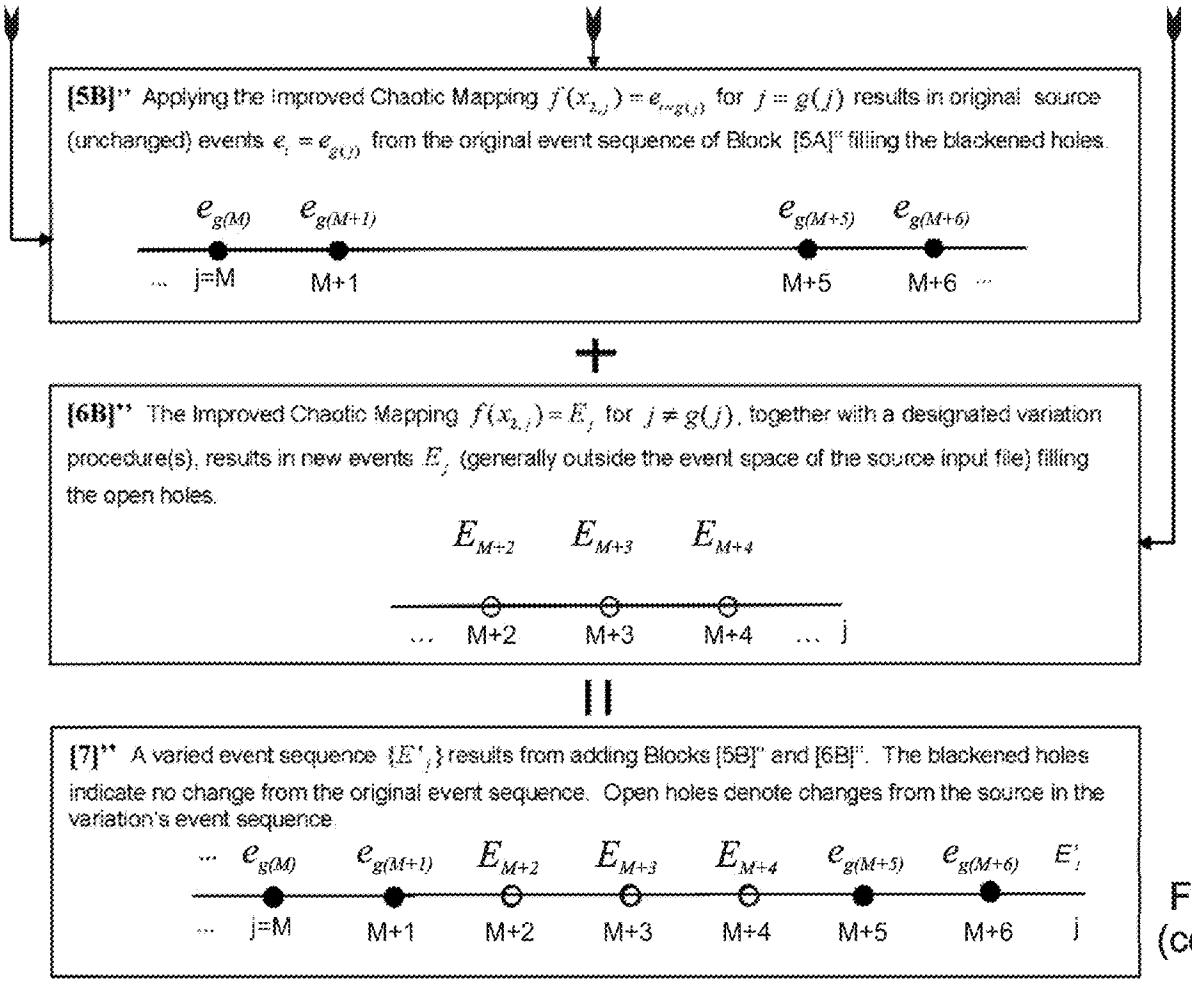

In Block [5], the Improved Chaotic Mapping of FIG. 5B operates on the original event sequence $\{e_i\}$ of Block [3], in conjunction with the designated variation procedure(s) of Block [4], in order to generate a variation of the event sequence $\{e_i\}$.

Block [6] denotes a variation of the source MIDI file of Block [1], consisting of changes to the event sequence parsed in Block [2], e.g., modifications to the original pitch/rhythmic sequence that result from introducing pitches and/or rhythmic patterns inside or outside the event space of the source piece.

The variation of Block [6] becomes the input to a MIDI sequencer (Block [7]) capable of playing the variation and outputting it as an audio signal to a Mixer (Block [8]). The Amplifier of Block [9] receives the audio signal of the variation, operates on it, and sends it through the Speakers of Block [10] so that the pitch and/or rhythmic variation of the source piece can be heard.

Embodiments Applied to Continuous Inputs Such as Audio Recordings

Figure 2:
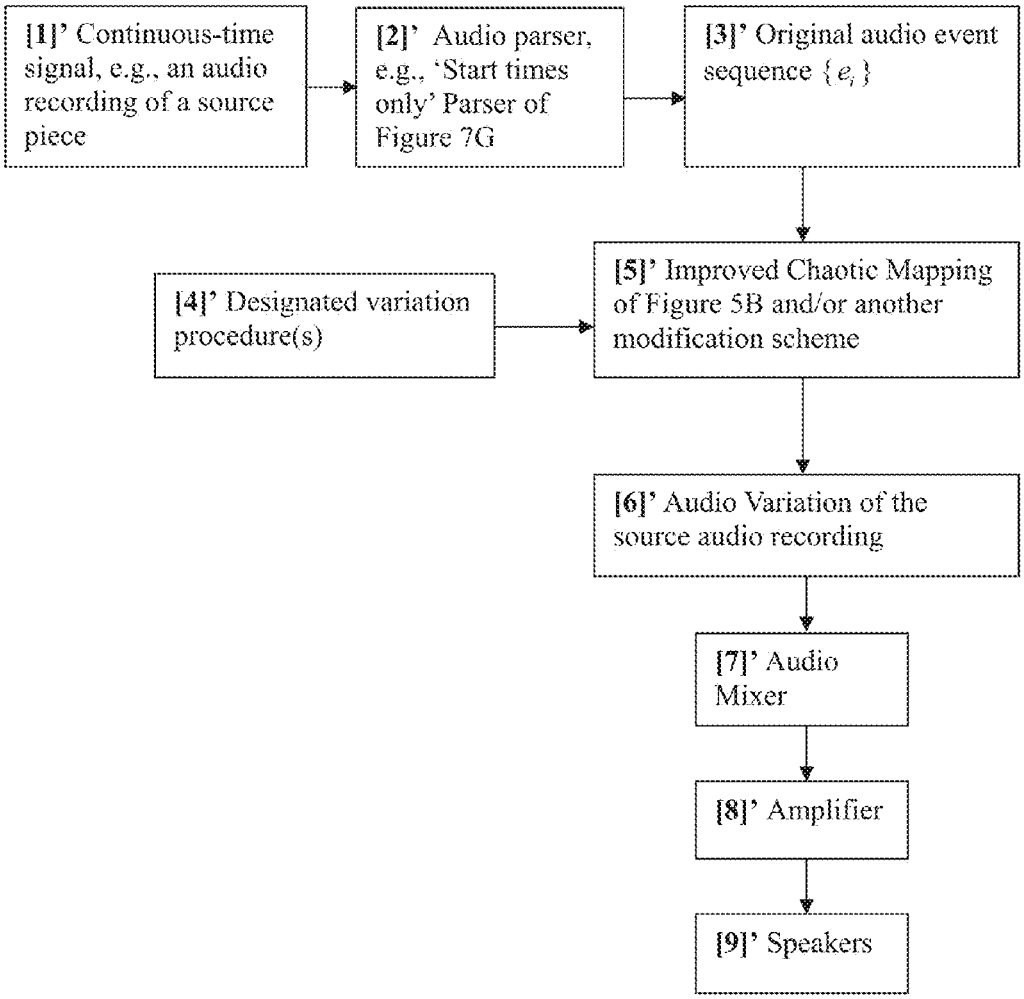
FIG. 2 is a flow diagram of an embodiment of the present invention that is adapted for application to audio and other recorded events.

FIG. 2 presents a flow diagram of an embodiment of the invention applied to making variations of a continuous-time signal representation of a given work, e.g., an audio recording (see Block [1]). Here, the term "designated variation procedure" is used to mean any modification and/or compositional technique.

Figure 7A:
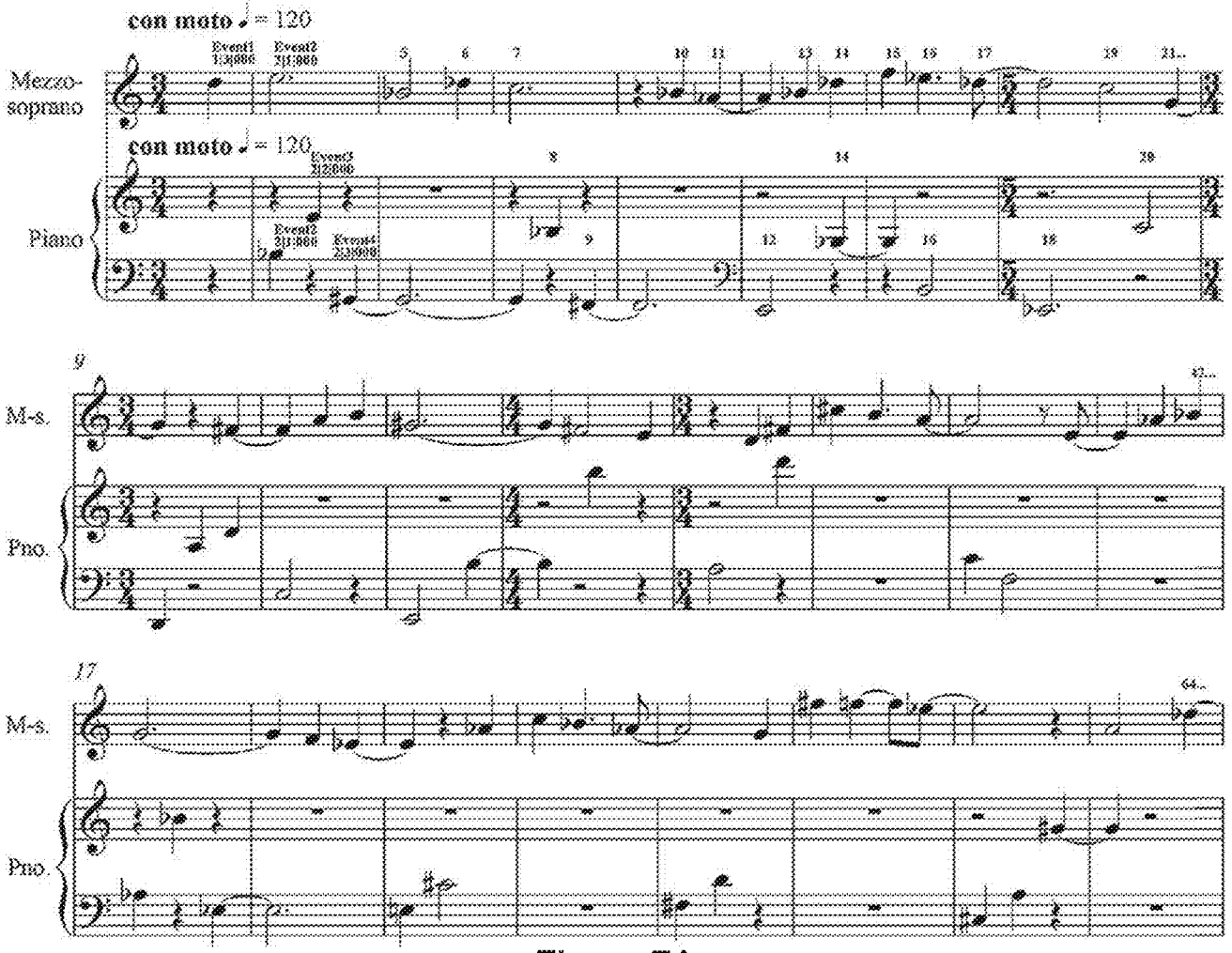
FIG. 7A is a musical example of a song (©2007 Diana Dabby) parsed in the manner of U.S. Pat. No. 5,606,144 (the "default parsing")
Figure 7A:
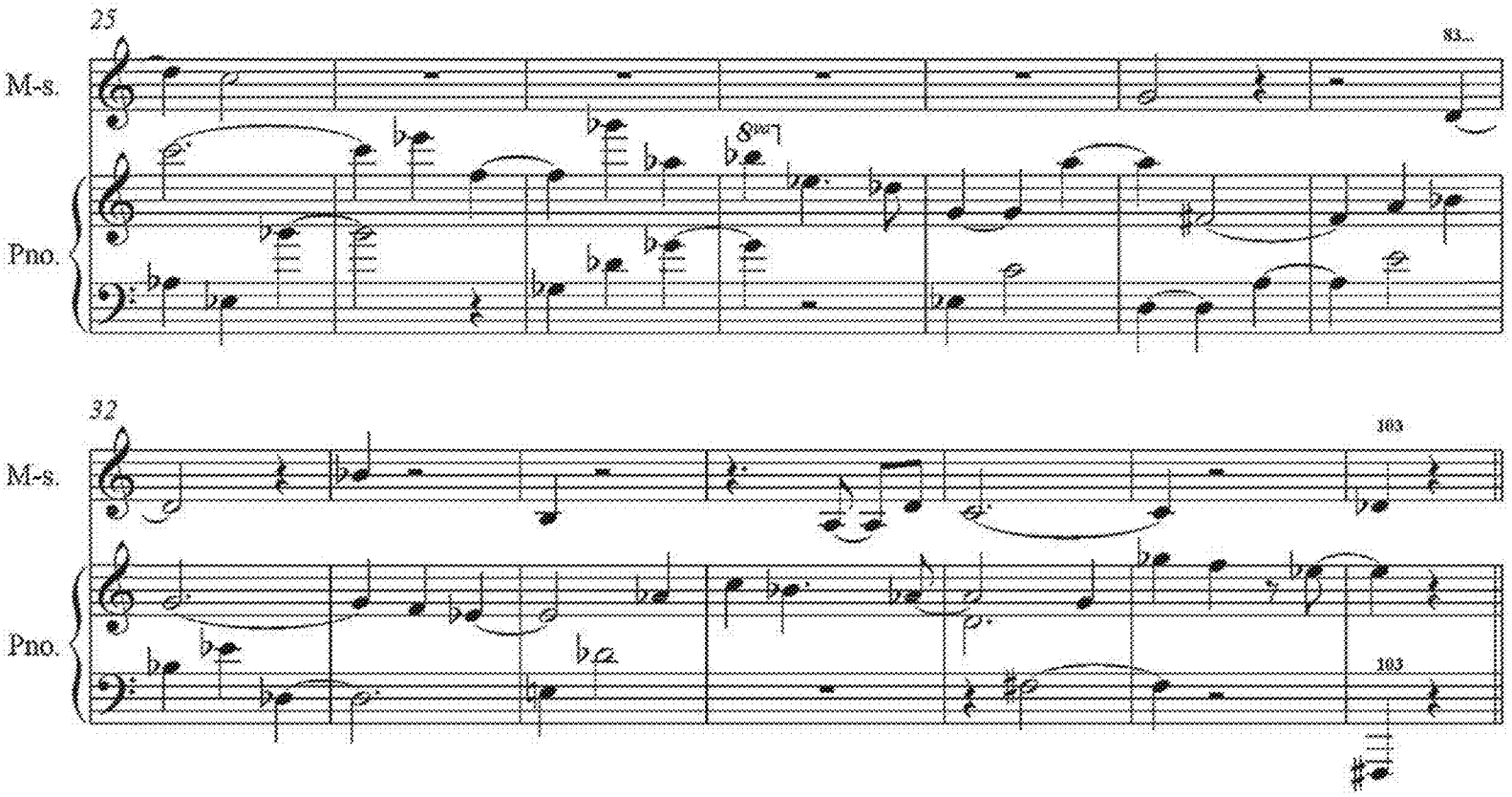
Figure 7B:
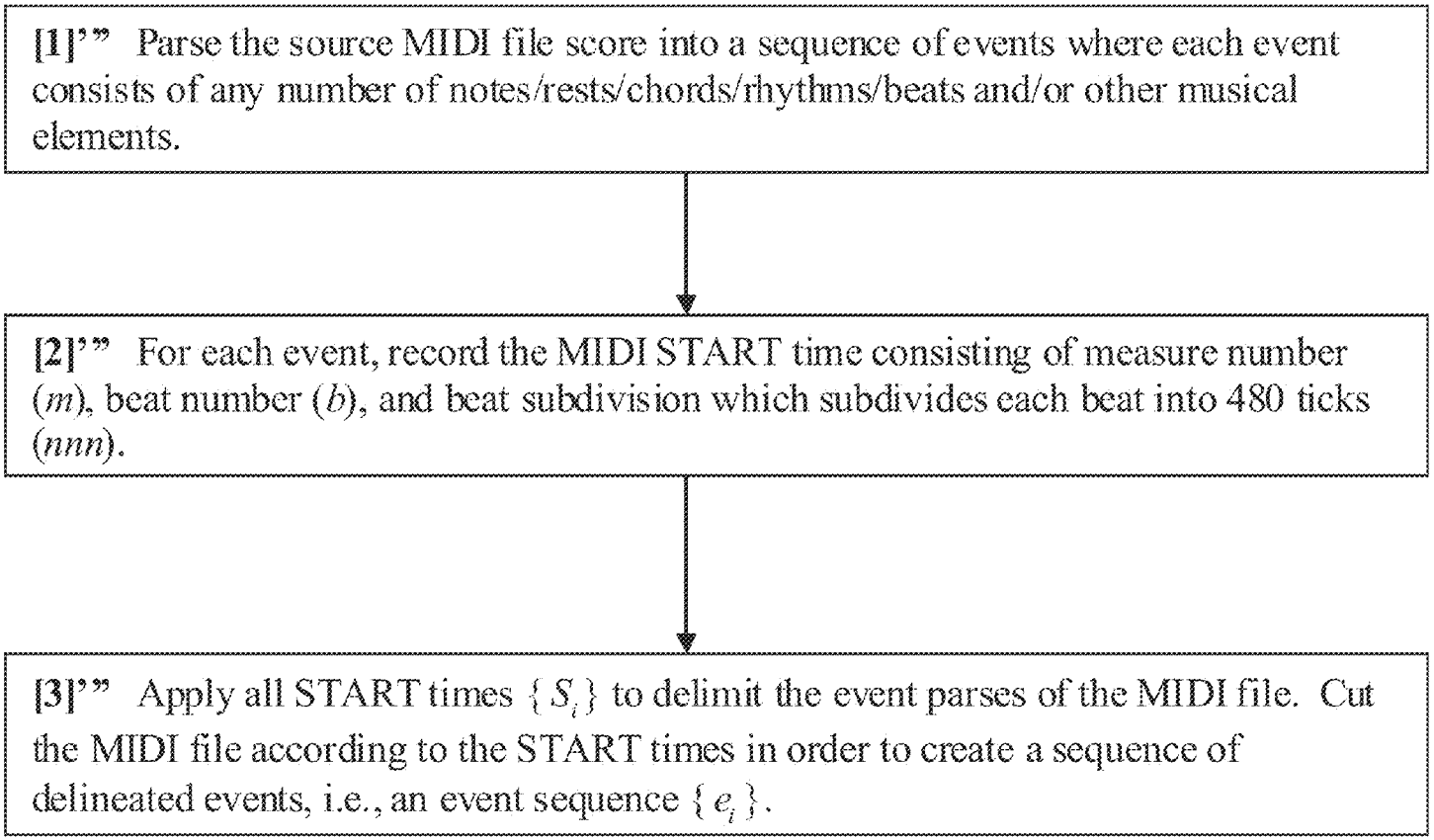
FIG. 7B is a flow diagram illustrating an exemplary algorithm in an embodiment of the present invention of a discrete-time signal parser applied to one or more notes/rests/chords/rhythms/beats in a MIDI file score.
Figure 7C:
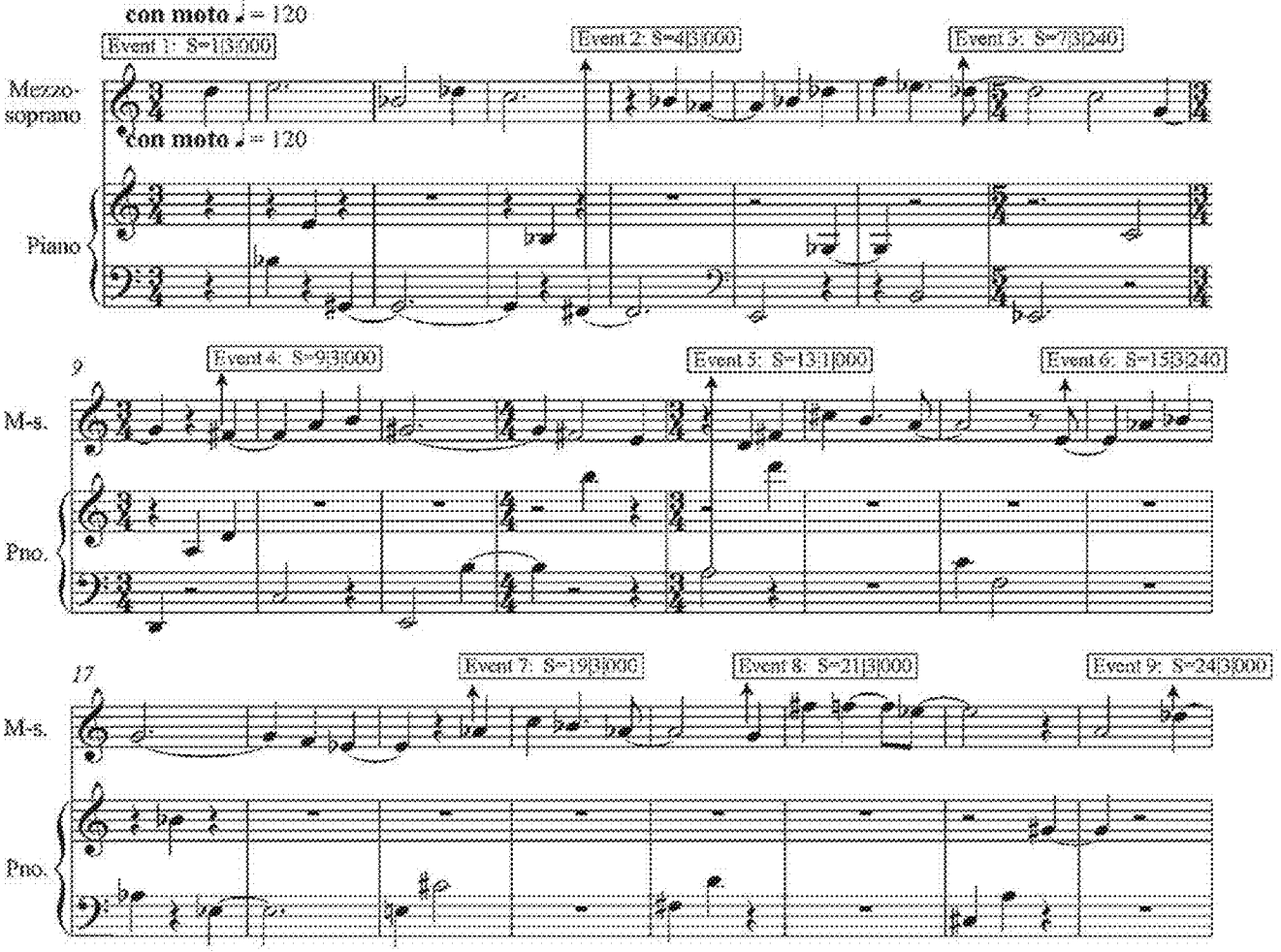
FIG. 7C is a musical example illustrating successively parsed MIDI file score events consisting of one or more notes/rests/chords/rhythms/beats and the event START times (S) in an embodiment of the invention.
Figure 7C:
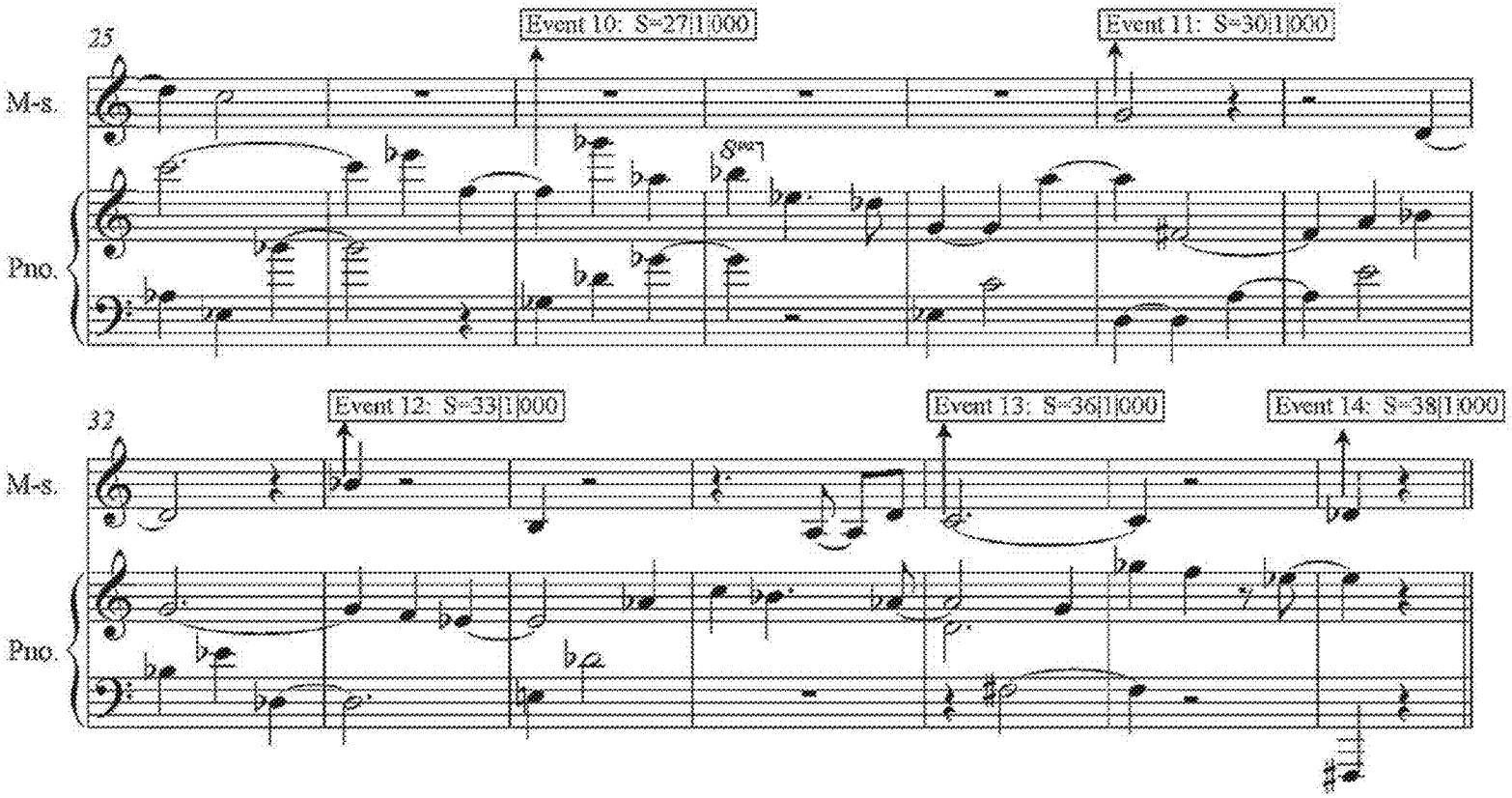
Figure 7D:
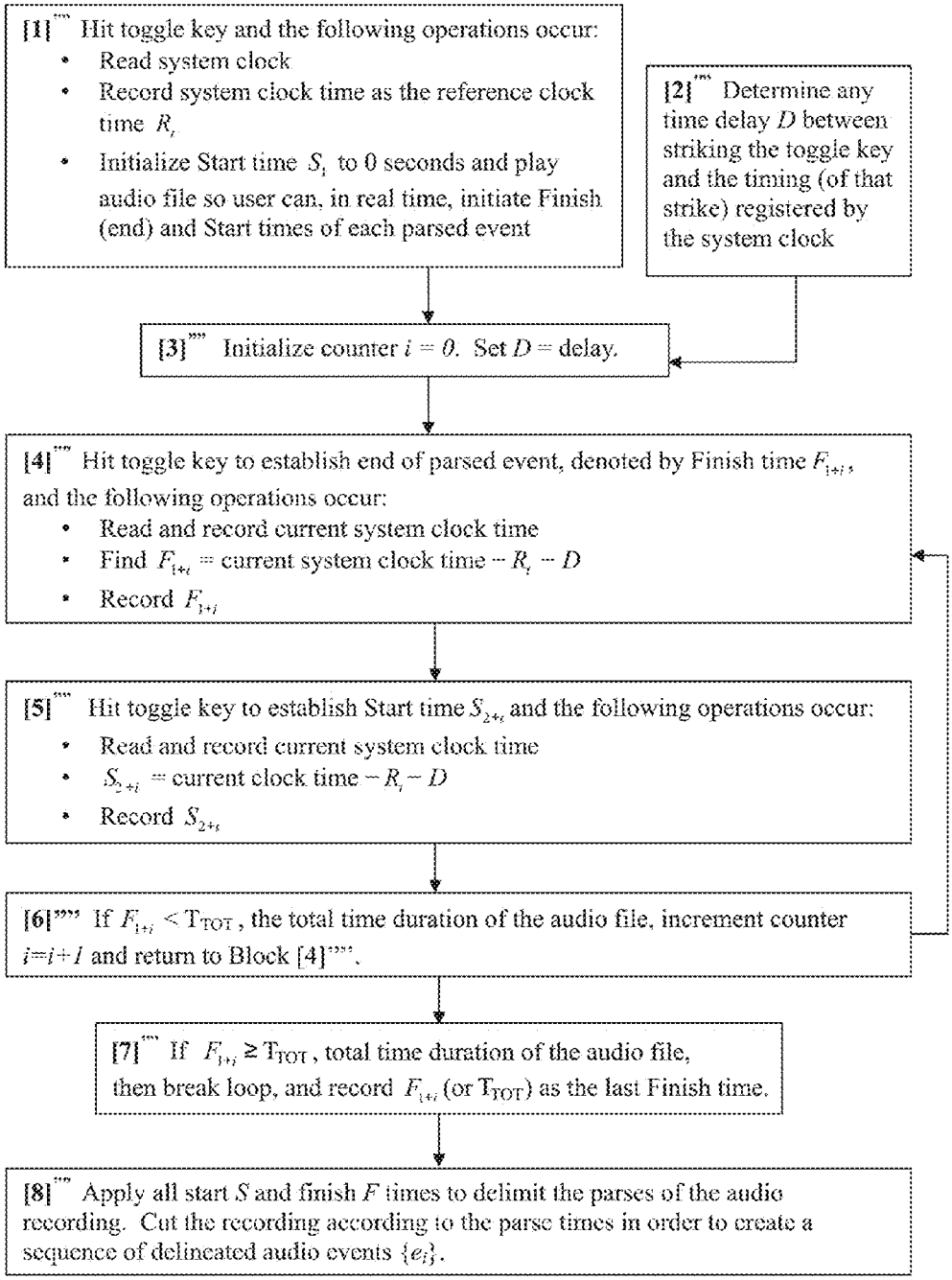
FIG. 7D is a flow diagram illustrating an exemplary toggle switch parser algorithm in an embodiment of the present invention applied to the continuous-time audio recording of FIG. 8.
Figure 7E:
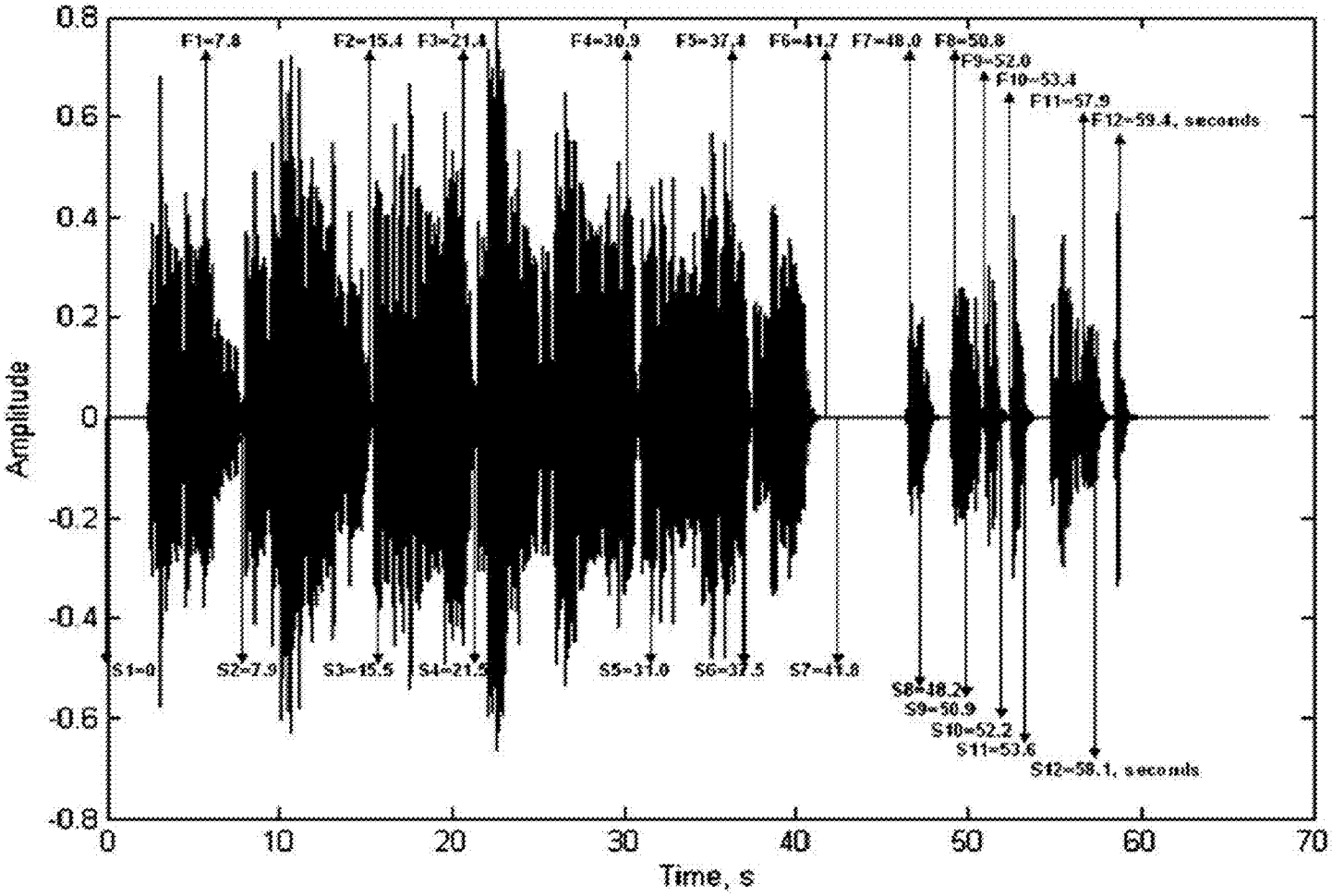
FIG. 7E is a graphical representation of an audio recording illustrating successive times of parsing of the time waveform of the song recording (vocal part only) of FIG. 8.
Figure 7F:
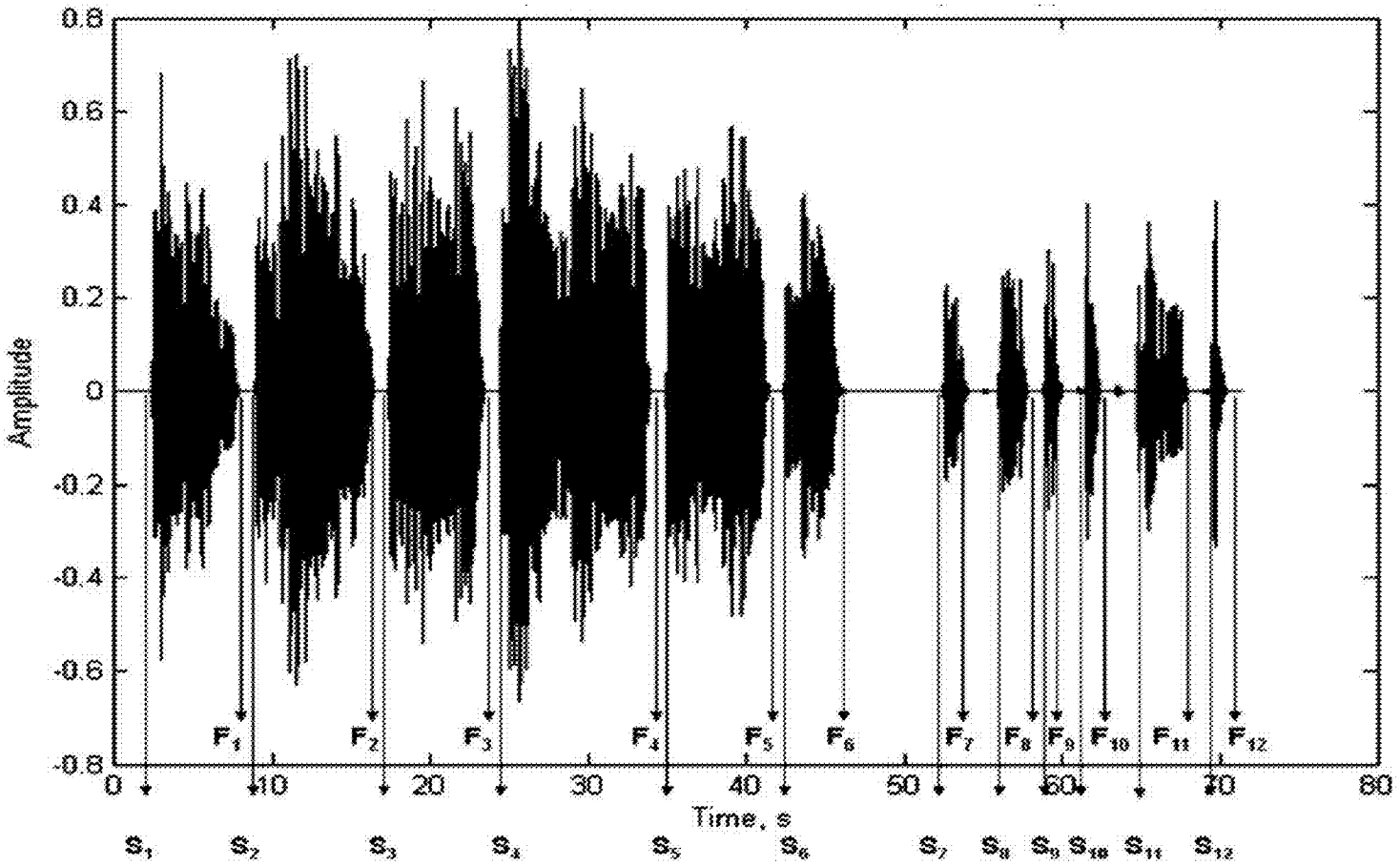
FIG. 7F is a graphical representation of an audio recording illustrating 12 parsed audio events of the song (vocal part only) of FIG. 8, wherein the events have been separated in time for clarity of illustration.
Figure 7G:
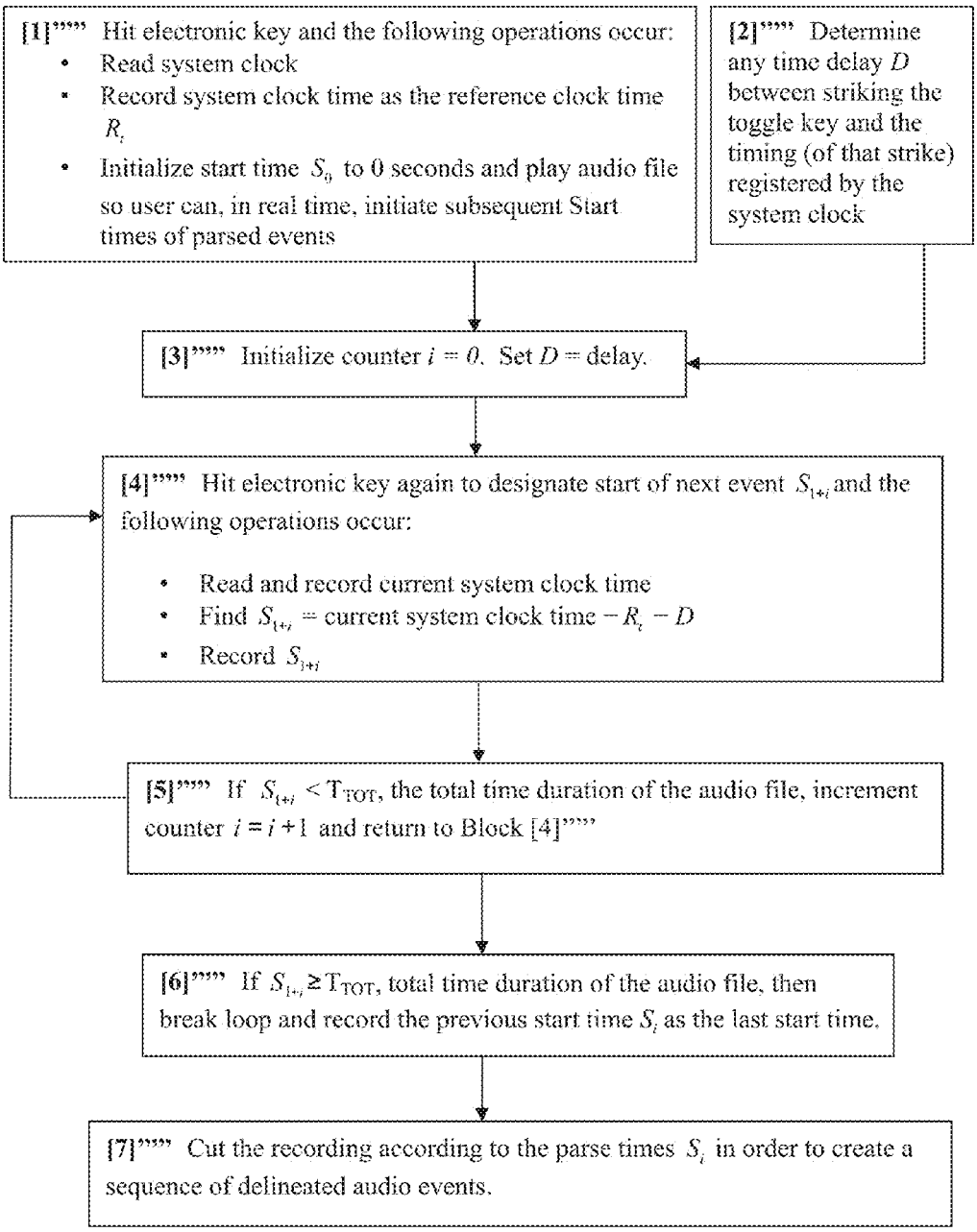
FIG. 7G is a flow diagram illustrating an exemplary embodiment of the 'Start-times only' parser of the present invention applied to a continuous-time signal such as the audio recording of FIG. 8.

An Audio Parser in Block [2], such as the 'Start-times only' Parser of FIG. 7G, is used to separate the audio recording into a sequence of discrete parsed audio events which constitute the event sequence $\{e_i\}$ of Block [3].

The Improved Chaotic Mapping of FIG. 5B (Block [5]) operates on the audio event sequence $\{e_i\}$ of Block [3], in conjunction with one or more designated variation procedures specified in Block [4].

The Audio Variation of Block [6] consists of changes to the event sequence of the source audio recording, as determined by the Improved Chaotic Mapping in conjunction with any designated variation procedure(s) of Block [4]. The Audio Variation of Block [6] passes through the Mixer, Amplifier, and Speaker systems of Blocks [7], [8], and [9] so that it can be heard.

Figure 13:
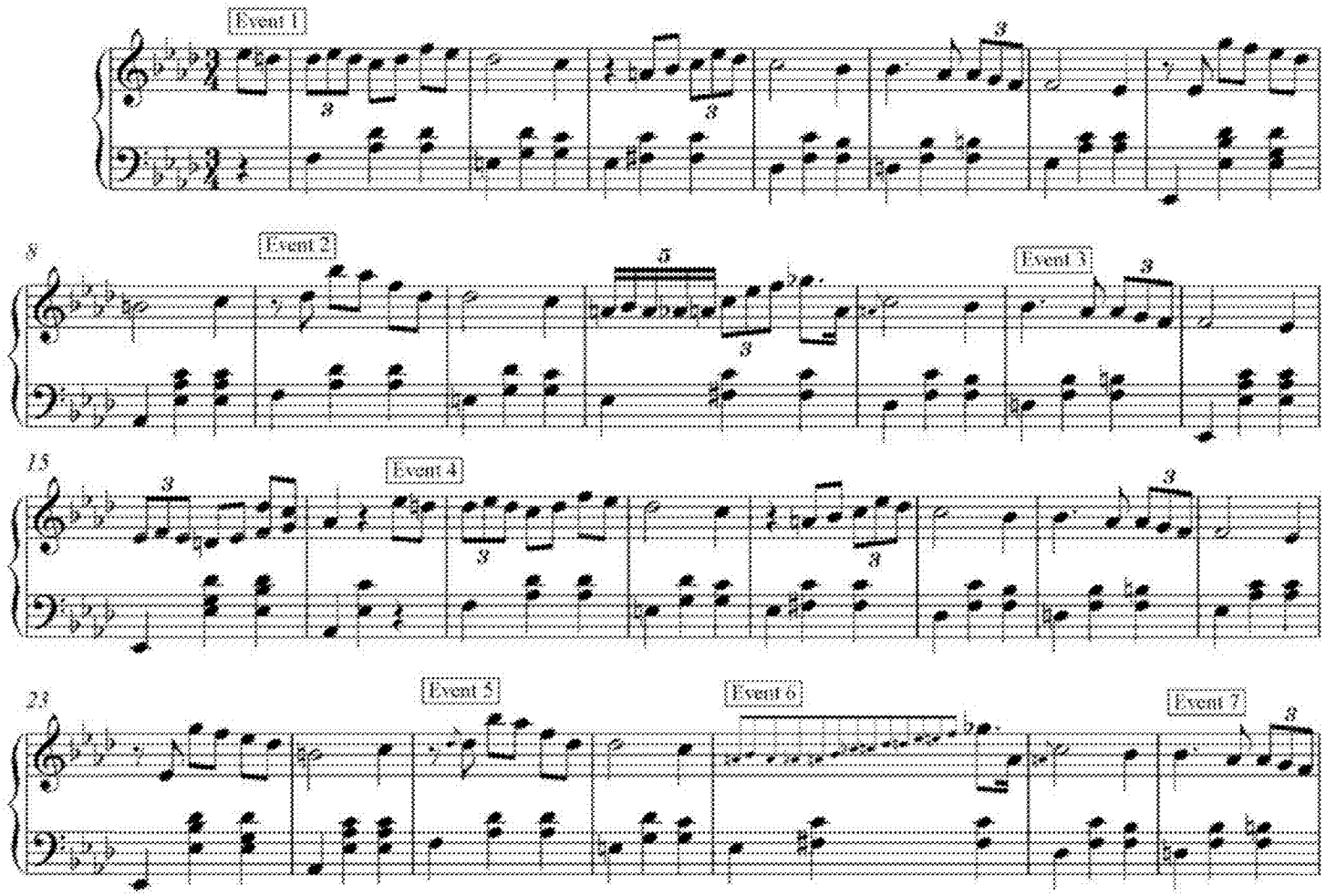
FIG. 13 is a musical score representation of an audio parsing of Chopin's Waltz in $A^b$, Op. 69, No. 1, created using an embodiment of the 'Start-times only' parser of FIG. 7G, where the parses differ in duration so as to demonstrate the Scanning Method.
Figure 13:
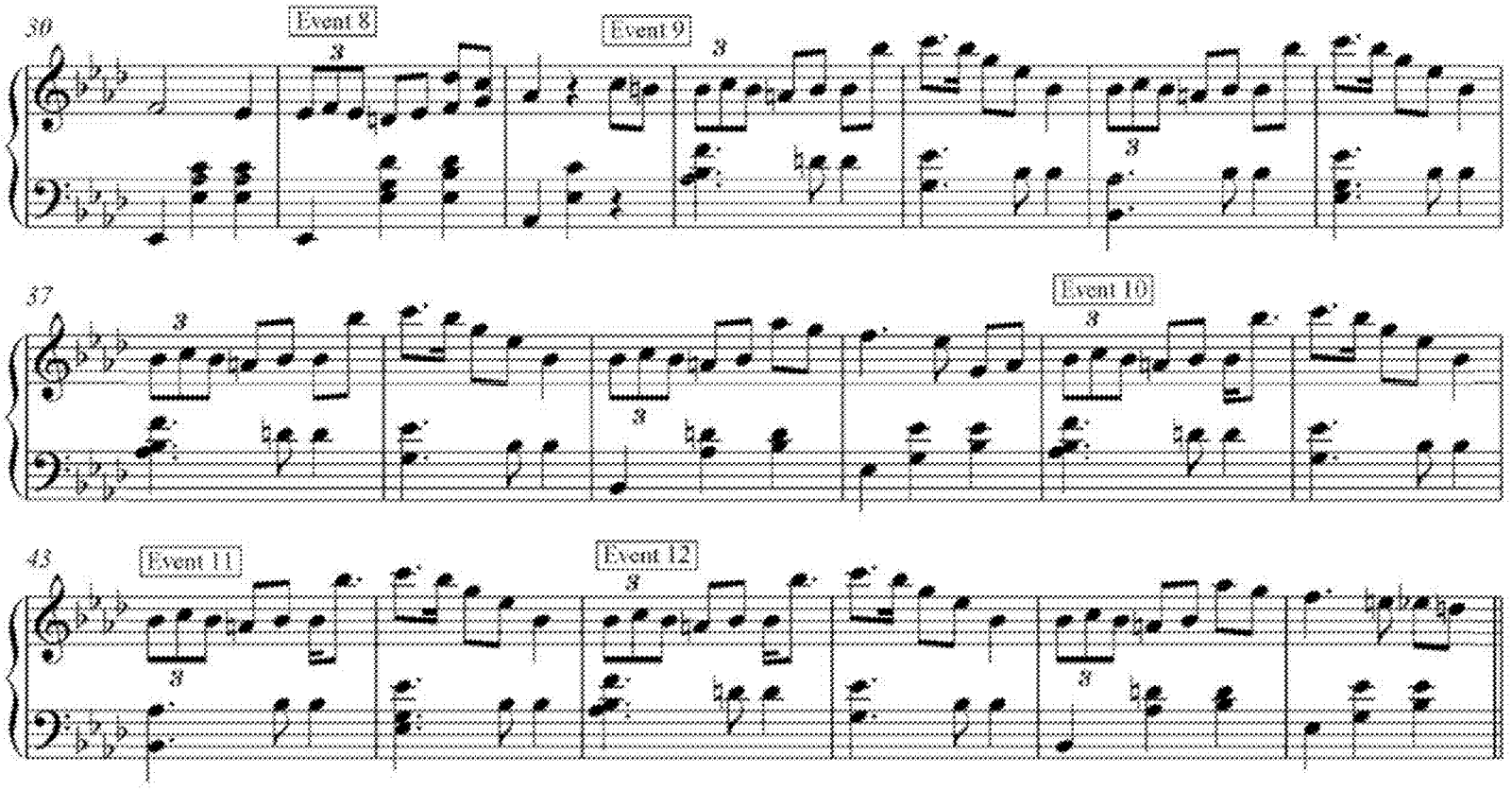
Figure 16:
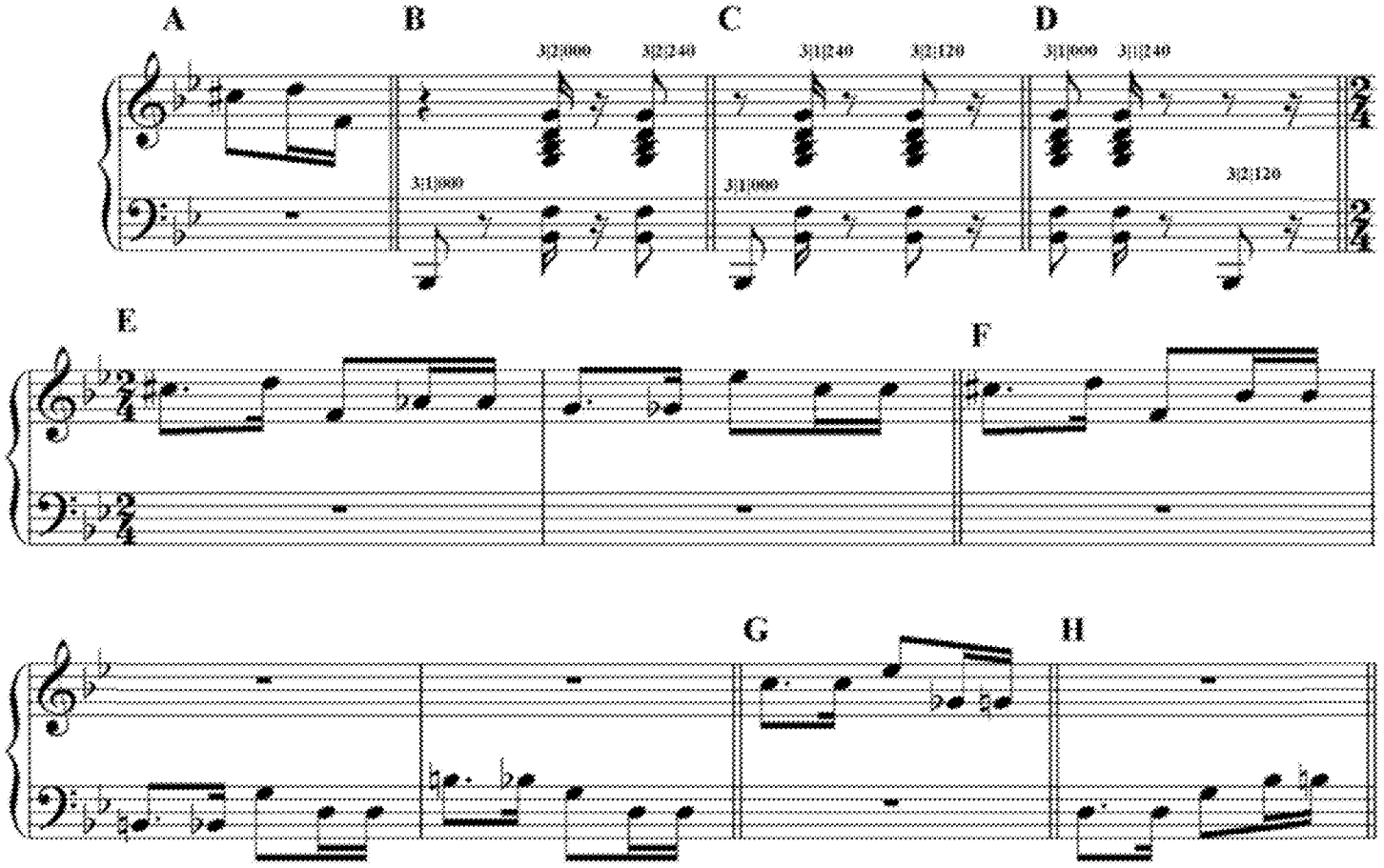
FIG. 16 is a musical score illustrating an embodiment of the Rhythmic-reversal Method algorithm applied to N-beat chunks.
Figure 17:
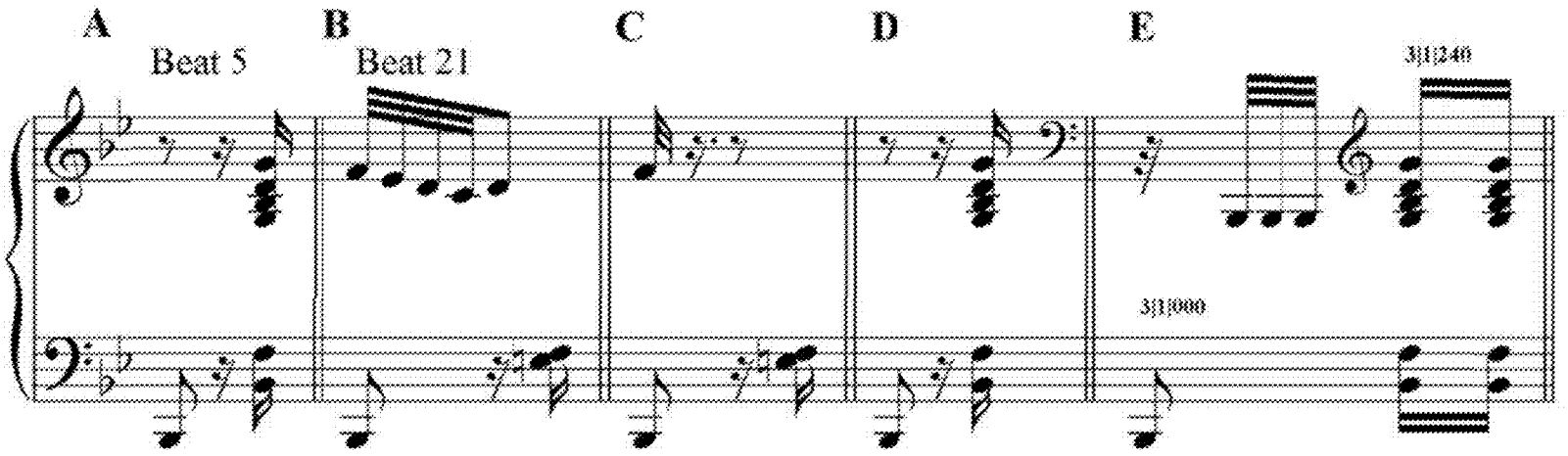
FIG. 17 is a musical score illustrating embodiments of the Basic Stenciling Algorithm and Expanded Stenciling Algorithm of the present invention applied to N-beat chunks.
Figure 18:
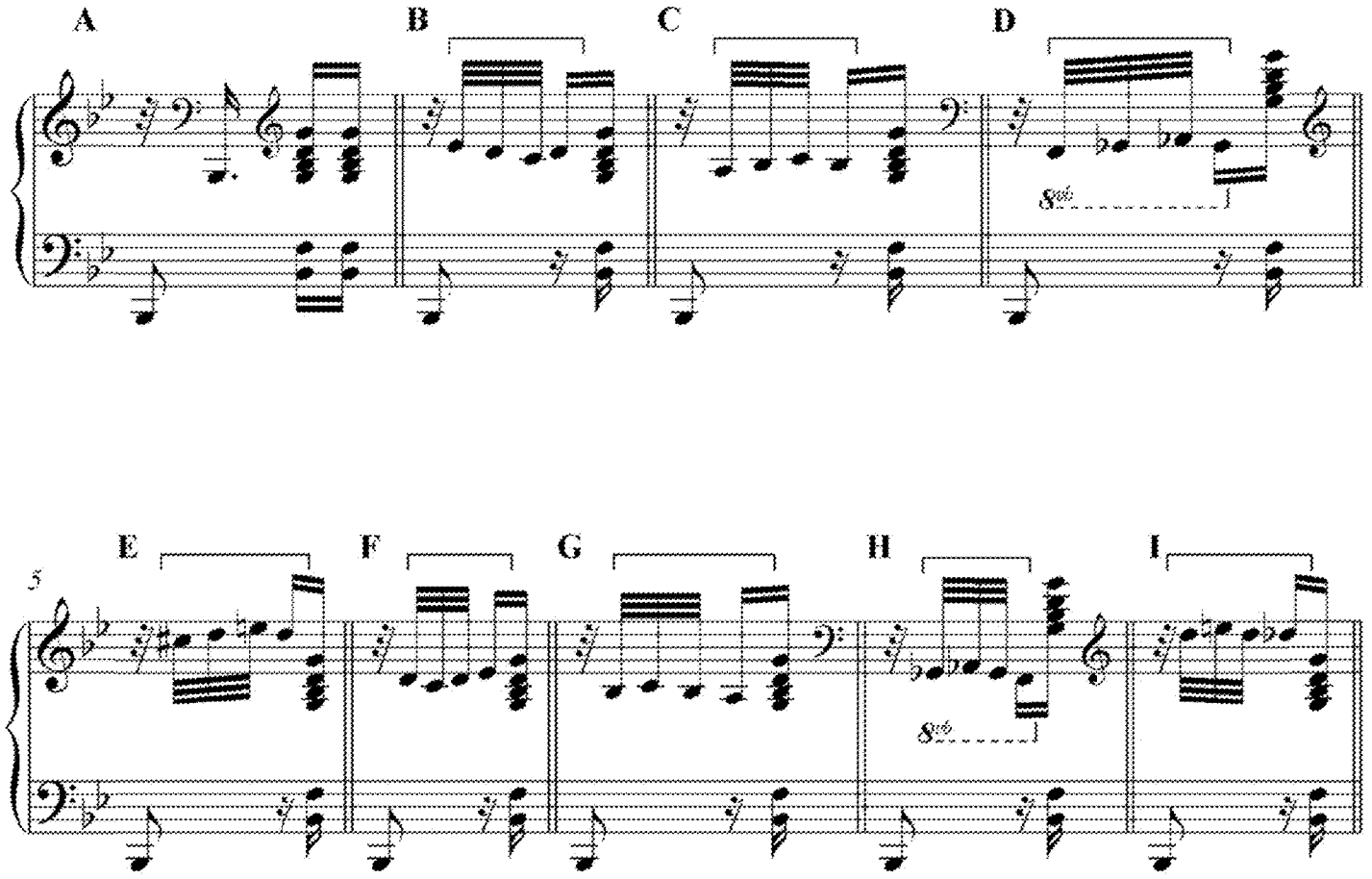
FIG. 18 is a musical score illustrating the application of nine options for the expanded stenciling algorithm so as to avoid any pitch repetition of the "nearest pitch" approach of Part E of FIG. 17.
Figure 19:
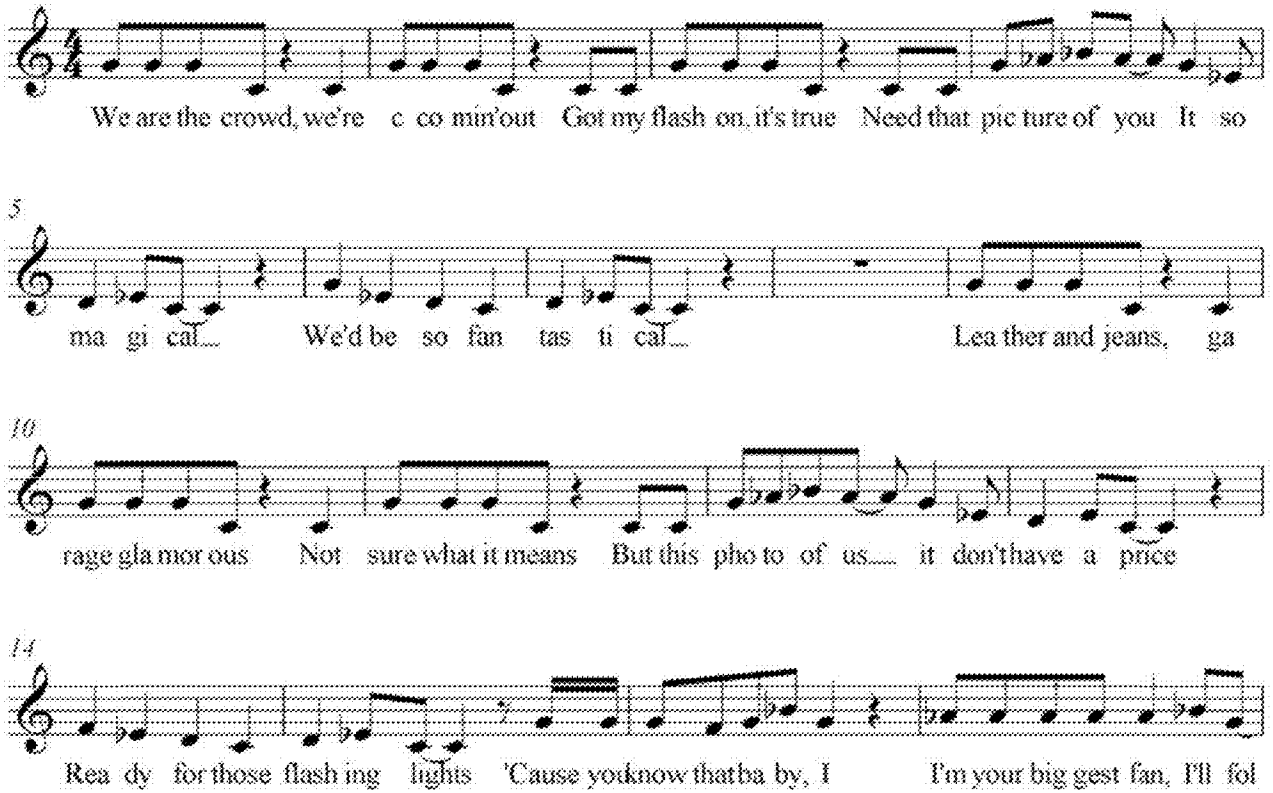
FIG. 19 is a musical score representation of the Lady Gaga mp3 vocal track recording of the song "Paparazzi" (words and music by Robert Fusari and Stefani Germanotta, ©2008 Sony/ATV Music Publishing, June Bug Alley Music and House of Gaga Publishing, Inc.)
Figure 19:
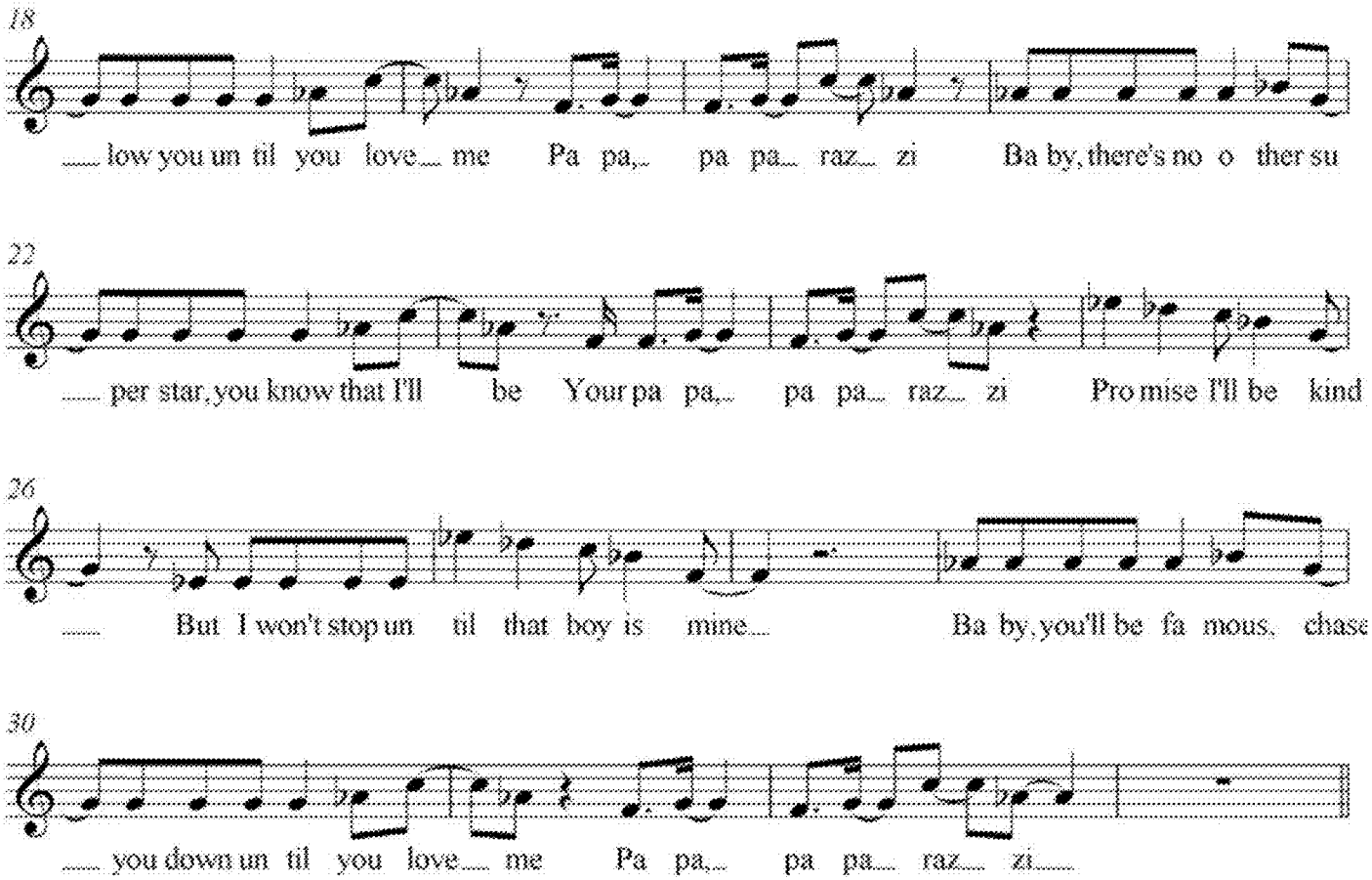
Figure 20:
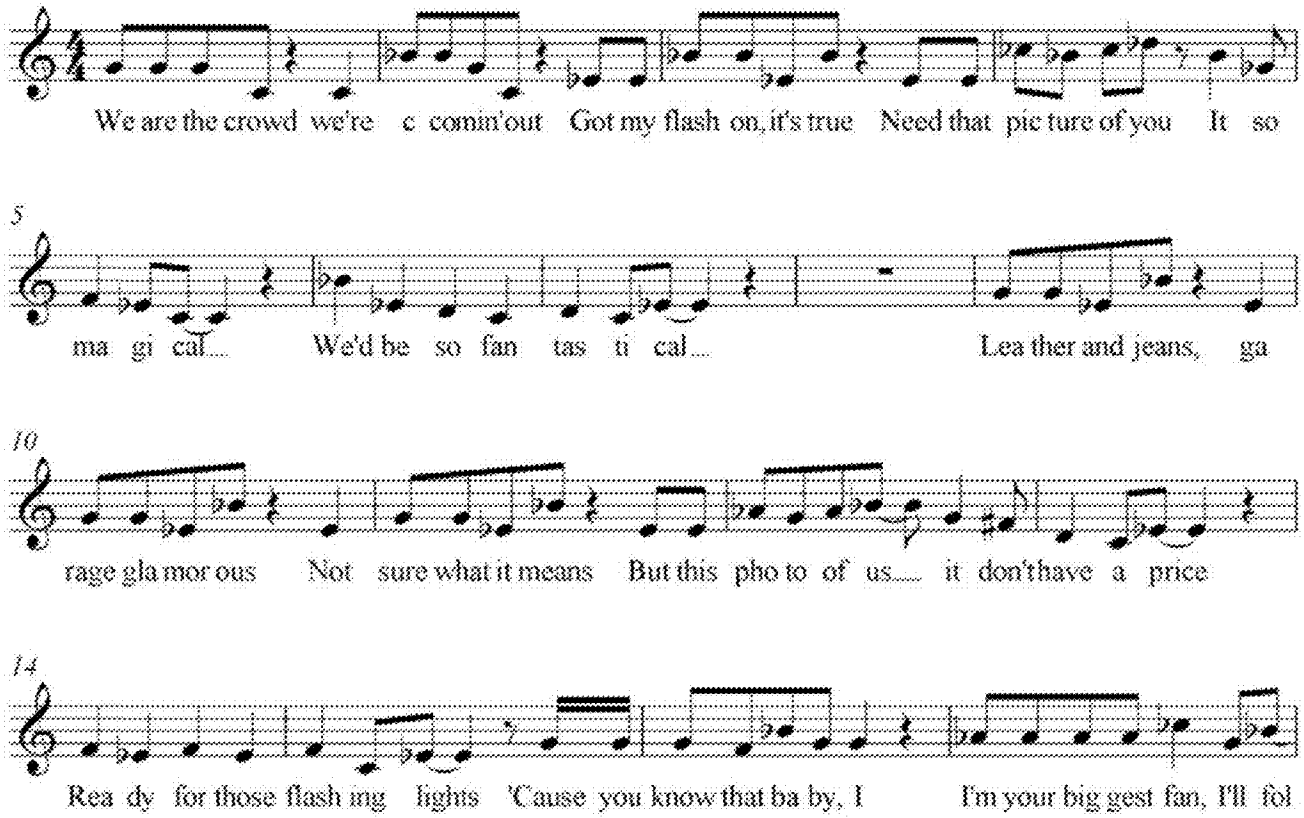
FIG. 20 is a musical score representation of an audio variation of the Lady Gaga mp3 vocal track recording of FIG. 19 created using an embodiment of the improved chaotic mapping method of the present invention in conjunction with embodiments of the interval method and of a reverse-pitch algorithm.
Figure 20:
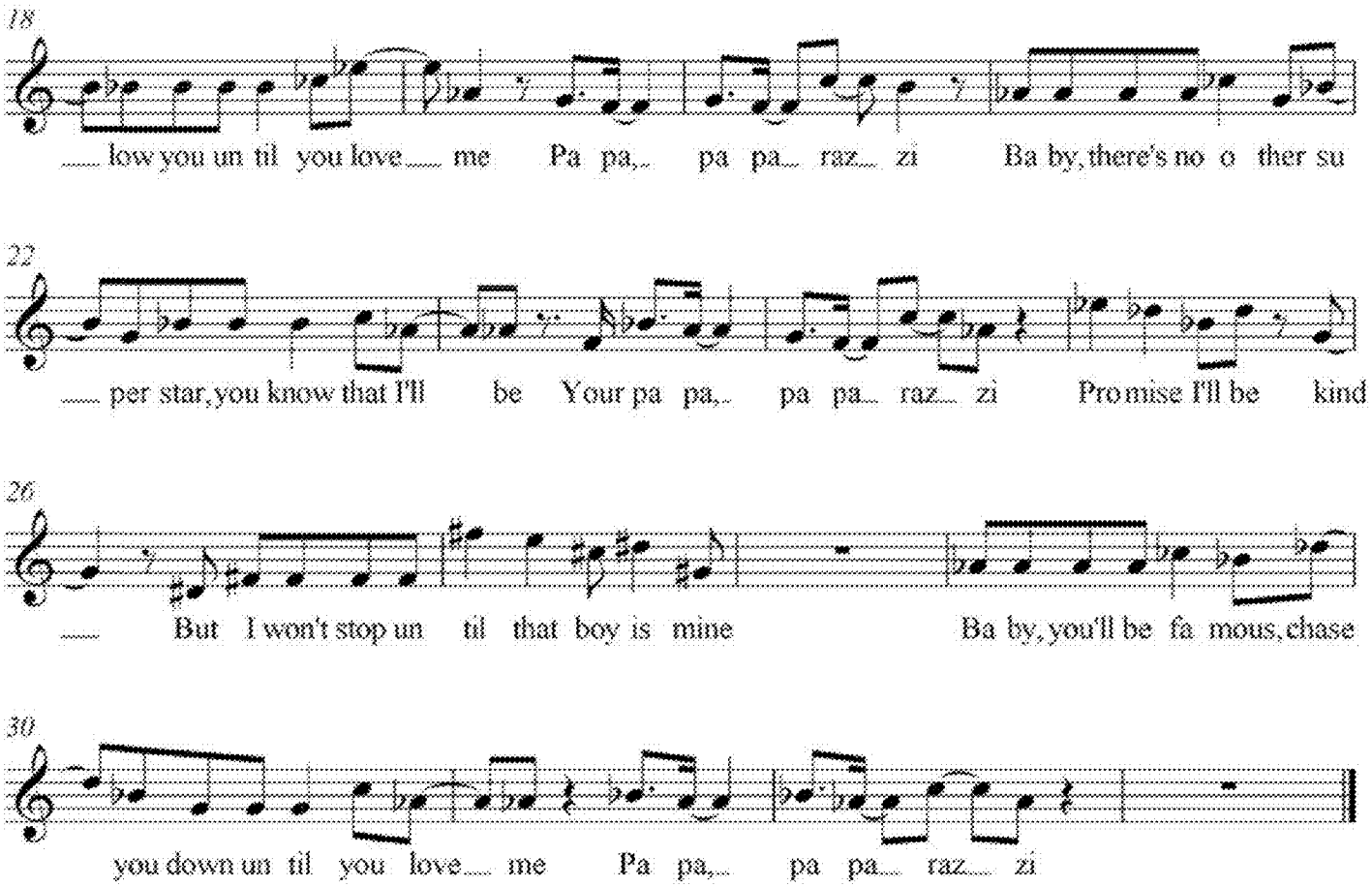
Figure 21:
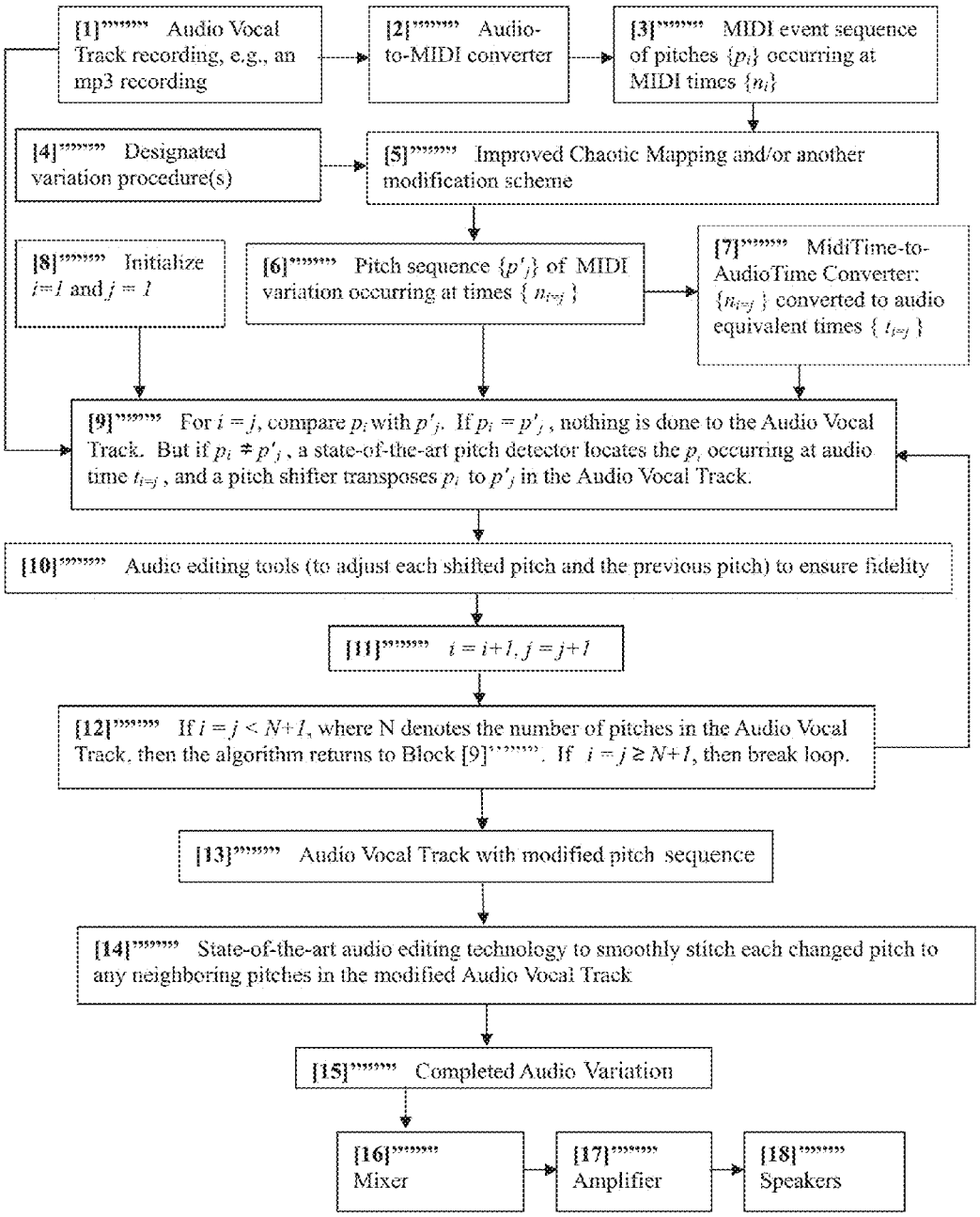
FIG. 21 is a flow diagram illustrating how the audio variation of FIG. 20 was created using an embodiment of the improved chaotic mapping method, with reversal and interval methods as designated variation procedures, so as to make a variation of an audio recording of the vocal line of FIG. 20.

FIGS. 1A, 1B and 2 provide an overview of embodiments of the present invention. The ensuing text now introduces and explains specific components applicable to various embodiments, including the following:

- the Extended-span Chaotic Mapping (FIG. 4),
- the Improved Chaotic Mapping (FIGS. 5A, 5B),
- the Discrete-time Signal Parsers,
  - the default MIDI parser of FIG. 7A,
  - the Discrete-time Signal Parser (FIG. 7B),
- the Continuous-time Signal Parsers,
  - the Toggle Switch Parser (FIG. 7D),
  - the 'Start-times only' Parser (FIG. 7G),
  - the Duration-specific Automatic Parser (FIG. 7H),
- the Interval Method for Audio Variation (FIG. 10),
- the Scanning Method for Audio Variation demonstrated with respect to FIG. 13,
- the Rhythmic-reversal Method Algorithms of FIG. 16,
- the Stenciling Method Algorithms of FIG. 17 and FIG. 18, and
- any of the above variation methods to generate Audio Variations on the level of individual notes and/or groups of notes (FIGS. 19-21).

The Original Chaotic Mapping of My Prior U.S. Pat. No. 5,606,144

Figure 3:
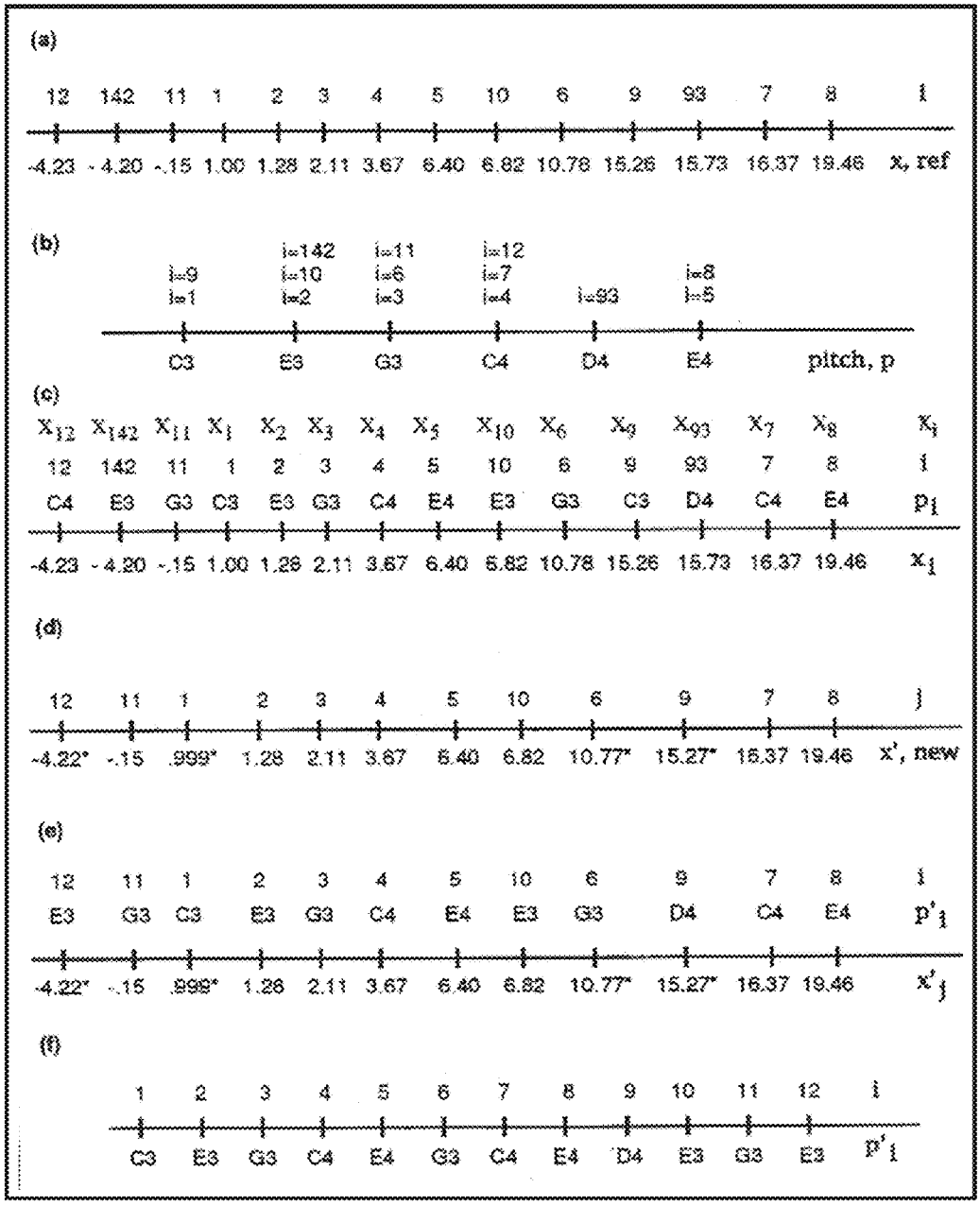
Figure 3 Prior Art
FIG. 3 is a prior art example of the chaotic mapping disclosed in U.S. Pat. No. 5,606,144.

The benefits of the Extended Span and Improved Chaotic Mapping algorithms of the present invention become apparent in comparison with the Original Chaotic Mapping algorithm of U.S. Pat. No. 5,606,144. FIG. 3 illustrates the original chaotic mapping or plotting that creates the variations, as disclosed in my earlier U.S. Pat. No. 5,606,144. First, a chaotic trajectory with an initial condition (IC) of (1, 1, 1) is simulated using a fourth order Runge-Kutta implementation of the Lorenz equations (1) through (3) given above, with step size h=0.01 and Lorenz parameters r=28, $\sigma$=10, and b=8/3. This chaotic trajectory serves as the reference trajectory. Let the sequence $\{x_i\}$ denote the x-values obtained after each time step (FIG. 3, part a). Let the sequence $\{p_i\}$ denote the pitches of the original piece, as shown in FIG. 3, part b. Each $x_i$ is then paired with a pitch $p_i$ from the pitch sequence $\{p_i\}$ (FIG. 3, part c). For example, the first pitch $p_1$ of the piece is paired with $x_1$, the first x-value of the reference trajectory; the second pitch $p_2$ is paired with $x_2$, and so on. The pairing continues until every $p_i$ has been paired with an $x_i$.

Next, a new trajectory is started at an IC differing from the reference (FIG. 3, part d), and thus initially displaced from the first trajectory. Each x-component $x'_j$ of the new trajectory is compared to the entire sequence $\{x_i\}$ in order to find the smallest or closest $x_i$, denoted $X_i$, that exceeds $x'_j$. The pitch originally assigned to $X_i$ is now ascribed to $x'_j$ (FIG. 3, part e). The above process is repeated, producing each pitch of the new variation. Sometimes the new pitch agrees with the original pitch ($p'_i=p_i$); at other times they differ ($p'_i \neq p_i$). Nevertheless, the variation (given in part f) consists of pitches from the input source file. The variation can retain the flavor of the source piece, provided the degree of displacement between the reference and new trajectories is small.

The Extended-Span Chaotic Mapping Method

When using the original chaotic mapping, the initial conditions (ICs) of the new trajectory must be chosen fairly close to those of the reference solution in order to create variations that 'make sense' stylistically, at least on an intuitive level. To allow more flexibility with the ICs, an improvement of the original chaotic mapping can be employed, in accordance with the present invention, which musically accommodates a greater departure in initial conditions for the second chaotic trajectory, compared to the first. Thus, for any given variation, ICs can be chosen for the first and second chaotic trajectories that differ from each other by a much greater margin, yet the variation will still maintain a reliable resemblance to the source piece. Such a result is not possible with the original chaotic mapping. This improvement of the original chaotic mapping is referred to herein as the "Extended-span Chaotic Mapping," because it extends the range of IC values that will produce the same pitch in the variation that occurred in the source piece. Thus, the Extended-span Chaotic Mapping is a kind of 'foolproof' chaotic mapping, because no matter how radically divergent the initial conditions, this mapping ensures an audible musical connection between the source composition and the variation than is otherwise possible with the original chaotic mapping.

Figure 4:
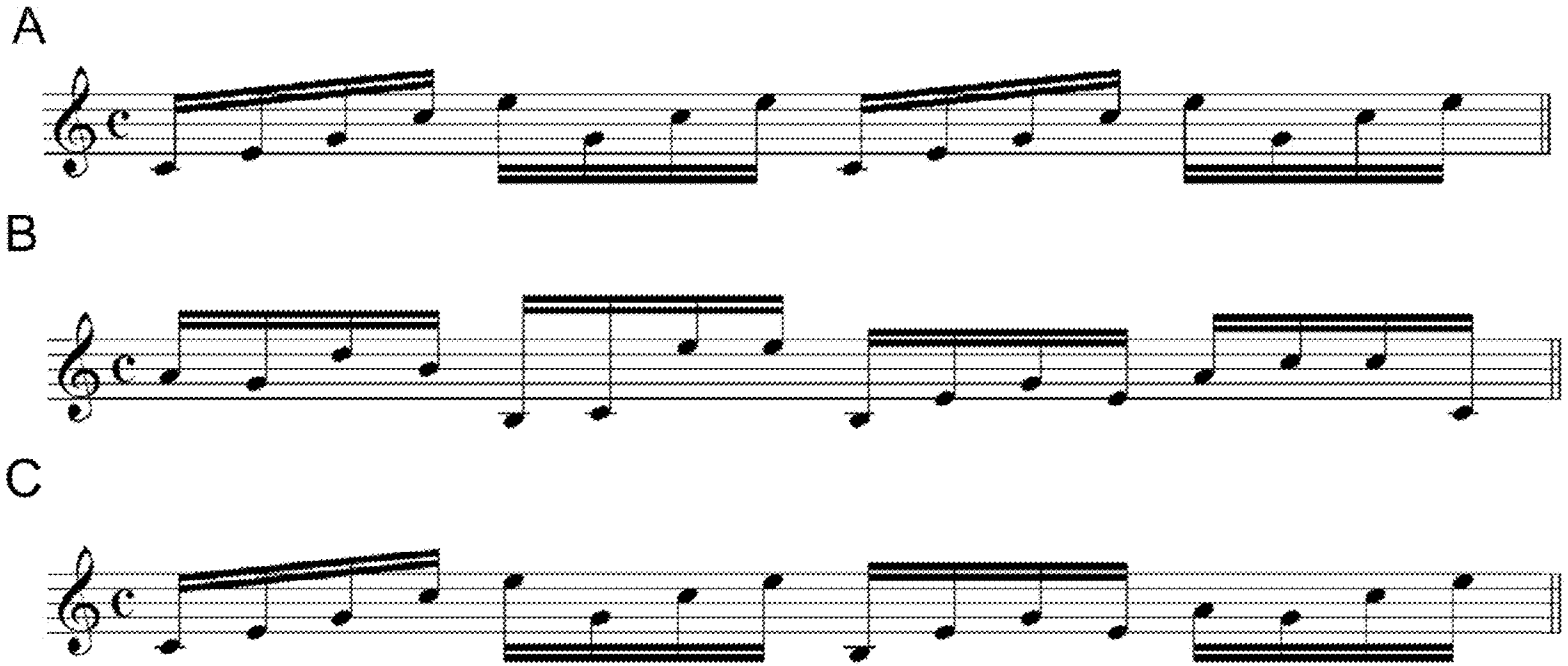
FIG. 4 illustrates the application of an Extended-Span Chaotic Mapping method of the present invention to the source Bach illustration of FIG. 6A (FIG. 2a of U.S. Pat. No. 5,606,144)
Figure 4:
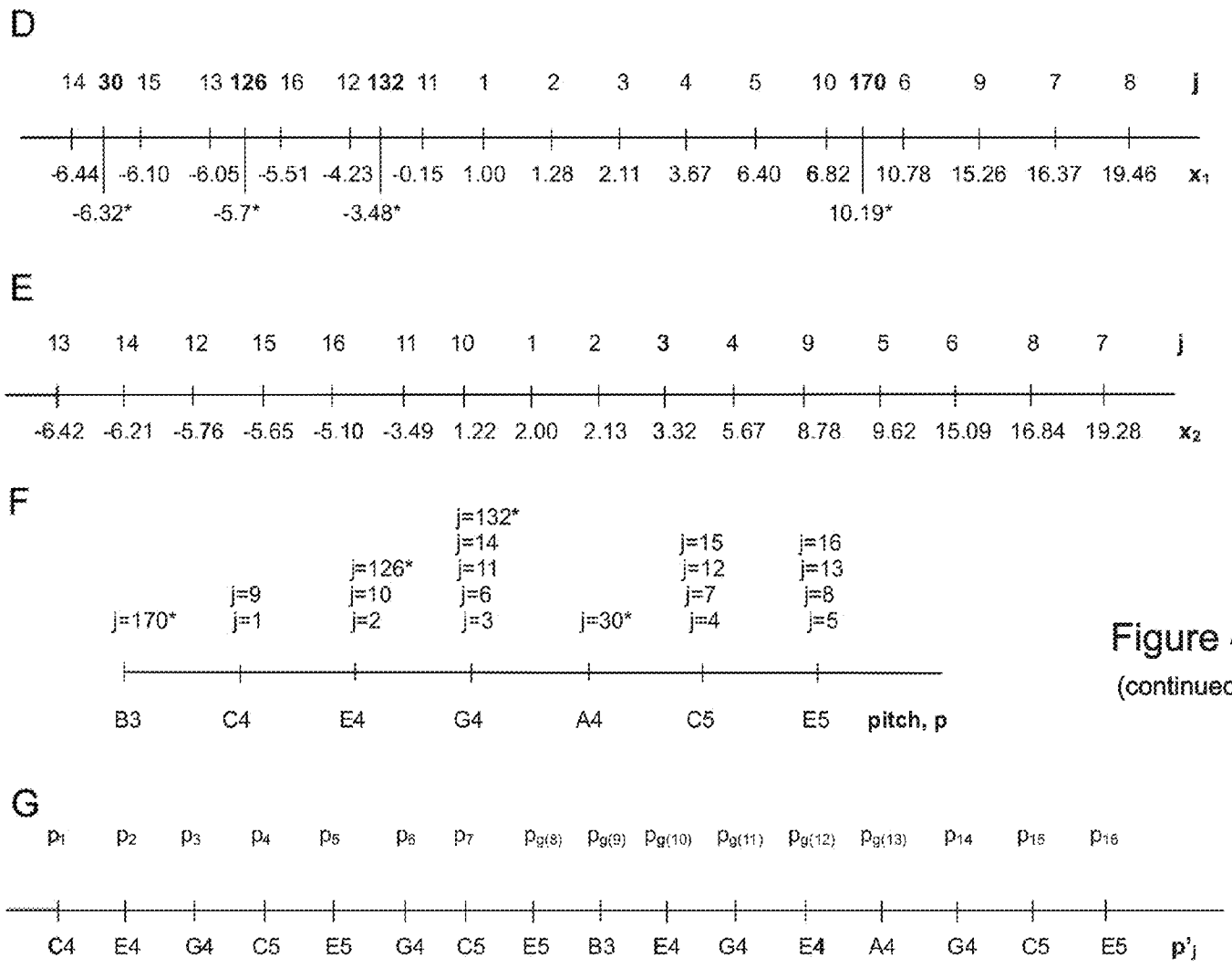

FIG. 4 illustrates the Extended-span Chaotic Mapping by first comparing the opening measure of Bach's Prelude in C from the Well-tempered Clavier, Book I (FIG. 4, part A), to the result of a variation generated by the original chaotic mapping (FIG. 4, part B). All sense of key and structure is lost in the latter. FIG. 4, part C shows a variation generated by the Extended-span Chaotic Mapping which not only conveys the key, but also preserves the five-part chorale structure of the Bach. The pitches which differ from the original harmony also make musical sense: the B3 and A4 serving as lower and upper neighbor notes to C4 and G4, respectively, where C4 denotes middle C.

To apply the Extended-span Chaotic Mapping, as earlier described, a chaotic trajectory with initial condition (IC) of (1, 1, 1) is simulated using a fourth-order Runge-Kutta implementation of the Lorenz equations. Let $x_{1,j}$ denote the j'th x-value of this first chaotic trajectory. FIG. 4 part D plots the sequence of $x_{1,j}$-values, obtained after each time step. Four other $x_{1,j}$-values are plotted: $x_{1,30}=-6.32$, $X_{1,126}=-5.7$, $x_{1,132}=-3.48$, and $X_{1,170}=10.19$. They are starred because each will prove significant when the Extended-span Chaotic Mapping is applied.

FIG. 4 part E plots the x-values $x_{2,j}$ of a second chaotic trajectory which starts at an IC (2, 1, 1) differing substantially from the first IC of (1, 1, 1). Let $p_j$ denote the j'th pitch from the pitch sequence $\{p_j\}$ of the Bach Prelude (FIG. 4, part F). As is well-known, chaotic trajectories are sensitively dependent on initial conditions. Thus, if one trajectory starts at IC (1, 1, 1), and a second trajectory starts at IC (2, 1, 1), the two trajectories will diverge much more radically than if the second trajectory had started at IC (0.999, 1, 1), for example.

In FIG. 4, part G, each x-component of the second chaotic trajectory $x_{2,j}$, in sequence, now undergoes the Extended-span Chaotic Mapping, $$f(x_{2,j}) = \left\{ \begin{matrix} p_{g(j)}, & x_{2,j} \le x_{1,j} \\ p_j, & x_{2,j} > x_{1,j} \end{matrix} \right\} = p'_j, \tag{7}$$

where g(j) is assigned the value of the index j of the least $x_{1,j}$ that is greater than or equal to $x_{2,j}$; thus $p_{g(j)}$ represents some pitch $p_j$ from the original Bach pitch sequence $\{p_j\}$ whenever $x_{2,j} \le x_{1,j}$. But if $x_{2,j} > x_{1,j}$, then the original pitch $p_j$ is retained in the variation.

In the example given here, since $x_{2,j} > x_{1,j}$ for j=1, . . . , 7, 14, 15, 16, the pitches of the variation match those of the source composition. But if the first condition of the Extended-span Chaotic Mapping applies, i.e., $x_{2,j} \le x_{1,j}$, the variation pitches may or may not replicate the source pitches, as can be seen in the variation pitches at locations j=8, . . . , 13. To determine $p_{g(8)}$, find the least $x_{1,j}$ that is greater than or equal to $x_{2,8}$, where $x_{2,8}=16.84$: $x_{2,8}=16.84 \le x_{1,8}$, where $x_{1,8}=19.46$. Furthermore, $x_{1,8}$ is the least $x_{1,j} \ge x_{2,8}$. Therefore, assign the index of $x_{1,8}$(j=8) to g(8) so that $g(8)=8 \rightarrow p_{g(8)}=p_8$. From part F, $p_8$=E5. Therefore, $p_{g(8)}$=E5=$p'_8$: this same pitch occurs in the variation exactly where it appeared in the source, i.e., at location j=8.

To determine $p_{g(9)}$, find those $x_{1,j} \ge =8.78$. Take the smallest one: $x_{1,170}=10.19$. Its index j=170 is now assigned to g(9); thus $p_{g(9)}=p_{170}$, and the 170$^{th}$ pitch B3 of the source Bach now appears as the ninth pitch of the variation. Proceeding in like manner, $p_{g(10)}$ of the variation will yield E4 ($p_2$ of the original Bach), $p_{g(11)}$ will give G4 ($p_{132}$ of the original Bach), $p_{g(12)}$ will return E4 ($p_{126}$ of the original Bach), and $p_{g(13)}$ will give A4 ($p_{30}$ of the original Bach). Recall that pitches 14-16 match those of the source, as given above. In this way, the Extended-span Chaotic Mapping constructs the pitches $p'_j$ of the variation, shown in FIG. 4 part G.

The Improved Chaotic Mapping Method

FIG. 5A illustrates the Improved Chaotic Mapping method, showing how the first 16 pitches of a variation of the Bach Prelude in C (from the Well-tempered Clavier, Book I) are constructed (FIG. 5A, part A). One pitch immediately stands out in the variation: the last pitch G#4 (shown in part A) does not occur in the original Bach Prelude (nor does its enharmonic equivalent Ab4). Such a variation would have been impossible with the original chaotic mapping, as well as the Extended-span Chaotic Mapping, since with these techniques no pitch can appear in the variation that was not already present in the original source piece. The G#4 arises from the Improved Chaotic Mapping working in conjunction with Dynamic Inversion, a new variation procedure described in more detail below.

Notice further that parts B, C, and D of FIG. 5A are indexed only from numbers 1-16; no other indices are indicated, as compared to the 93$^{rd}$ and 142$^{nd}$ indices apparent in part C of FIG. 3, as well as the 30$^{th}$, 126$^{th}$, 132$^{nd}$, and 170$^{th}$ indices shown in parts D and F of FIG. 4. Such indices result from a significant property of the original chaotic mapping and the Extended-span Chaotic Mapping: both techniques produce variations of an input file by using only the pitches/chords from that file.

FIG. 5A, part B shows the pitch sequence $\{p_i\}$ of the Bach Prelude in C where each $p_i$ denotes the i$^{th}$ pitch of the sequence. A fourth-order Runge-Kutta implementation of the Lorenz equations simulates a chaotic trajectory with initial condition (IC) of (1, 1, 1) where each $x_{1,i}$ denotes the i$^{th}$ x-value of this first chaotic trajectory, shown in FIG. 5A, part C.

FIG. 5A, part D plots the sequence of x-values $\{x_{2,j}\}$ of a second chaotic trajectory with ICs (1.002, 1, 1) differing from those of the first trajectory. The values in FIG. 5A part D have been rounded to two decimal places. (Rounding takes place after each trajectory has been simulated.) FIG. 5A, part E shows the result of applying a 'hole-generating' function, $w(x_{2,j})=g(j)$, where g(j) is assigned the value of the index i of the least $x_{1,i}$ for which $x_{2,j} \le x_{1,i}$. Blackened 'holes' indicate all j for which j=g(j), and signify those places in the variation that will retain the pitches of the original Bach. Open 'holes' indicate those j for which j≠g(j) and serve as holding places for new pitch events (lake events). As an example, for j=1, apply the function $w(x_{2,j})=g(j)$ to determine the value of g(1): first deduce that the initial value of $x_{2,1}$ is 1.002 from part D, which is now rounded to 1.00 before the hole-generating function is applied, as noted above; find the least $x_{1,i} \ge x_{2,1}$ (i.e., find the smallest $x_{1,i}$ that equals or exceeds 1.00; the smallest $x_{1,i}$ is $x_{1,1}=1.00$); take the value of the index i of $x_{1,1}$ which is 1 and assign it to $g(1) \rightarrow g(1)=1$.

Similarly, for j=9, first deduce the value of $x_{2,9}=15.24$ from part D; find the least $x_{1,i} \ge 15.24$ which is $x_{1,9}=15.26$; take the value of the index i of $x_{1,9}$ which is 9 and assign it to $g(9) \rightarrow g(9)=9$. Applying the 'hole-generating' function to $x_{2,1}$ and $x_{2,9}$ yields blackened holes since j=g(j) in both cases. On the other hand, open holes denote those j for which j≠g(j). For example, for j=4, apply the function $w(x_{2,j})=g(j)$ to determine the value of g(4): first deduce the value of $x_{2,4}=3.68$ from part D; find the least $x_{1,i} \ge 3.68$ which is $x_{1,5}=6.40$; take the value of the index i of $x_{1,5}$ which is 5 and assign it to $g(4) \rightarrow g(4)=5$. Since j≠g(j), i.e., since 4≠g(4), an open hole results for location 4 in the Hole Template. Likewise, for Hole Template locations 5-7 and 16, it can be verified that j≠g(j), and so open holes arise in these locations as well.

Blackened holes indicate no change from the source Bach, and open holes indicate changes will occur in those locations. The notes that will change—$N_{c,4}$, $N_{c,5}$, $N_{c,6}$, $N_{c,7}$, and $N_{c,16}$—are indicated above the open holes. Each $N_{c,j}$ denotes the pitch number of the j$^{th}$ pitch of the source piece for which j≠g(j). The unchanging notes of the Bach and the prior event pitches $E_{p,3}$ and $E_{p,15}$, which will serve as the reference pitches for the Dynamic Inversion process explained in parts F and G, are marked above the blackened holes. For example, prior pitch event $E_{p,3}$ represents the pitch immediately prior to four 'open holes' in the variation; here $E_{p,3}$ corresponds to the third blackened hole=G4. This prior pitch event $E_{p,3}$=G4 functions as the reference pitch for the Dynamic Inversion of those Bach input file pitches 4-7, i.e., $N_{c,4}$, $N_{c,5}$, $N_{c,6}$, and $N_{c,7}$, which will all be inverted about the G4. Thus, the $N_{c,j}$'s will be inverted about the pitch occupying the previous blackened hole—here, G4. In the Dynamic Inversion procedure, reference pitches are defined by, and change according to the Hole Template of the Improved Chaotic Mapping. Thus, each differs from any other reference pitch, e.g., $E_{p,3} \neq E_{p,15}$ so that the reference pitches are dynamic rather than fixed or static. By contrast, in past and current commercial computer practice, inversions are taken about a reference pitch that is fixed, e.g., middle C (C4) or a user-supplied reference pitch.

The process of Dynamic Inversion is set up in FIG. 5A, part F using an explicit pairing between all the pitches from A3 to E5 with the numbers 57 to 76 (middle C=C4=pitch number 60) so that each unit increment results in a pitch one half step higher. Those pitches $N_{c,j}$ of the original Bach which will ultimately change in the variation are marked ($N_{c,4}$, $N_{c,5}$, $N_{c,6}$, $N_{c,7}$, and $N_{c,16}$). Each of these corresponds to one of the open holes 4-7 and 16 in the Hole Template of part E. Each prior event pitch $E_{p,j-1}$ that serves as a reference pitch for the Dynamic Inversion procedure is also indicated ($E_{p,3}$ and $E_{p,15}$). The prior event pitches $E_{p,3}$ and $E_{p,15}$ correspond to the third and fifteenth blackened holes, respectively, of the Hole Template of part E.

Since j=g(j) for the first three events of the variation, as already determined by the Hole Template of part E, the original Bach pitches will occur in locations 1-3 of the variation. The same is true for the $8^{th}$-$15^{th}$ pitches of the variation. However, since j≠g(j) for j=4, . . . , 7, 16, the variation will change from the source according to the expression for the Improved Chaotic Mapping working in conjunction with said Dynamic Inversion procedure:

$$f(x_{2,j}) = \left\{ \begin{matrix} p_{g(j)}, & j = g(j) \\ p_N, & j \neq g(j) \end{matrix} \right\} = p'_j, \tag{8}$$

where g(j) is assigned the value of the index i of the least $x_{1,i}$ for which $x_{2,j} \leq x_{1,i}$. Here, Dynamic Inversion is used to calculate each new pitch $P_N$ of the variation using the expression $N=-(N_{c,j}-E_{p,j-1})_{MOD12}+W_{p,j-1}$, where $N_{c,j}$ denotes the pitch number of the $j^{th}$ pitch of the source piece for which j≠g(j), and $E_{p,j-1}$ is defined in terms of $N_{c,j}$ as the pitch number of the (j−1) pitch of the original pitch sequence that occurs before one or more consecutive $N_{c,j}$'s. As stated earlier, the prior event $E_{p,j-1}$ serves as the dynamic reference pitch about which the inversion of one or more consecutive $N_{c,j}$'s will take place.

To find $p'_4$, the fourth pitch of the variation, calculate $P_N$ where $N=-(N_{c,4}-E_{p,3})_{MOD12}+E_{p,3}=-(72-67)+67=62 \rightarrow P_{62}=D4=p'_4$, the $4^{th}$ pitch of the variation. Pitches $p'_5$, $p'_6$, and $p'_7$ result from a similar procedure. The mod 12 option did not apply in determining $p'_4$. Though it was not necessary here, it can be invoked to preclude inversions that move up/down from any reference pitch by more than an octave. To see how the G#4 is assigned to $p'_{16}$, again calculate $P_N$ where $N=-(N_{c,16}-E_{p,15})_{MOD12}+E_{p,15}=-(76-72)+72=68 \rightarrow P_{68}=G\#4=p'_{16}$.

Applying the Improved Chaotic Mapping in conjunction with Dynamic Inversion yields the variation sequence displayed in FIG. 5A, part G: $\{p'_j\}=\{p_{g(1)}, \ldots, p_{g(3)}, P_{62}, P_{58}, P_{67}, P_{62}, p_{g(8)}, \ldots, p_{g(15)}, P_{68}\}$. Pitches 1-3 and 8-15 in the variation, corresponding to blackened holes, do not change from those occurring at locations 1-3 and 8-15 in the pitch sequence of the source Bach. But pitches 4-7 and pitch 16, corresponding to open holes do change from those occurring in locations 4-7 and 16 in the source Bach, in accordance with the Improved Chaotic Mapping and the Dynamic Inversion process.

FIG. 5B shows an exemplary algorithm, (Blocks [1] through [7]), of the Improved Chaotic Mapping of FIG. 5A, applicable to discrete-time and/or continuous-time signals. To make variations of a sequence of events, the Improved Chaotic Mapping is given by $$f(x_{2,j}) = \left\{ \begin{matrix} e_{i=g(j)}, & j = g(j) \\ E_j, & j \neq g(j) \end{matrix} \right\} = E'_j, \tag{9}$$

where $E'_j$ represents any event of the variation, $e_{i=g(j)}$ denotes any pitch, chord, phrase, beat, note rhythmic value, note-group, and/or any other musical event from the source work that will appear unchanged in the variation as a result of the condition j=g(j), and $E_j$ represents any musical event in the variation produced by the Improved Chaotic Mapping in conjunction with a designated variation procedure whenever j≠g(j). The term g(j) is assigned the value of the index i of the least $x_{1,i}$ for which $x_{2,j} \leq x_{1,i}$.

In Block [1], the first chaotic trajectory $\{x_{1,i}, y_{1,i}, z_{1,i}\}$, indexed on i, with initial conditions $(x_{1,1}, y_{1,1}, z_{1,1})$ is launched. A second chaotic trajectory $\{x_{2,j}, y_{2,j}, z_{2,j}\}$, indexed on j, with initial conditions $(x_{2,1}, y_{2,1}, z_{2,1})$ is simulated in Block [2]. The hole-generating function $w(x_{2,j})$=g(j) of Block [3] takes each x-value of the second chaotic trajectory (and/or y-z-values of same) and determines g(j), where g(j) is assigned the value of the index i of the least $x_{1,i}$ such that $x_{2,j} \leq x_{1,i}$. The hole-generating function creates the Hole Template of Block [4] according to whether or not j=g(j). If so, a blackened hole appears at the appropriate j; if not, an open hole occurs.

Block [4] shows a hypothetical example of a Hole Template (resulting from Block [3]), where M represents any given integer. Here, M is the hypothetical value of the left-most j in the plotting. Suppose that applying the hole-generating function, $w(x_{2,j})$=g(j), to $x_{2,j}$ results in j=g(j), and equivalently M=g(M) for the j=M location in the drawing. Thus, for j=M, a blackened hole results. Suppose further that the same process applied to the next x-value $x_{2,j}$, where j=M+1, also results in j=g(j)→M+1=g(M+1). Then for j=M+1, a blackened hole appears. As stated earlier, blackened holes denote those j for which j=g(j). Here, blackened holes result from applying the hole-generating function to the two x-values $x_{2,M}$ and $x_{2,M+1}$, as well as to the x-values $x_{2,M+5}$ and $x_{2,M+6}$. But now suppose that for $x_{2,j}$ where j=M+2, the hole-generating function returns a value for g(j) that does not equal j. Thus an open hole occurs for j=M+2. Ditto for j=M+3 and j=M+4.

Block [5A] supplies the event sequence $\{e_i\}$ of a source work—which can include MIDI events, audio events, or both—to the Improved Chaotic Mapping of Block [5B]. Note that if the event list consists of more than one musical attribute (e.g., MIDI pitch, onset time, and velocity), each can be varied separately, or together, by applying this exemplary algorithm to one or more axes in 3-space, or to n axes in n-space, e.g., where n axes result from harnessing additional chaotic systems.

The Improved Chaotic Mapping is applied in Block [5B] whenever j=g(j), i.e., at the blackened holes. This results in events $e_{i=g(j)}$ occurring in the same spot in the variation as in the source piece. Thus for this hypothetical example, original events $e_M$, $e_{M+1}$, $e_{M+5}$, $e_{M+6}$ fill the blackened holes $E'_{j=M}$, $E'_{j=M+1}$, $E'_{j=M+5}$, and $E'_{j=M+6}$ in the variation shown in Block [7].

Block [6A] provides a designated variation procedure which will work in tandem with the Improved Chaotic Mapping of Block [6B] to generate new events $E_j$ whenever j≠g(j), i.e., at the open holes. Thus, for this hypothetical example, new events $E_{M+2}$, $E_{M+3}$, and $E_{M+4}$ fill the open holes and are equivalent to $E'_{j=M+2}$, $E'_{j=M+3}$, and $E'_{j=M+4}$, in the variation shown in Block [7].

Block [7] contains the variation's event sequence $\{E'_j\}$ which comprises the sum of Blocks [5B]+[6B]. The contents of the blackened holes remain unchanged from the source event sequence. The open holes are filled with new events $E_j$ supplied by the Improved Chaotic Mapping in conjunction with a designated variation procedure(s). The variation is produced by merging the contents of the blackened and open holes to give the variation's final event sequence $\{E'_j\}=\{\ .\ .\ .\ ,\ e_{g(M)},\ e_{g(M+1)},\ E_{M+2},\ E_{M+3},\ E_{M+4},\ e_{g(M+5)},\ e_{g(M\alpha 6)},\ .\ .\ .\}$.

In the embodiments discussed above, the hole-generating function of the Improved Chaotic Mapping produces a Hole Template where the number of open vs. blackened holes can vary depending on ICs for chaotic trajectories 1 and 2. In other embodiments, other schemes such as probabilistic methods can produce a Hole Template capable of receiving new events via, for instance, Dynamic Inversion. One inherent advantage of the Improved Chaotic Mapping over a probabilistic scheme lies in the fact that the Improved Chaotic Mapping has several built-in 'controls' or 'sliders' that determine the amount of variability—all arising from a natural mechanism for variability present in chaotic systems, i.e., the sensitive dependence of chaotic trajectories to initial conditions. Thus, the degree to which the initial conditions chosen for the second chaotic trajectory differ from those assigned to the first trajectory will directly affect the amount of variability present in a variation.

Figure 6A:
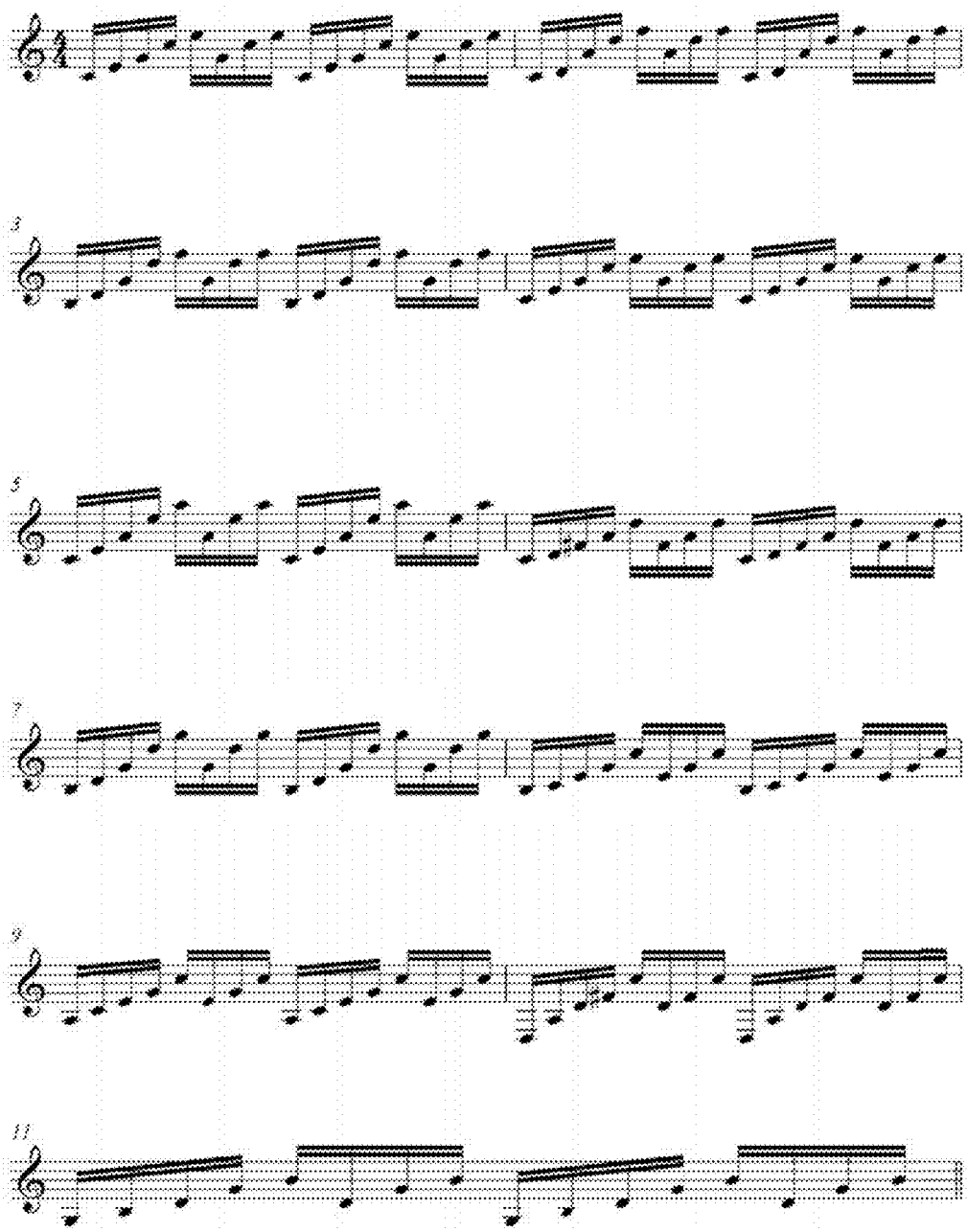
Figure 6A Prior Art
FIG. 6A is a prior art example using Bach's Prelude in C (WTC I), pitches only.

The Bach Prelude in C (from the Well-tempered Clavier, Book I) presents an ideal demonstration piece for the Improved Chaotic Mapping. The first two phrases—measures (mm.) 1-11, representative of the entire Prelude—are shown in FIG. 6A. The pitch sequence of the Bach consists only of single notes, all of which have essentially the same rhythm, except for the last chord (not shown).

Figure 6B:
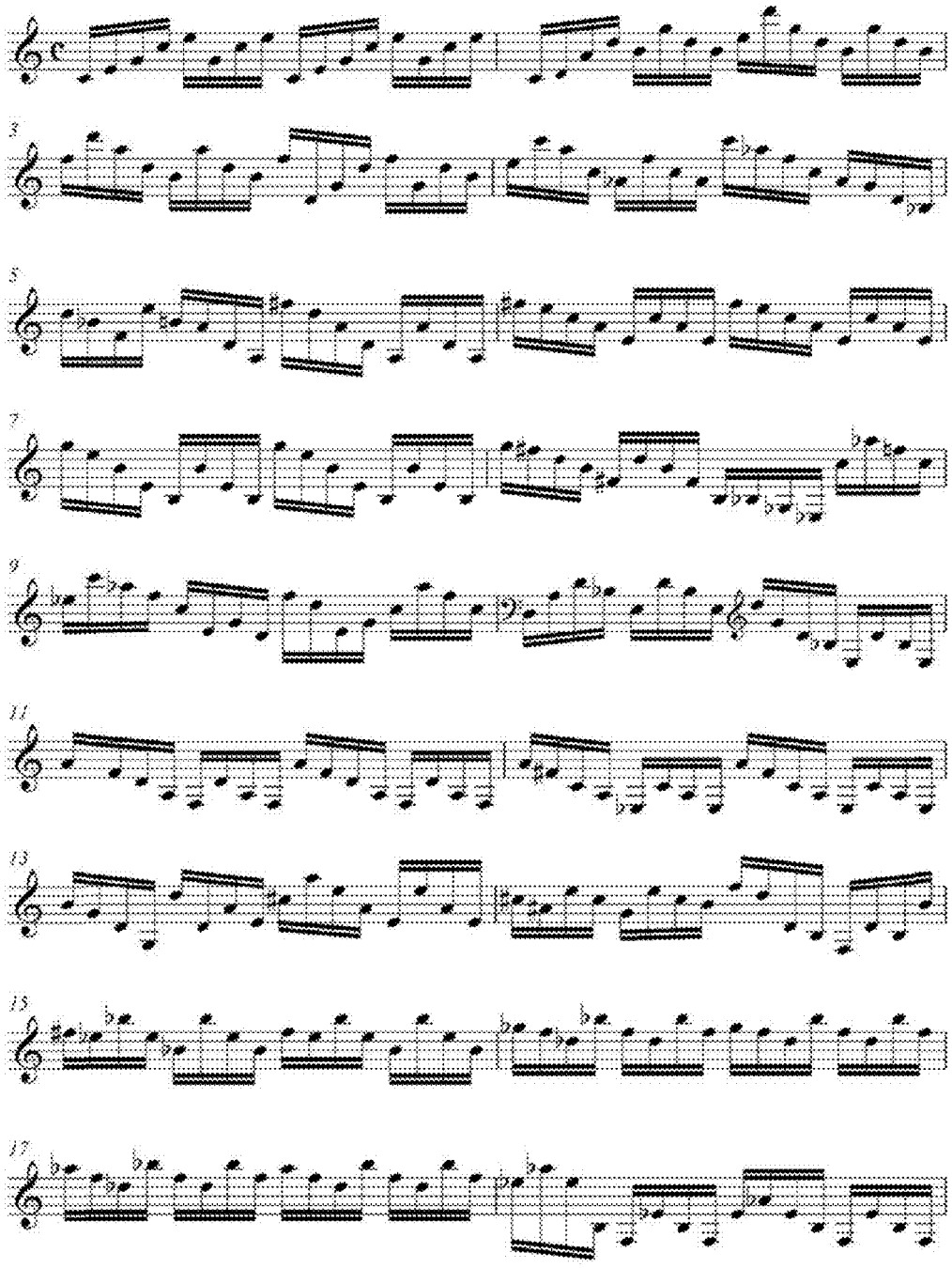
FIG. 6B is a musical example created using the hole template method of FIG. 5A to produce a variation of the Bach Prelude.
Figure 6B:
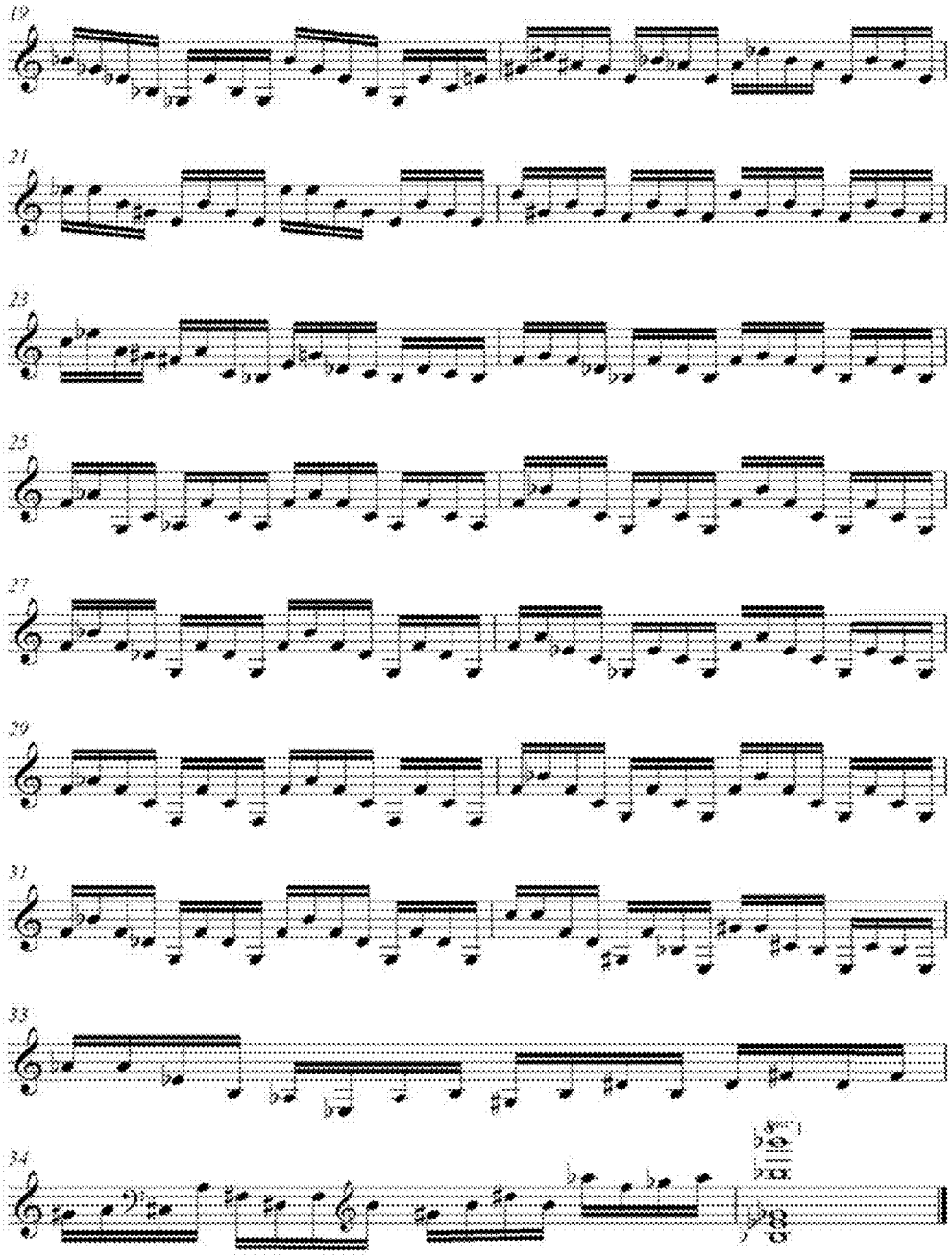

FIG. 6B presents an exemplary variation produced by the Improved Chaotic Mapping combined with the Dynamic Inversion process described in FIG. 5A. Default parsing was used, i.e., each pitch or chord was considered a separate event. An underlying harmonic tenet of the source Bach, i.e., one harmonic change per measure, is often preserved because the Dynamic Inversion procedure has built-in symmetry: It reflects the original pitches about reference pitches, where each reference pitch is the pitch prior to any one or more consecutively changed notes. Yet the Dynamic Inversion process also allows harmonic shifts, as can be heard in measures 2-5. These shifting harmonies result from changing reference pitches, which in turn are determined by the Hole Template of the Improved Chaotic Mapping.

The last pitch event of the source Bach Prelude is a 5-note C major chord. Several methods exist for inverting a chord using Dynamic Inversion: a chord could be inverted about its midpoint or about a prior pitch event; or the chord's midpoint could be inverted about a prior pitch event such that its pitches are transposed with respect to the new midpoint, or the chord's midpoint could be inverted about a prior pitch event and its pitches then inverted about the new midpoint, and so on.

It should be noted that the Improved Chaotic Mapping method can invoke two designated variation procedures simultaneously, one for j=g(j) and another for j≠g(j):

$$f(x_{2,j}) = \begin{Bmatrix} E_{j,a}, & j = g(j) \\ E_{j,b}, & j \neq g(j) \end{Bmatrix} = E'_j, \tag{10}$$

where $E_{j,a}$ represents an event given by designated variation procedure "a" (denoted by subscript "a") whenever j=g(j), and $E_{j,b}$ represents an event given by designated variation procedure "b" (denoted by subscript "b") whenever j≠g(j).

Parsers for Discrete-Time Signals, Such as MIDI .mid Files

A discrete-time parser is necessary to separate a discrete-time signal, such as a MIDI file score, into a sequence of discrete events so that a variation of the signal can be generated, for example using the Improved Chaotic Mapping method. The "default" parsing of FIG. 7A consists of 103 separate pitch or chord events. Each pitch or group of simultaneous pitches (a chord) denotes an event, as shown in the first 2 measures: Event 1 consists of one pitch (D5) whereas Event 2 comprises the chord Bb3-E5. Event 1 occurs at MIDI time m|b|nnn (1|3|000) where m signifies the measure number (here, m. 1), b denotes the beat (here, beat 3), and nnn subdivides the beat into 480 ticks, thus giving the precise timing of the pitch within the beat. The MIDI protocol allocates 480 ticks per beat. Therefore, Event 1 occurs precisely on beat 3 since nnn=000. Similarly, Event 2 (Bb3-E5) occurs on the downbeat of m. 2 since its MIDI time indicates m. 2, beat 1, and tick 000. Events 3 and 4 sound at 2|2|000 and 2|3|000, respectively. Event timings continue in like manner for subsequent events generated by the default parsing of the original chaotic mapping. All subsequent pitch and chord events are numbered by Arabic numerals above each event in the first system (i.e., 5-21), and possess MIDI times m|b|nnn. Note that while traditional music notation does not assign a measure number to an upbeat measure, the MIDI protocol does. Thus, the upbeat measure that opens the piece is considered m.1.

As a way of offering more flexibility for generating the event list, the Discrete-time Signal (e.g., MIDI file) Parser of FIG. 7B can allow one or more non-simultaneously occurring pitches/chords to be grouped together to form an event. The parsed events $\{e_i\}$ of Block [3] resulting from the Discrete-time Signal Parser comprise a sequence of events upon which the Improved Chaotic Mapping of FIG. 5B, and/or another modification scheme, can operate in order to generate a variation.

FIG. 7C presents one result of applying the Discrete-time Signal Parser algorithm of FIG. 7B to a given song. The score of FIG. 7C displays a parsed event list consisting of 14 different events, each denoted by an arrow and START time S. This event list constitutes a different kind of input to the Improved Chaotic Mapping, one of groups of pitches and chords, rather than a list of individually sounding pitches or chords.

To illustrate how a Timing Template can work in various embodiments in conjunction with the parsed events of FIG. 7C, suppose the Improved Chaotic Mapping returns a blackened hole for Event 1, an open hole for Event 2 and a blackened hole for Event 3. Suppose, further, that the Improved Chaotic Mapping selects Event 7 as a hole filler for Event 2. In this variation, then, the sequence of the first three events is:

Event 1, Event 7, Event 3. Thus, Event 2 of the source piece, with start time 4|3|000, is replaced by Event 7 which has a length of 6 quarter beats. In the variation, Event 7 will assume the Start time of Event 2 and commence at 4|3|000, but it will finish 3½ quarter beats before the Start time of the next event, 7|3|240, thus creating a silence of 3½ beats before Event 3 is heard at 7|3|240.

If the events of the variation, however, are stitched together without the Timing Template, i.e., one right after another in the order Event 1, Event 7, Event 3, then Event 7 would be placed immediately following Event 1, at the Start time of the next event following Event 1 in the original score, i.e., at 4|3|000, the Start time of Event 2. In the variation, Event 3 would occur immediately following Event 7. Where Event 3 starts would be determined by taking the difference between the Start time of the next event following Event 7 in the score of the source work, i.e., the Start time of Event 8=21|3|000, and the time of the last note D4 (in the left hand of the piano part) of Event 7=21|2|000. The difference is 21|3|000−21|2|000=1 quarter beat or 480 ticks. This difference is then added to the timing of the last note/chord event (Event 7) in the variation 6|2|000+480 ticks=6|3|000. Thus Event 3 would be placed at 6|3|000 following Event 7, and the Start times of the first three events of the variation would be: 1|3|000 (Event 1), 4|3|000 (Event 7), and 6|3|000 (Event 3).

Parsers for Continuous-Time Signals, Such as Audio .wav Files:

A continuous-time parser is needed to separate a continuous-time signal, e.g, an audio recording, into a sequence of parsed audio events so that an Audio Variation can be generated. Continuous-time signal parsers of the present invention include the Toggle Switch Parser, the 'Start-times only' Parser, and the Duration-specific Automatic Parser.

The Toggle Switch Parser

FIG. 7D shows an exemplary algorithm of the Toggle Switch Parser.

First, a switch key that can toggle—that is, alternate between two states—must be designated on a computer (or on another capable system). The toggle key triggers one of two states: 'Start time' S and 'Finish time' F, whenever struck. The Start and Finish times of each parse are used to separate an audio recording into a discrete sequence of parsed audio events.

Upon activating the toggle key in Block [1], the Toggle Switch Parser reads the system clock, records the system clock time as the 'reference clock time' $R_t$ that will serve as the reference time from which all subsequent times are calculated, and initializes the Start time $S_1$ to 0 seconds and plays the audio file (mp3, .wav, .pcm, .acm, etc.) so that the user can, in real time, initiate the Finish and Start times of each desired parsed event. The Toggle Switch Parser also ascertains whether or not there exists a delay between the input signal, generated by striking the toggle key, and the timing of that signal vis à vis the system clock. A counter is initialized: i=0.

To delineate the Finish time $F_1$ of the first parsed event ($S_1$, $F_1$), the user will again hit the toggle key, after which the parser reads and records the current system clock time, calculates the elapsed time between the reference clock time $R_t$ and the current clock time, minus any delay associated with the toggle key, and records the Finish time $F_{1+i}$.

To delineate any subsequent parsed events, the user continues to strike the toggle key to record Start S and Finish F times until the last recorded Finish time is greater than or equal to the total time $T_{TOT}$ of the recorded musical piece. These Start S and Finish F times are then applied to the recorded audio file to separate it into discrete audio events upon which the Improved Chaotic Mapping, or any other modification scheme, can operate.

In embodiments, after the Improved Chaotic Mapping method has generated a variation, each event of the variation $E_j'$ is placed, in sequence, in a Timing Template provided by the Start times of the parsed audio events as delineated in the source piece. That is, each $E_j'$ is placed at the precise time that the corresponding original event $e_{i=j}$ occurred in the source work. In this way, the Start times of the parsed events of the source piece provide a Timing Template which determines where each of the new events $E_j'$ comprising the variation will be placed, in sequence. With the Timing Template approach, the variation will be the same duration as the source piece; however, some events of the variation may 'bleed' into succeeding events, or silence may occur between two adjoining events, due to one being longer or shorter than the duration allocated by the Timing Template, respectively.

Alternatively, the events $\{E_j'\}$ of the variation may follow one another back-to-back sequentially, in the order proscribed by the Improved Chaotic Mapping. Here, as with the Timing Template approach, the events of the variation can be stitched together by using audio editing techniques. For instance, logarithmic cross fading can be used to allow the new event to enter into and emerge from a seam over a 60 ms time span, while simultaneously fading out the previous event, also over the same 60 ms time span.

Figure 8:
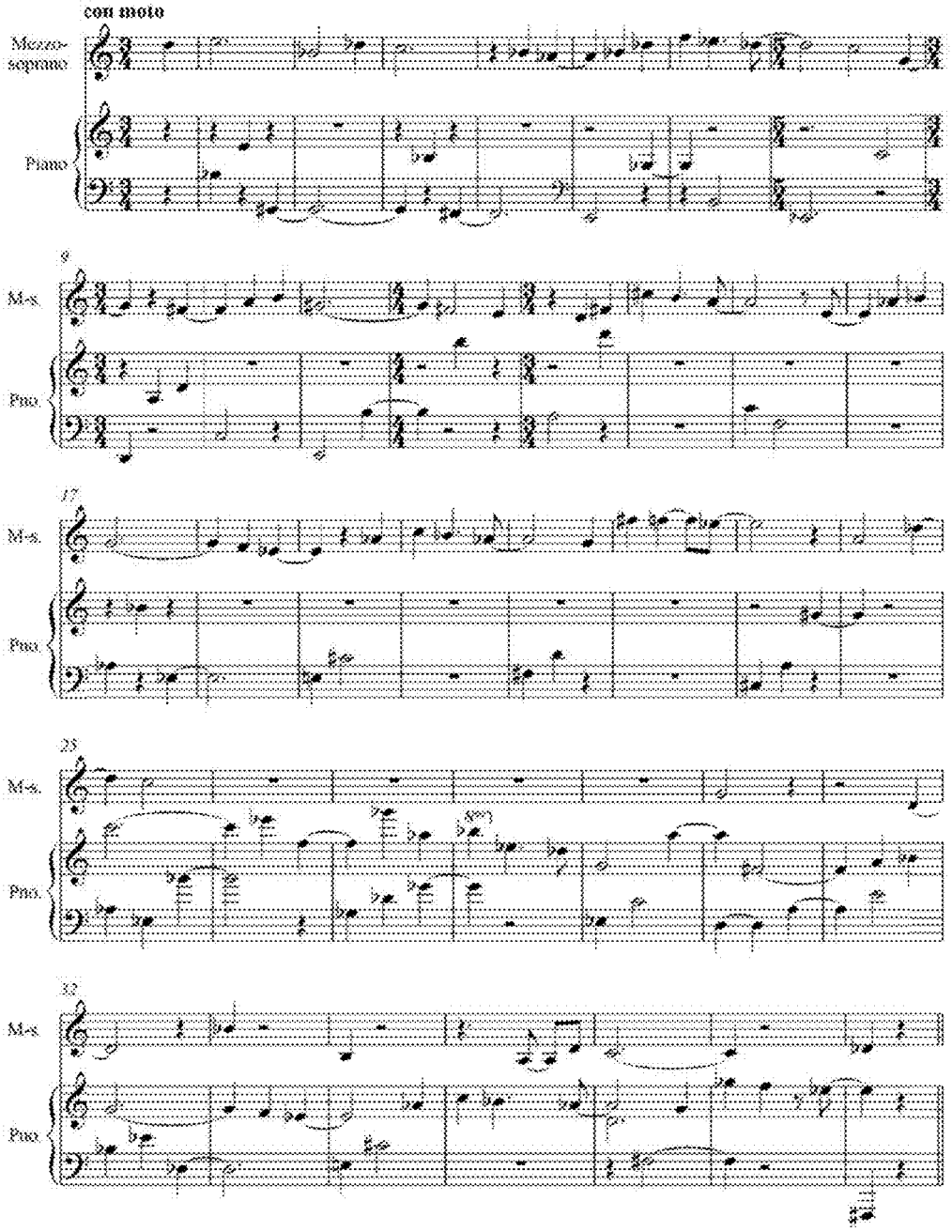
FIG. 8 is a musical score representation of an audio recording of the song of FIGS. 7A and 7C.

FIG. 7E shows an exemplary time waveform of a solo vocal track from a song recording of the music presented in FIG. 8. The Start and Finish times produced by the Toggle Switch Parser of FIG. 7D are marked in FIG. 7E. These timings are then applied to the source recording to separate it into 12 discrete audio events.

FIG. 7F shows each of the twelve audio parses of FIG. 7E, separated in time from one another by one second. The events are separated so that, in listening to these separated audio parses, the user can gauge the musical efficacy and integrity of each parse, and, if necessary, make adjustments—either by hand or by state-of-the-art audio detection software, e.g., signal processing and pattern recognition technology—to the Start/Finish times and/or the Delay time that occurs between striking the toggle key and the Start/Finish times registered by the system clock. In FIG. 7F, the longer arrows indicate Start times and the shorter arrows indicate Finish times. Each event is delineated by its own Start and Finish times, e.g., $S_1$ and $F_1$ represent the Start and Finish times of Event 1.

One advantage of the Toggle Switch Parser lies in the ability of the user to selectively discard parts of any audio recording by controlling the Finish time $F_i$. The considered placement of each Finish time can determine which parts of an audio file are eliminated, as desired, or which parts might be used for Infused Variation, another method discussed in more detail below. It is important to note, however, that the Toggle Switch Parser will always result in data loss.

'Start-Times Only' Parser

The 'Start-times only' Parser of FIG. 7G differs from the Toggle Switch Parser of FIG. 7D by eliminating the need to key in separate "Finish" times at the end of each audio parse. Each event proceeds from its own start time until the audio sample immediately preceding the next start time. Thus, there is no data loss.

Duration-Specific Automatic Parser

Figure 7H:
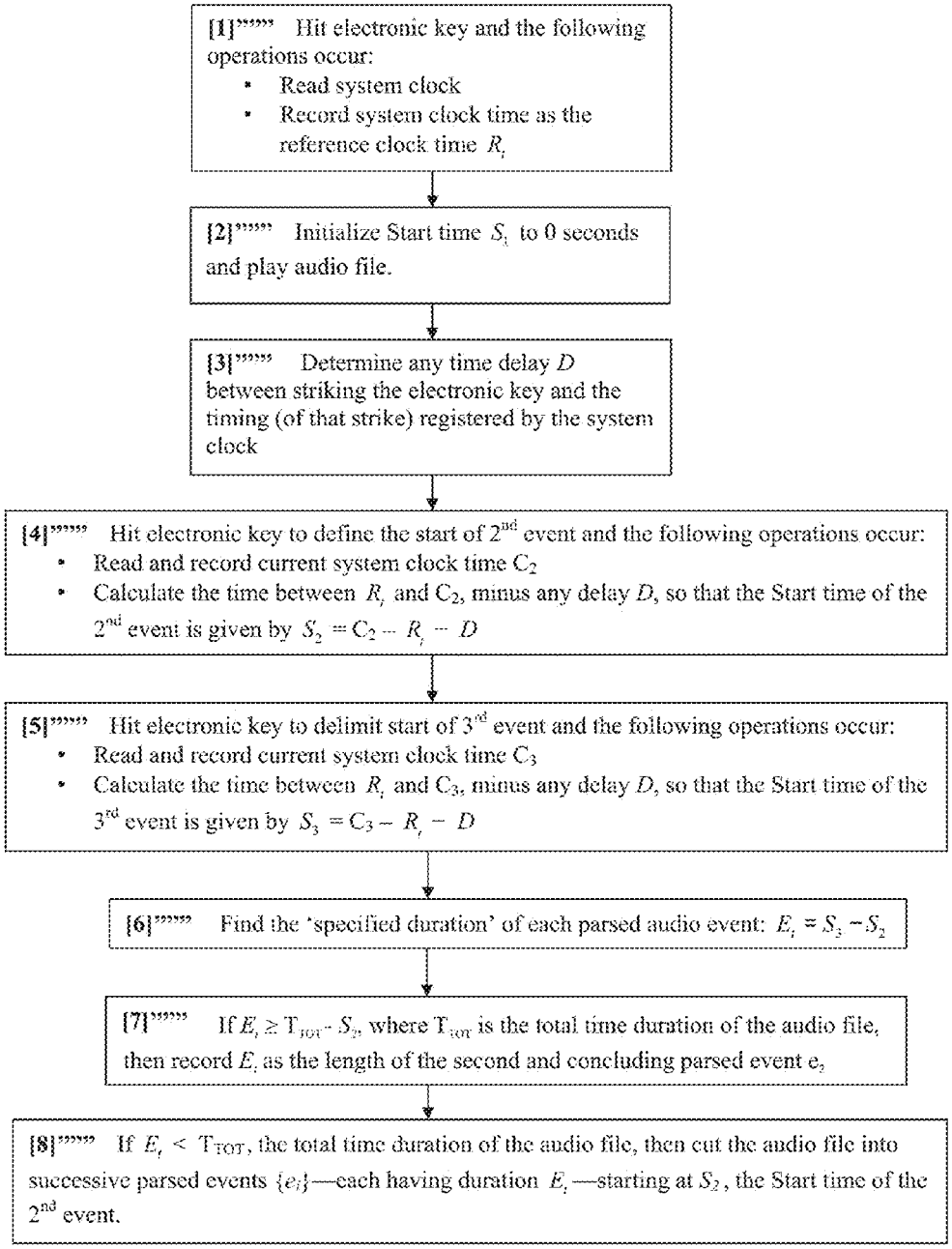
FIG. 7H is a flow diagram illustrating an exemplary embodiment of the Duration-specific Automatic Parser of the present invention applied to a continuous-time signal having a steady repetitive beat or a repetitive phrase length.
Figure 71:
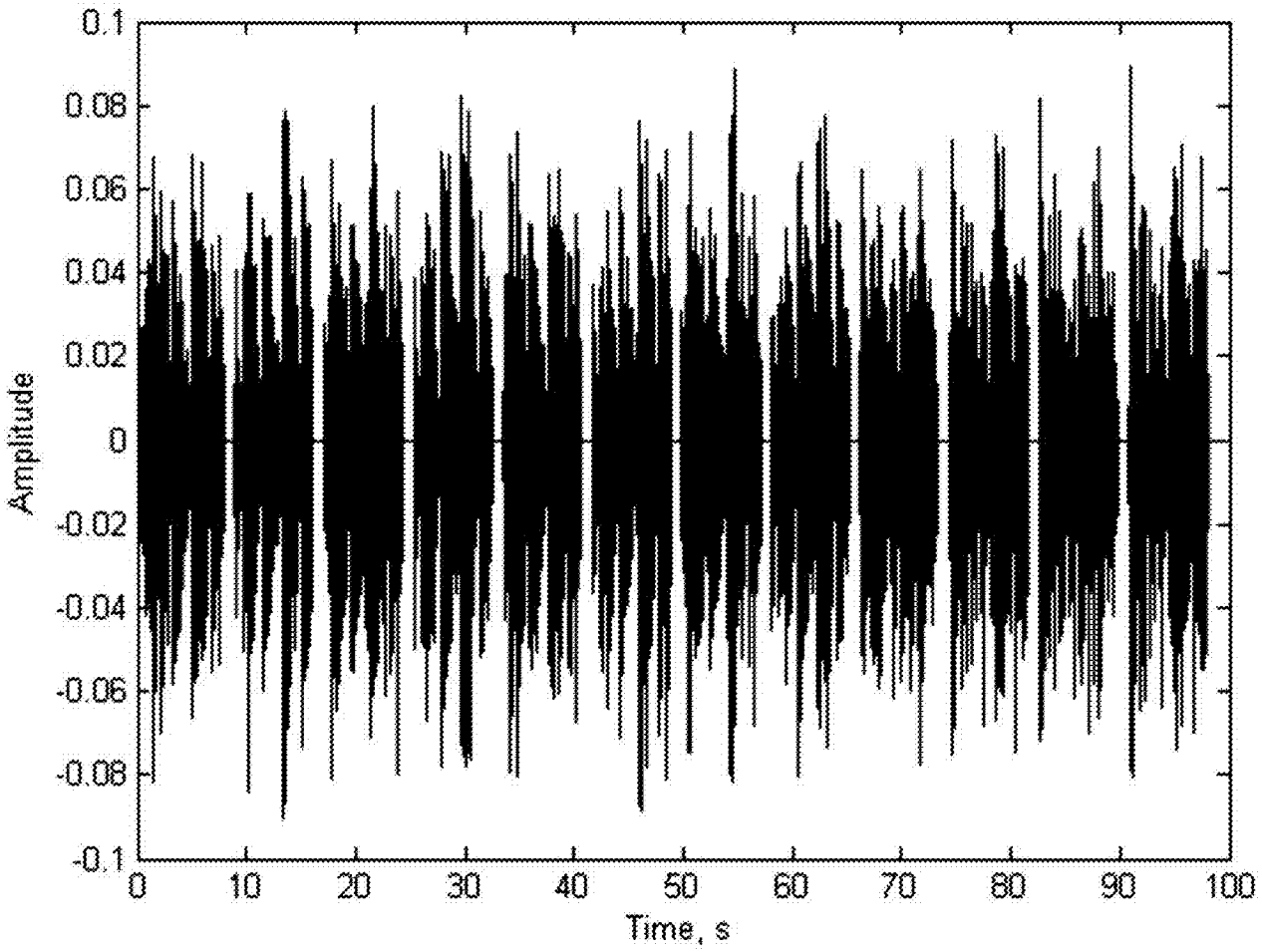

It is also possible to more fully automate the 'Start-times only' Parser algorithm of FIG. 7G so it can be used in conjunction with an input having a well-defined timing structure. FIG. 7H shows a schematic for a Duration-specific Automatic Parser that can be applied to, but is not restricted to, a source piece consisting of a steady repetitive beat, or composed of phrases that are of the same length or close thereto, as can be heard in most popular songs. The user specifies which phrase (or repetitive beat) length will define the 'specified duration' for each parsed audio event, except perhaps the first and the last parsed events, and the system automatically divides the input into a plurality of consecutive segments all having the specified length.

In general, the length of the second phrase (or repetitive beat) will constitute the duration for all the parsed audio events, because the source recording may begin with an upbeat or even a free-form introduction; it may have a glitch at the start (end) of the recording, have a Coda, Cadenza or extemporaneous material at the beginning and/or end.

Instead of simply using a fixed time duration, embodiments of the Duration-specific Automatic Parser can take advantage of state-of-the-art beat detection technology to parse an audio file so that each parse has a specified number of beats.

One application of the Duration-specific Automatic Parser takes advantage of the plethora of 16- and 8-measure phrases in both classical and popular music, many of which can be neatly subdivided into 4-measure groups, which in turn often subdivide into 2-measure units. This specific application is referred to herein as the "4+4 method," so-named because it relies on the prevalence of 4-measure groups to comprise the usual 8- and 16-measure phrases common to many songs, i.e., 4-measure group+4-measure group=8-measure phrase.

FIG. 7I shows the time waveforms of each repetitive phrase length parse resulting from application of the Duration-specific Automatic Parser of FIG. 7H to the first two sections of a recording of the Chopin Waltz in $A^b$, Op. 69, No. 1, where any rubato did not interfere with the larger four-measure pulse. Each parsed audio event has the duration of the second phrase (7 s), except for the first event which has duration 7.6 s, due to the presence of an upbeat. For clarity of illustration, each parse is separated by 1 second.

Variations of Audio Recordings Via the Improved Chaotic Mapping

The Improved Chaotic Mapping method can be applied to continuous-time signal inputs as well as discrete-time signal inputs. Variation methods which can be applied to continuous-time signal inputs include the Interval Method and the Scanning Method.

The Interval Method for Making Audio Variations

The Interval Method, in accordance with the Hole Template of the Improved Chaotic Mapping, shifts an event up or down by a given musical interval (such as a minor second) and/or adds notes above or below a given pitch to form a chord. The interval can be either fixed or changeable in accordance with the musical context. Commercially available pitch shifters and detectors can be used to move (transpose) selected events, as well as identify the pitches of a given musical event in order to provide musical context. Such context could help determine other note(s) and/or intervals to be added, e.g., the major, minor, and perfect intervals associated with Western music.

FIG. 8 shows an illustrative score representation of an audio recording of a 1-minute song (pitches and rhythms only) for mezzo-soprano and piano. The vocal and piano parts were recorded separately. The audio vocal track was then parsed into 12 audio events, as shown in FIG. 9, by using the Toggle Switch Parser of FIG. 7D.

Figure 9:
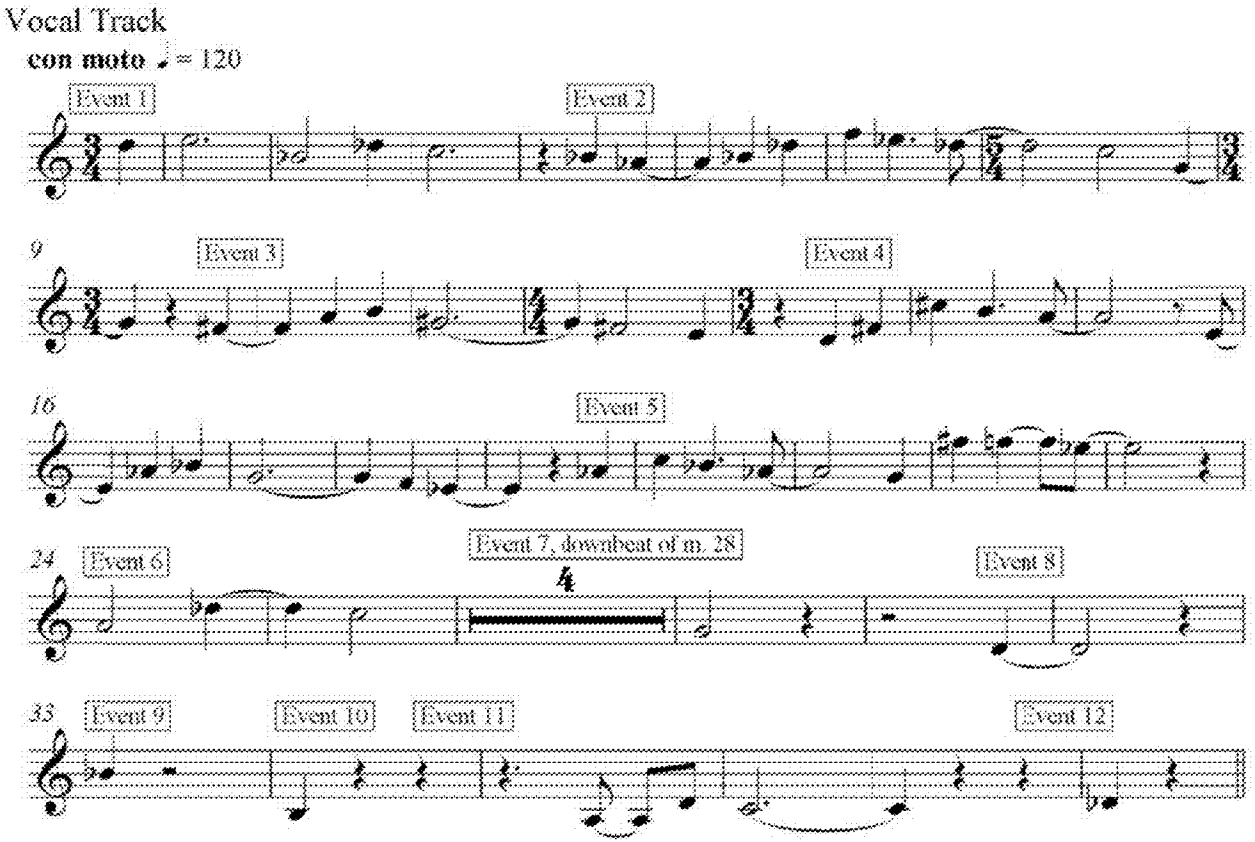
FIG. 9 is a musical score representation of an audio recording of the vocal line of FIG. 8 after application of the toggle parsing algorithm of FIG. 7D.
Figure 10:
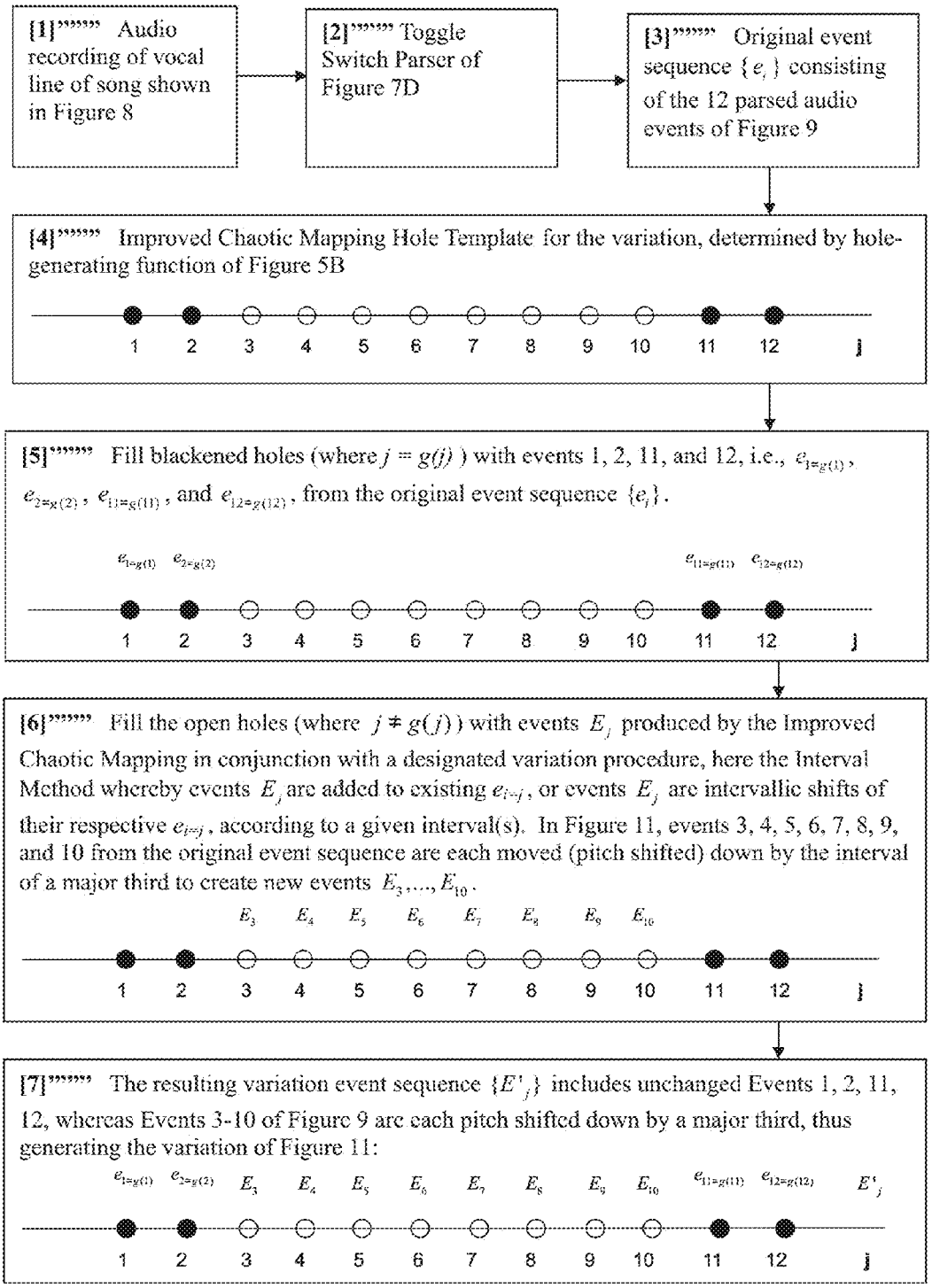
FIG. 10 is a flow diagram illustrating the method by which FIG. 11 was generated using an improved chaotic mapping algorithm of the present invention, with the Interval Method having been used as the designated variation procedure, to make a variation of an audio recording of the vocal line of FIG. 8.

FIG. 10 shows all the steps required to make an Improved Chaotic Mapping-generated Audio Variation of the audio vocal track of FIG. 9 using the Interval Method and the Toggle Switch Parser of FIG. 7D.

Figure 11:
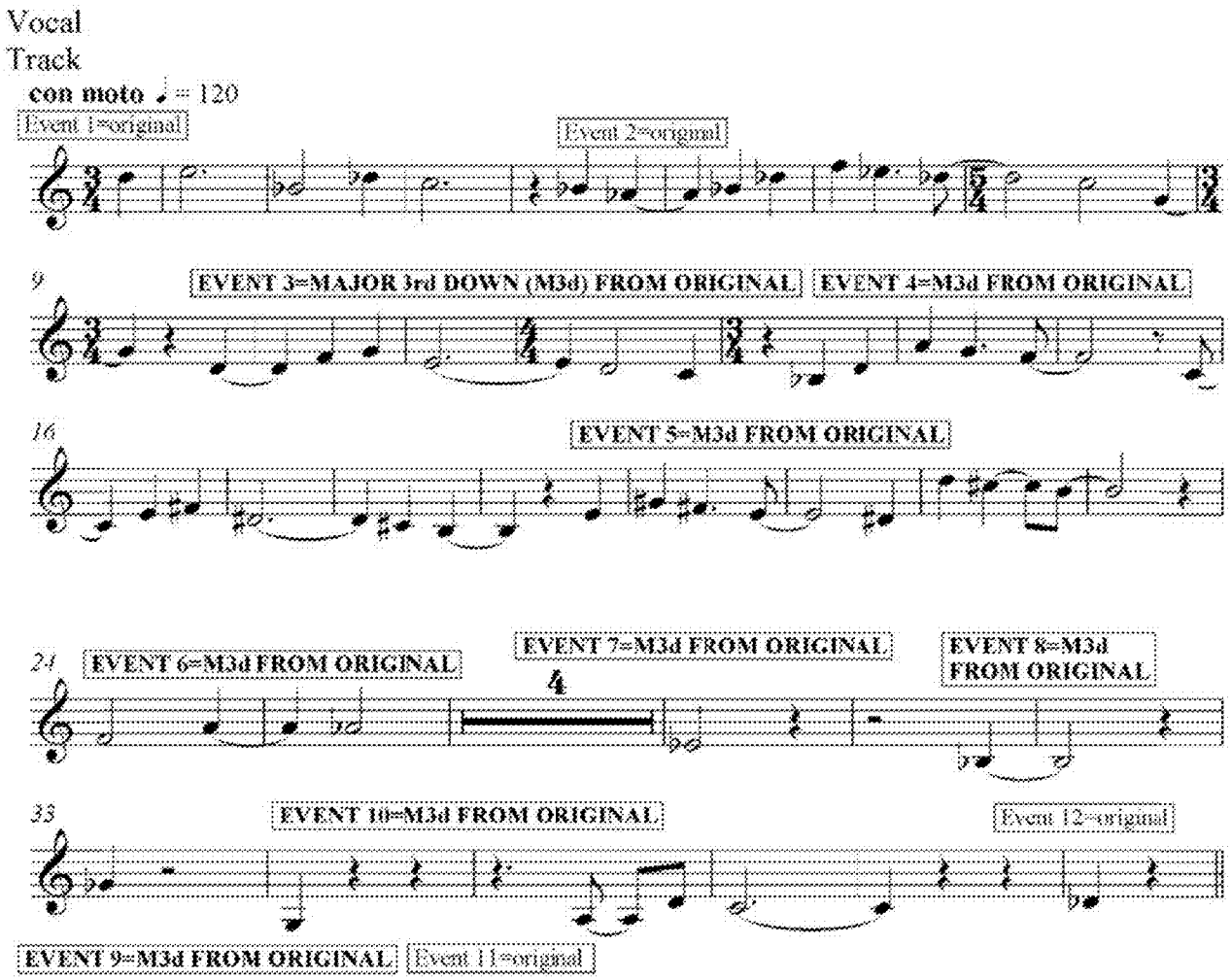
FIG. 11 is a musical score representation of an audio variation of the recording of FIG. 9, created in accordance with the method of FIG. 10 for toggle parsing of the illustrated events of FIG. 9, wherein boxed and boldface capital letters indicate changes from the source recording.

FIG. 11 gives an illustrative score representation of an Improved Chaotic Mapping-generated Audio Variation of the vocal track recording using the Interval Method as a designated variation procedure in order to produce new events $E_j$ not heard in the source recording. These are indicated in boxed bolded capital letters. The variation (and its attendant score) differ from the source recording (and score) in that Events 3-10 occur a major third below the original. Thus the sequence of Events 3-10 of the source melody has changed. These changes give the Audio Variation a lower pitch cast, an earthier tone, and more material in the alto, rather than mezzo-soprano, range.

Figure 12:
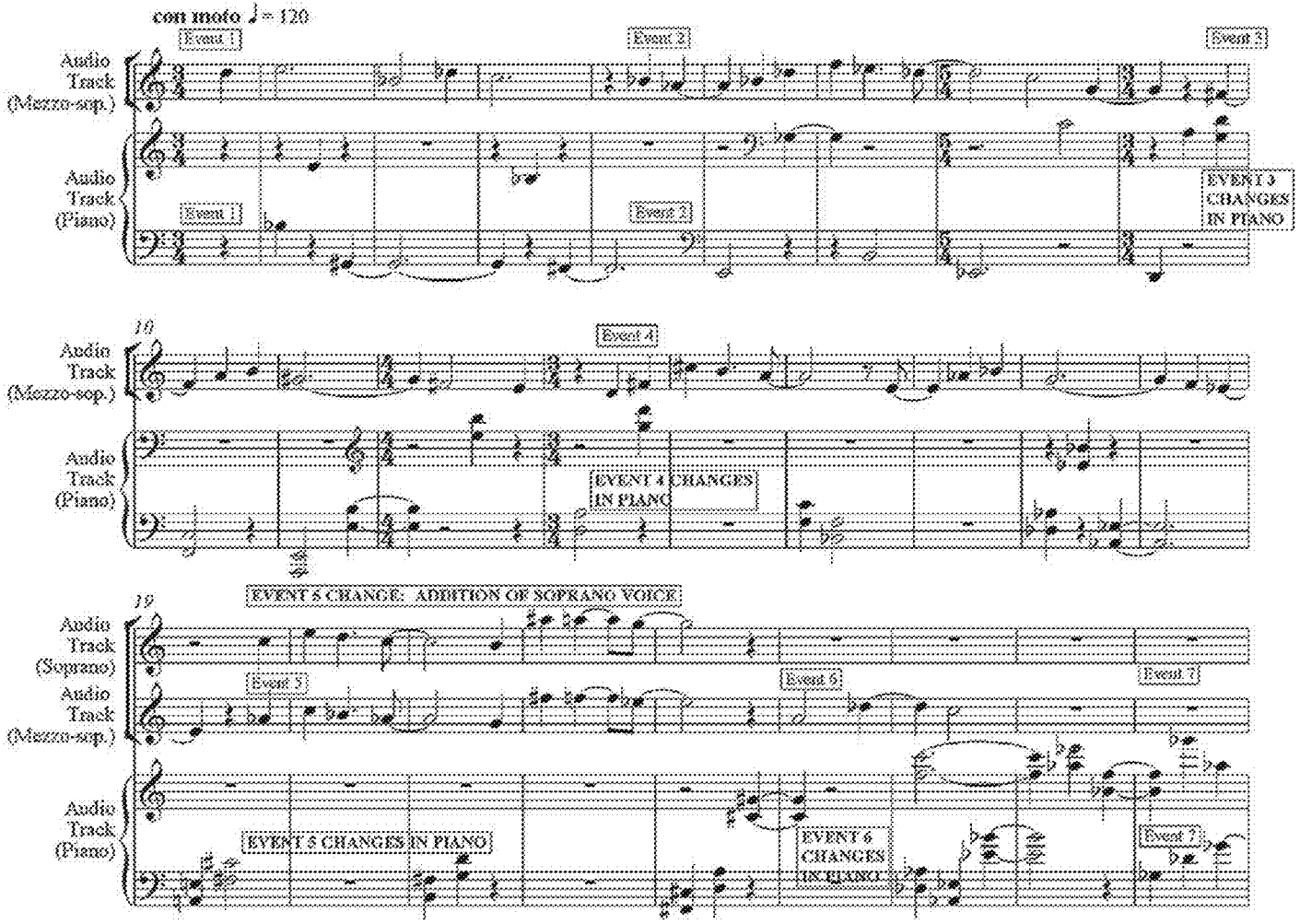
FIG. 12 is a musical score representation of an audio variation of both the vocal and piano lines in the recording of FIG. 8 created using toggle parsing of the events illustrated in FIG. 9, wherein boxed and boldface capital letters indicate changes from the source recording.
Figure 12:
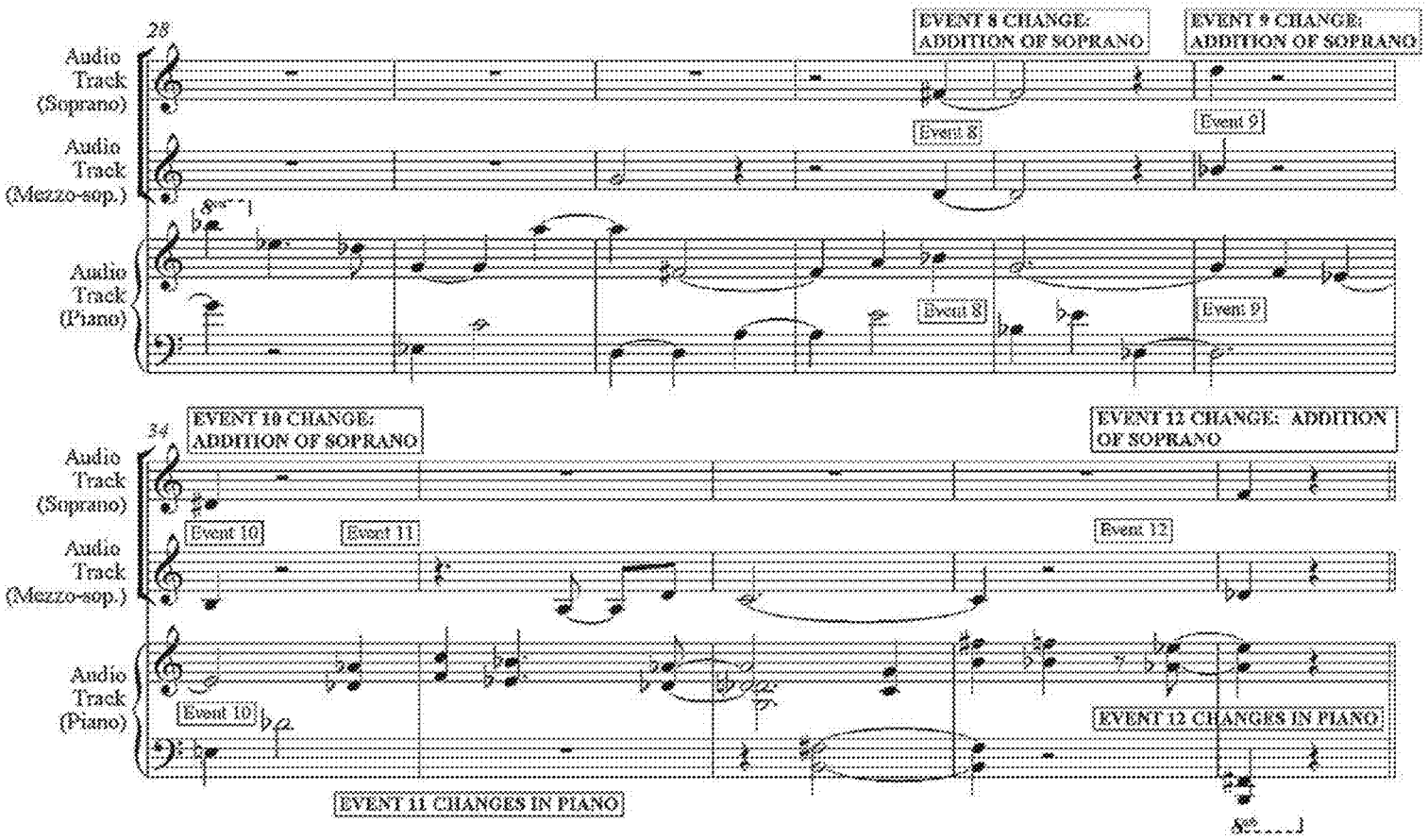

The same timings that constitute the vocal parse can then be applied to the piano part of FIG. 8 so that the Improved Chaotic Mapping can operate on the parsed events of the piano audio track in order to create an Audio Variation of the entire song using the Interval Method as a designated variation procedure, as shown in FIG. 12. All changes of the source song are indicated by boxed boldface capital letters, the first of which occurs in the piano track on the third beat of m. 9, where the recording sounds a chord G3-D4 instead of the original D4, an example of how selected audio events for $j \neq g(j)$ can acquire an additional pitch.

The vocal line of the Audio Variation of FIG. 12 differs from the source recording of FIG. 9 in that an extra soprano line appears (mm. 19-23, 31-34, and 38)—not all the time—just enough to provide extra harmonic color in the recording. This gives an example of how selected audio events for $j \neq g(j)$ can acquire additional pitches. Note that changes in the vocal line occur later than in the piano line because the variation of the vocal line was generated by choosing ICs for the second chaotic trajectory (0.993, 1, 1) closer to the first trajectory ICs (1, 1, 1). Rather than apply the Improved Chaotic Mapping to the x-components, as occurred in generating the vocal line, the Audio Variation of the piano line resulted from applying the Improved Chaotic Mapping to the z-components.

The Interval Method described above has certain advantages. For example, song variations can occur which preserve the original sequence of the words in the lyrics. Also, the melodic and harmonic language of recorded songs can change because selected audio events for $j \neq g(j)$ can be shifted by a desired interval and/or acquire additional notes. Just as Dynamic Inversion allows multiple reference pitches, the Interval Method can also allow different intervallic shifts and provide them according to the musical context of surrounding events.

The Scanning Method for Making Audio Variations

Whenever the Improved Chaotic Mapping returns an 'open hole' (i.e., when $j \neq g(j)$), the Improved Chaotic Mapping can employ the Scanning Method as a designated variation procedure to fill the open hole with an event $E_j$, according to any of six Scanning Options. Each option can occur with or without 'banning'. If 'banning' is in place, then any substitution event can only be used once in the Audio Variation. If banning is not invoked, then there is no limit to the number of times a substitution event can be used in the Audio Variation.

Three of these options are explained below with respect to FIG. 13 which shows an illustrative score representation of a parsing of a recording of the Chopin Waltz in $A^b$, Op. 69, No. 1. The parsing consists of three 8-measure half phrases (Events 1, 4, and 9, with upbeats included, such that each event is 14.6 s long), two 4-measure groups (Events 2 and 12, each 7 s long), one 4-measure group shortened by a beat (Event 3, 6.4 s), six 2-measure units (Events 5, 6, 7, 10, and 11, each approximately 3.5 s long), and one 2-measure group shortened by a beat (Event 8, 2.9 s).

Look Forward Option (LF):

For $j \neq g(j)$, the invention will ascertain the duration of the original event $e_{i=j}$ and then scan the sequential list of original events $\{e_i\}$, starting with the very first event $e_1$, and find the first available 'same duration' event, within a tolerance of $\tau$ seconds. This becomes the 'open hole filler' event $E_j$ that passes the "length test", i.e., it has the same duration as the original event, within a tolerance $\tau$ seconds. It is possible—especially for open holes near the beginning of the input and especially without banning—that the first event that passes the length test will be the original event $e_i=E_j$, with i=j.

Using FIG. 13 as an example, suppose the Improved Chaotic Mapping returns an open hole for j=1 (i.e., $1\neq g(1)$ for the first event of the variation). Event 1, $e_1$ of the source Chopin, consists of eight measures (14 seconds) plus an upbeat (0.6 seconds) for a total duration of 14.6 s. The LF option will fill the open hole with Event 1, since Event 1 is the first 8-measure plus upbeat (14.6 s) event it finds in the source, starting from the beginning of the original event sequence $\{e_i\}$, even though substitution event $E_1$ is the same as the original event $e_1$.

Now suppose that banning is in effect for the previous example and that the next open hole occurs for j=4 (i.e., $4\neq g(4)$ for the fourth event of the variation). Since Event 1 has already been used to fill the first hole, the LF method will fill the fourth hole of the variation with Event 4 ($e_4$), which is the first 8-measure (plus upbeat) event it finds, starting from the beginning of the original event sequence $\{e_i\}$, that has not already served as an 'open hole filler'—even though substitution event $E_4$ is the same as the original event $e_4$.

Best Match Option:

For $j\neq g(j)$, the invention will ascertain the duration of the original event $e_{i=j}$ and then scan the sequential list of all of the original events $\{e_i\}$ in order to find the event that best passes the length test, provided it is not the original event $e_{i=j}$, and if banning is included provided it has not already been used as a substitution event. The best duration match becomes the 'open hole filler' event $E_j$. If none is available, within a tolerance $\tau$, then the Best Match option can retain the original, or it can vary the original event using any variation technique.

Using FIG. 13 as an example with banning invoked, suppose the Improved Chaotic Mapping returns an open hole for j=10, i.e., $10\neq g(10)$ for the tenth event of the variation, two measures long with a hypothetical duration of 3.52 s. The Best Match option will fill open hole 10 of the variation with a different event whose time duration best matches that of the original Event 10 $e_{10}$. Suppose Events 6 and 7, which are also 2-measure parses, have hypothetical time durations 3.54 s and 3.5 s, respectively. Suppose further that Event 5 has time duration 3.51 s, and Event 11 has time duration 3.53 s. The substitution event that best matches the time duration of Event 10 (3.52 seconds) is either Event 5 (3.51 seconds) or Event 11 (3.53 seconds). Since banning is in effect, and assuming Event 5 has already been used as a substitution event, then the Best Match method will choose Event 11 as the tenth event of the variation.

In embodiments the Scanning Method includes an amplitude test, whereby the algorithm looks for a seed event that not only passes the length test but also passes an amplitude test, within a tolerance $v_a$. To find a suitable seed event, in some embodiments the algorithm determines the average amplitude of the last part, e.g., the last 100 ms, of the preceding event of the variation, the average amplitude of the initial portion, e.g., the first 100 ms, of any seed event that passes the length test, and selects the seed event whose average amplitude best matches the tail end (e.g., the last 100 ms) of the preceding event of the variation. If no seed event passes the length and amplitude tests, then the algorithm can apply the Interval Method and shift the input file event by a given interval (e.g., a minor $2^{nd}$), and/or add a given interval to the input file event, and/or apply any other modification.

Embodiments of the present invention include other Scanning Options, such as Look Backward, where scanned events are found by scanning from the end of the source piece back towards the beginning, Modified Look Backward and Modified Look Forward, where the scan avoids using the original event as a substitution event, and Cater-corner, where scanned events are found in the half of the source piece opposite to where the $j\neq g(j)$ event occurs.

Finally, in some embodiments the Scanning Method can scan events outside the event space of the source, for example by scanning a totally different piece or a section of the same piece or composition which is not included in the input. The result will be a variation containing parses from both event spaces, i.e., an Infused Variation, which is discussed below in more detail.

Figure 14A:
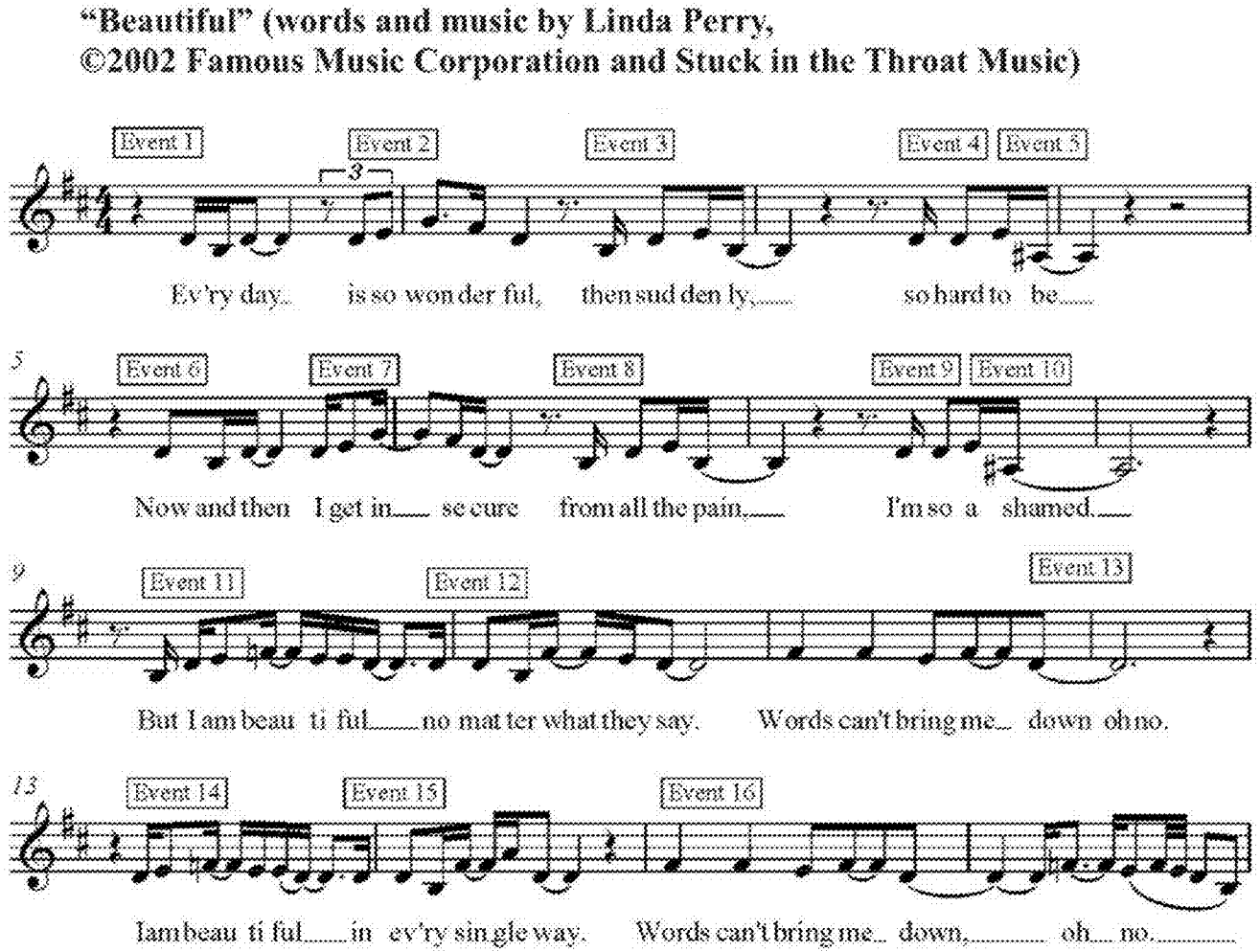
FIG. 14A is a musical score representation of a Christina Aguilera audio recording of the song "Beautiful" (words and music by Linda Perry, ©2002 Famous Music Corporation and Stuck in the Throat Music) showing parsed audio events created using the 'Start-times only' parser of FIG. 7G.
Figure 14A:
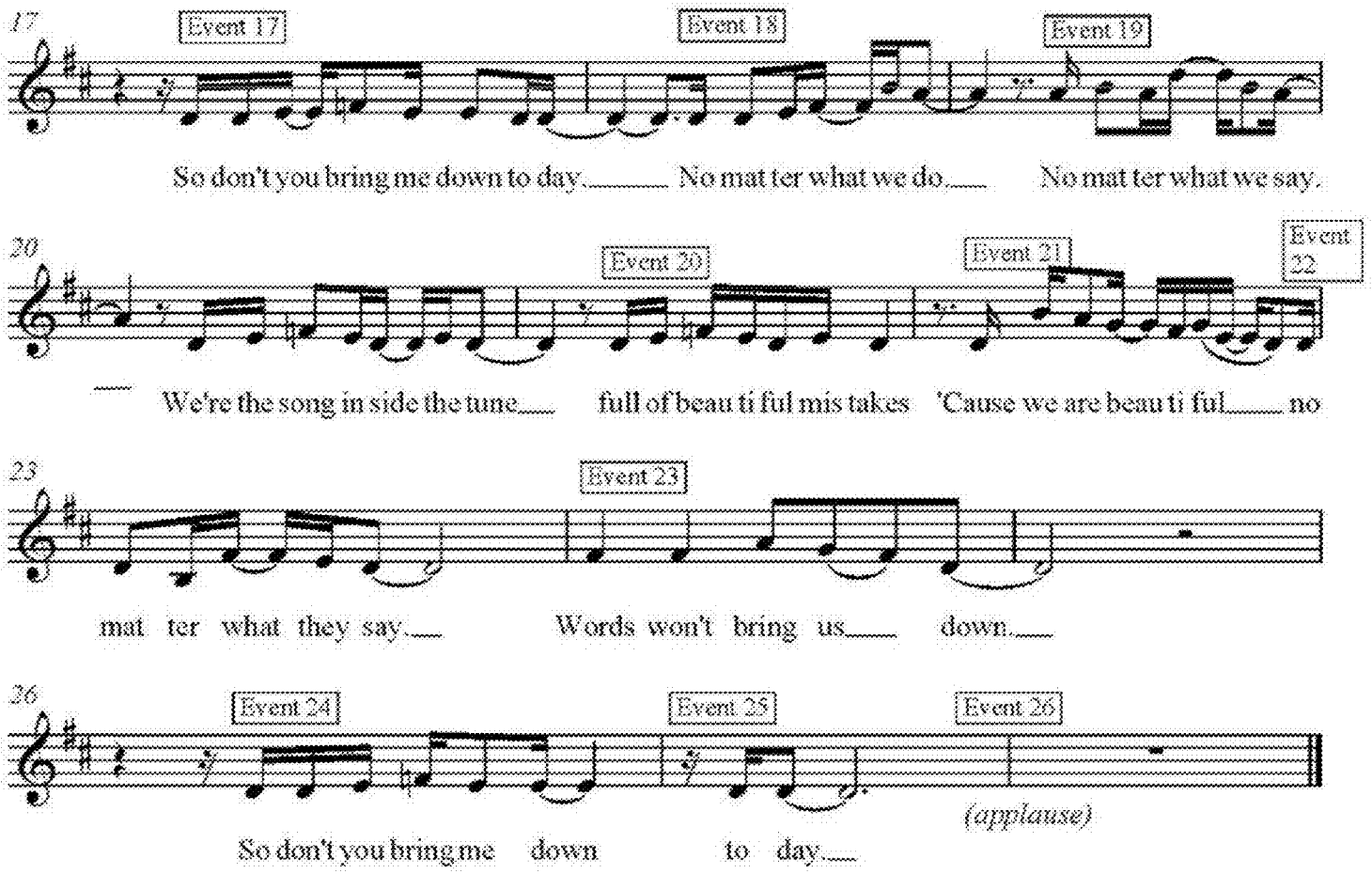

Combining Variation Techniques to Create More Sophisticated Variations of Recordings FIG. 14A is a score representation of an illustrative live audio recording of Christina Aguilera singing the song "Beautiful" (words and music by Linda Perry, ©2002 Famous Music Corporation and Stuck in the Throat Music). The song is sung a-cappella, i.e., there is no instrumental accompaniment. Using the 'Start-times only' Parser of FIG. 7G, the recording was parsed into a sequence of 26 audio events that comprise the original event list $\{e_i\}$. In FIG. 14A, Event 1=$e_1$, Event 2=$e_2$, . . . , Event 26=$e_{26}$.

Figure 14B:
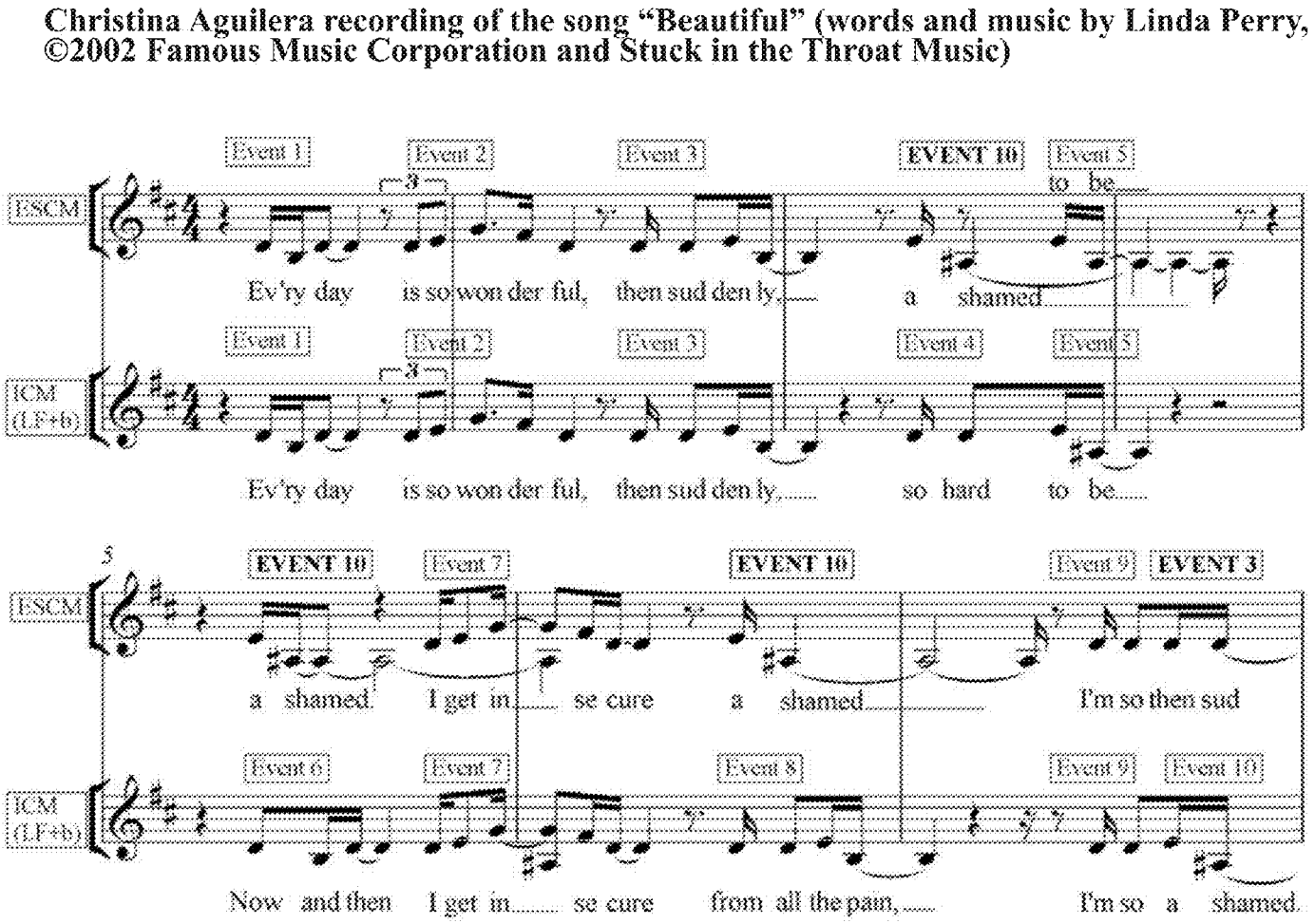
FIG. 14B is a musical score representation of an audio variation of the Christina Aguilera recording of FIG. 14A generated using embodiments of the extended-span chaotic mapping method and the improved chaotic mapping method in conjunction with the scanning method, wherein boxed and boldface capital letters indicate changes from the source recording.
Figure 14B:
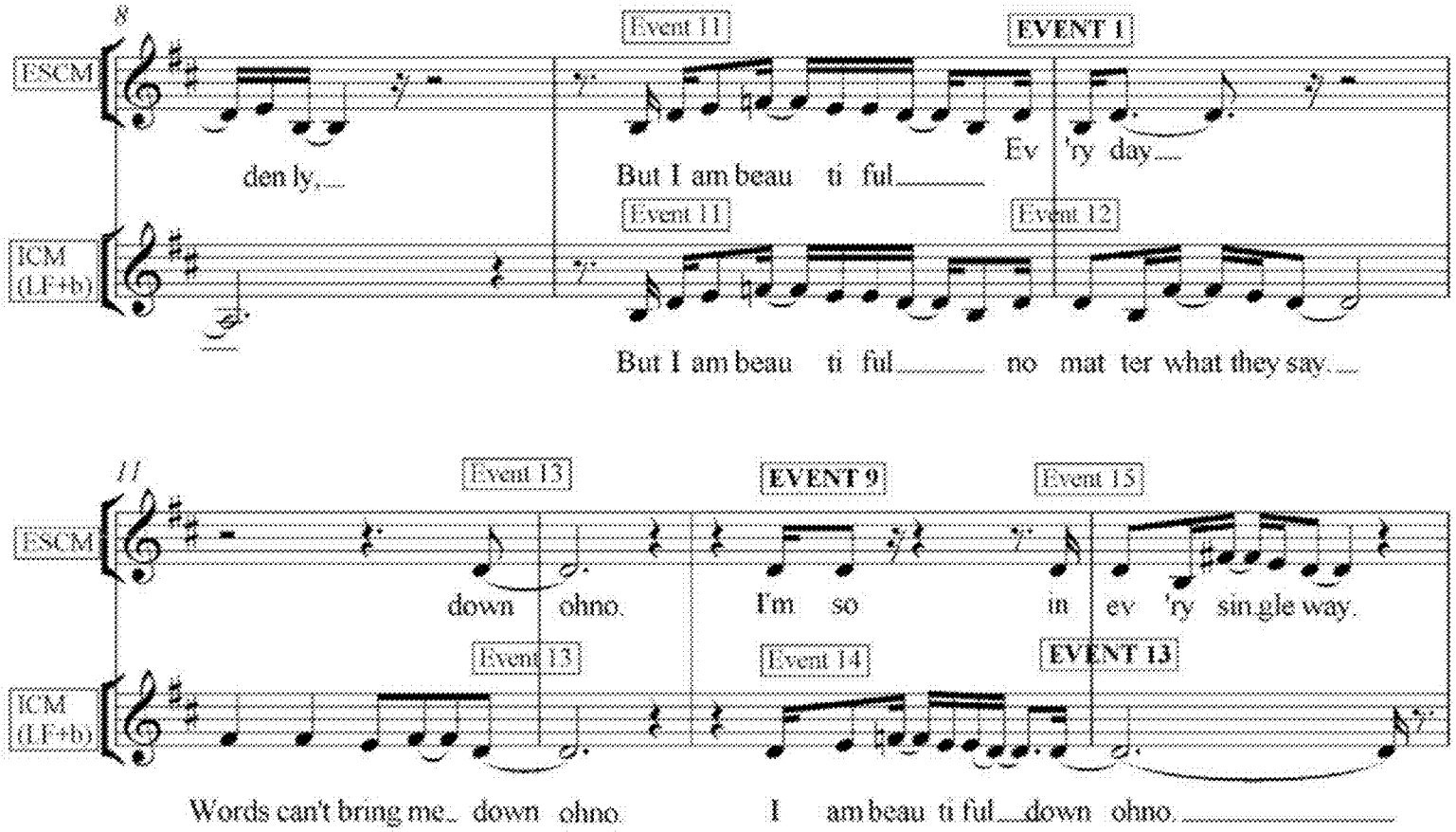
Figure 14B:
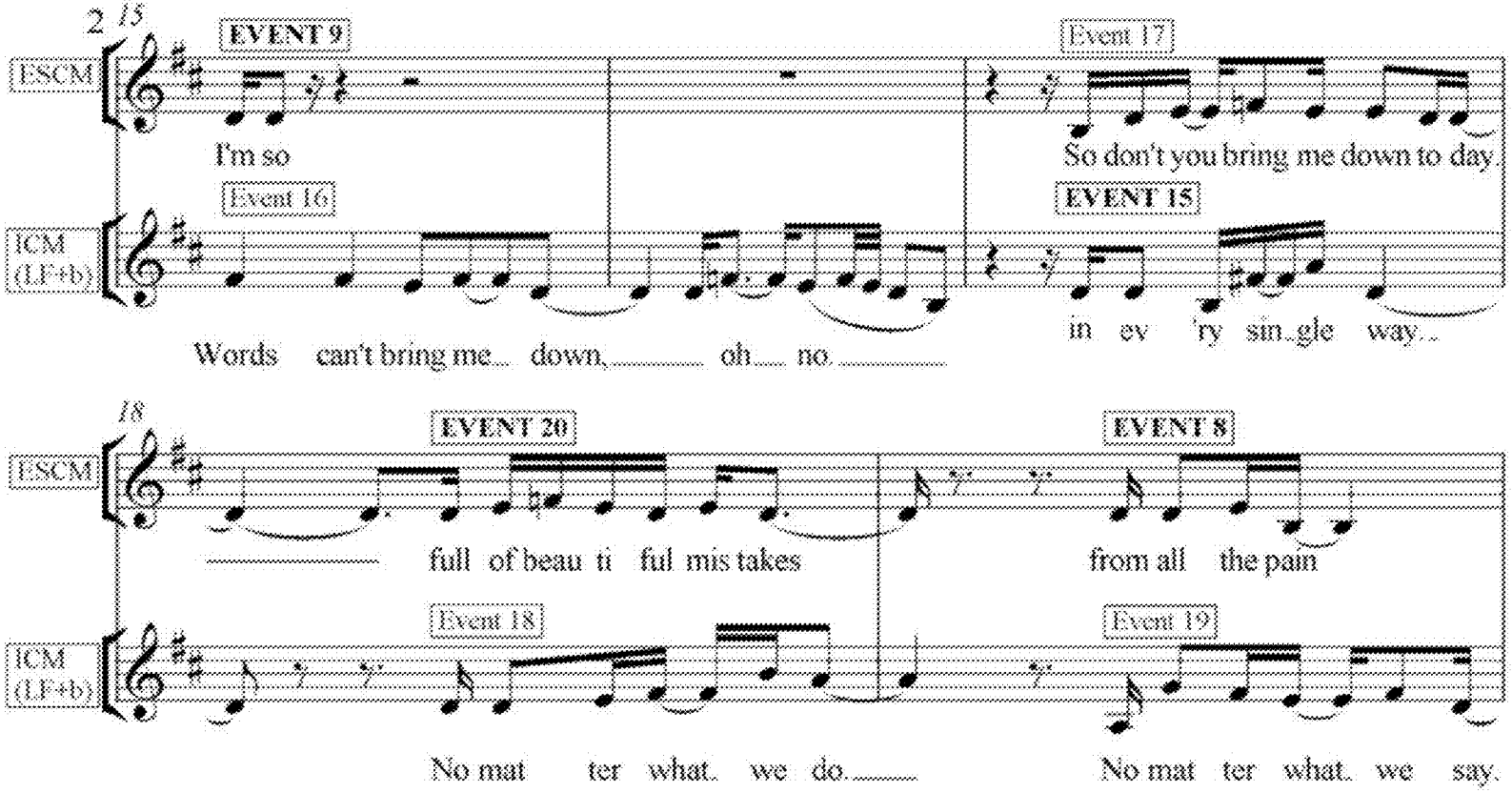
Figure 14B:
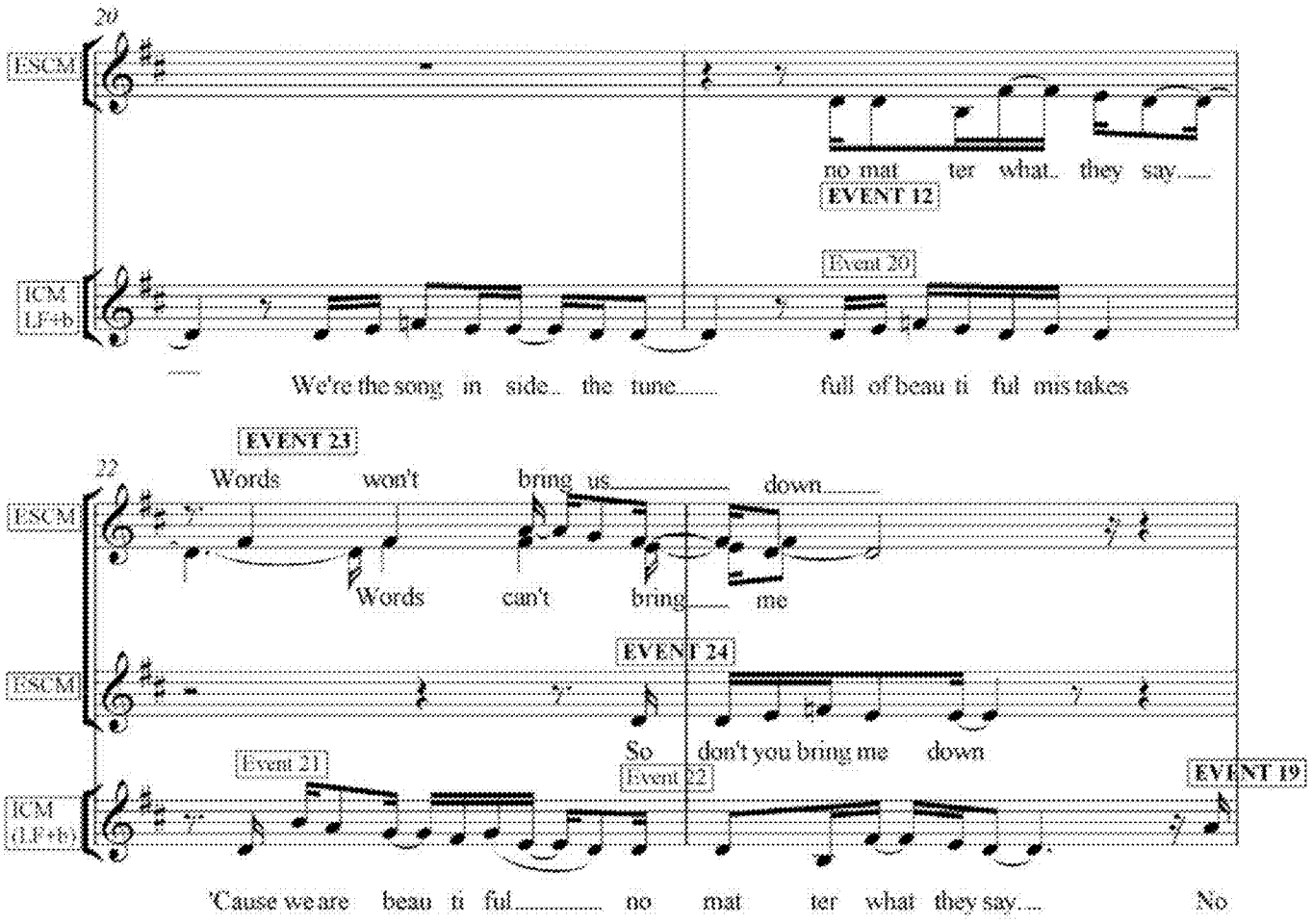
Figure 14B:
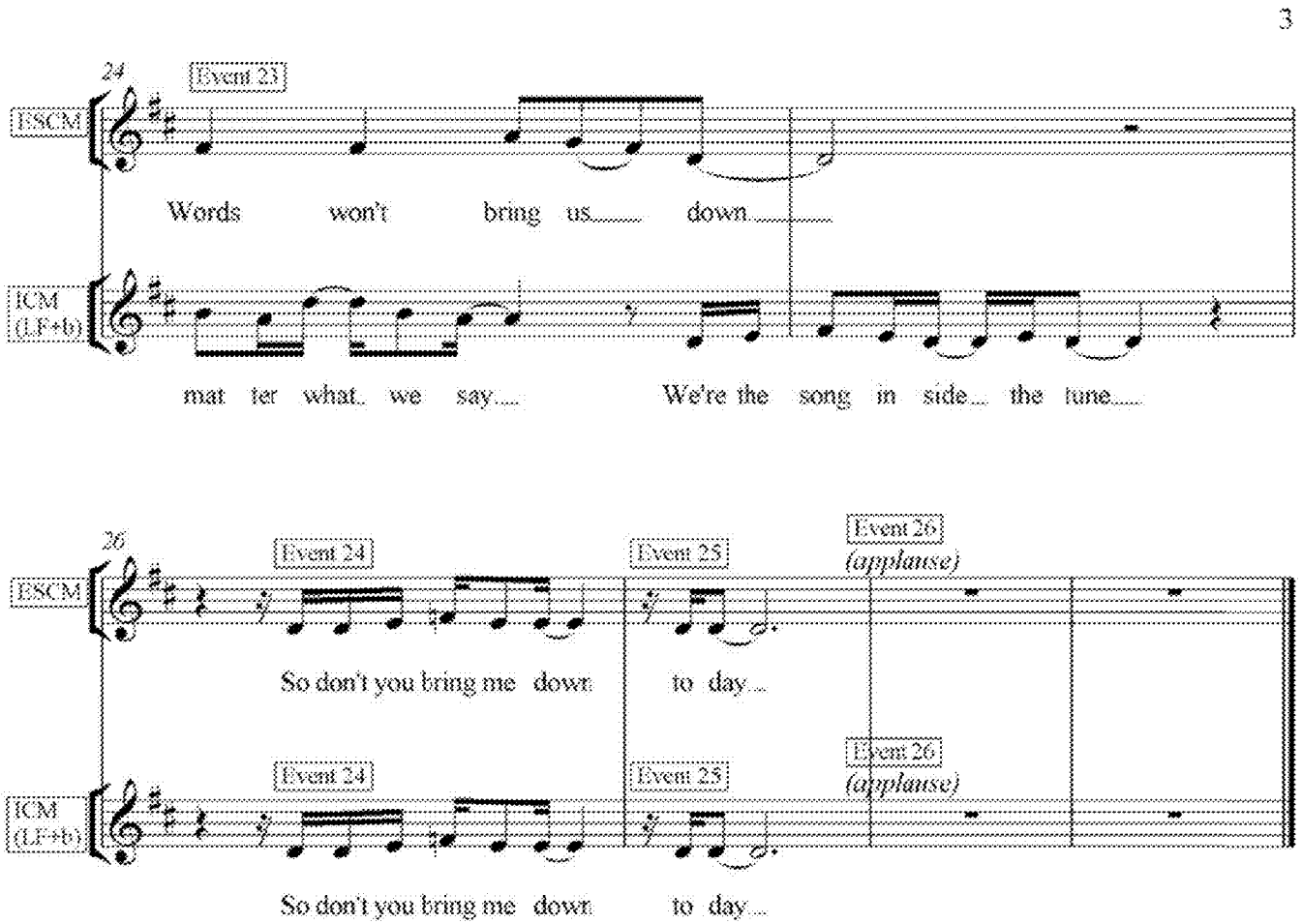

FIG. 14B is an illustrative score representation of an Audio Variation of the Christina Aguilera recording of FIG. 14A. The variation of the audio recording resulted from combining the 'Start-times only' Parser of FIG. 7G, the Extended-span Chaotic Mapping of FIG. 4 (to generate the upper vocal line in the score representation), and the Improved Chaotic Mapping using the Look Forward with Banning Scanning Option as a designated variation procedure (to generate the lower vocal line in the score representation).

To generate the upper vocal line shown in the score representation of the Audio Variation of FIG. 14B, the Extended-span Chaotic Mapping was applied to a list of events $\{e_i\}$ such that $$f(x_{2,j}) = \begin{Bmatrix} e_{g(j)}, & x_{2,j} \leq x_{1,j} \\ e_j, & x_{2,j} > x_{1,j} \end{Bmatrix} = e'_j,$$

where g(j) is assigned the value of the index j of the least $x_{1,j}$ that is greater than or equal to $x_{2,j}$. Thus $e_{g(j)}$ represents some event $e_j$ from the original event sequence $\{e_j\}$ whenever $x_{2,j}\leq x_{1,j}$. But if $x_{2,j}>x_{1,j}$, then the original event $e_j$ is retained in the variation.

The Extended-span Chaotic Mapping employed the following parameters: ICs (1, 1, 1) and (0.5, 1, 1) for the first and second trajectories, respectively, with the mapping applied to the x-values of the two trajectories. The Start time of each parsed audio event of the original event sequence $\{e_j\}$ then served as a starting time placeholder for each $e_j'$ produced by the Extended-span Chaotic Mapping (the Timing Template approach described earlier). Thus, event $e_1'$ is placed in the Audio Variation at the same Start time the original event $e_1$ occurred in the source Aguilera recording; event $e_2'$ is placed in the Audio Variation at the same Start time the original event $e_2$ appeared in the recording of "Beautiful", and so on.

The upper line of the illustrative score representation of the audio result is marked "ESCM", indicating that it was generated using the Extended-span Chaotic Mapping. The sequence of events for the upper line of the Audio Variation comprises, in order, the following audio events,

{1 2 3 10 5 10 7 10 9 3 11 1 13 9 15 9 17 20 8 23 24 23 24 25 26}, where changes from the original event sequence $\{e_j\}$ are shown above in bolded numbers. These changes are reflected in FIG. 14B, and are indicated by boxed, boldface, capital letters.

It should be noted that there are silences in the ESCM-generated part of the variation due to some $e_j'$ having shorter durations than the placeholder events $e_j$ of the source recording. There are also instances where events are longer in duration than the placeholder events.

Since it is possible to run two (or more) different methods simultaneously on any given recording, the Improved Chaotic Mapping with the Scanning Method (Look Forward+banning option) as a designated variation procedure was also applied to the source recording, shown as the lower line and marked "ICM(LF+b)" in the illustrative score representation of the Audio Variation of FIG. 14B. If the LF+b scanning returned no event that satisfied the length test and banning requirements, then the Audio Variation retained the original event.

In the resulting Audio Variation, Events 1-14 of the lower line remain unchanged from the source events because in each case, the LF+b option looked for the first unbanned event that passed the length test. For each Event 1-14, that first unbanned event turned out to be the original event. For the fifteenth open hole event of the LF+b variation, both Events 10 and 13 satisfied the length test, but since Event 10 had already been used as the tenth 'open hole filler' (and was therefore banned from further use), Event 13 became the fifteenth event of the variation.

The Improved Chaotic Mapping with the LF+b Scanning Option generated the following sequence of events $\{E_j'\}$ for the lower line of the score representation of the Audio Variation:

{1 2 3 4 5 6 7 8 9 10 11 12 13 14 13 16 15 18 19 20 22 19 24 25 26}, where changes from the original event sequence $\{e_i\}$ are shown above in bolded numbers. These changes are marked by boxed, boldface, capital letters in the "LF+b" line of FIG. 14B. In producing the lower vocal line, the Improved Chaotic Mapping employed the same ICs (1, 1, 1) and (0.5, 1, 1) for the first and second trajectories that were used to produce the upper line, but this time the mapping was applied to the y-values of the two trajectories in order to generate the lower vocal line.

The upper and lower lines in the illustrative score representation of the ESCM and ICM(LF+b) Audio Variations combine to give the Audio Variation of the Aguilera recording of FIG. 14B. This variation presents a far more complex song to the listener than the source recording. The lyrics change. For instance, the singer no longer ends with: "Words won't bring us down. So don't you bring me down today." Instead the Audio Variation concludes with "We're the song inside the tune. So don't you bring me down today."

Rhythmic and Rhythmic-Pitch Variations Via the Improved Chaotic Mapping

The Improved Chaotic Mapping in tandem with the above designated variation procedures can make rhythmic, as well as rhythmic-pitch variations of MIDI file scores, by introducing new rhythmic events, and/or new pitch/chord events, that are not present in the source. These new events can be generated by algorithms such as the Rhythmic-reversal Method, the Stenciling Method, and Infused Variation.

Rhythmic-Reversal Method

The Rhythmic-reversal Method encompasses six algorithms: (a) the Basic Rhythmic-reversal Algorithm, (b) the Rhythmic-reversal+Pitch-reversal Algorithm, (c) the Rhythmic-reversal+Pitch-Dynamic Inversion Algorithm, (d) the Rhythmic-reversal+Pitch-inversion Algorithm, (e) the Rhythmic-reversal+Pitch-reversal-Dynamic Inversion Algorithm, and (f) the Rhythmic-reversal+Pitch-reversal-inversion Algorithm.

Figure 15:
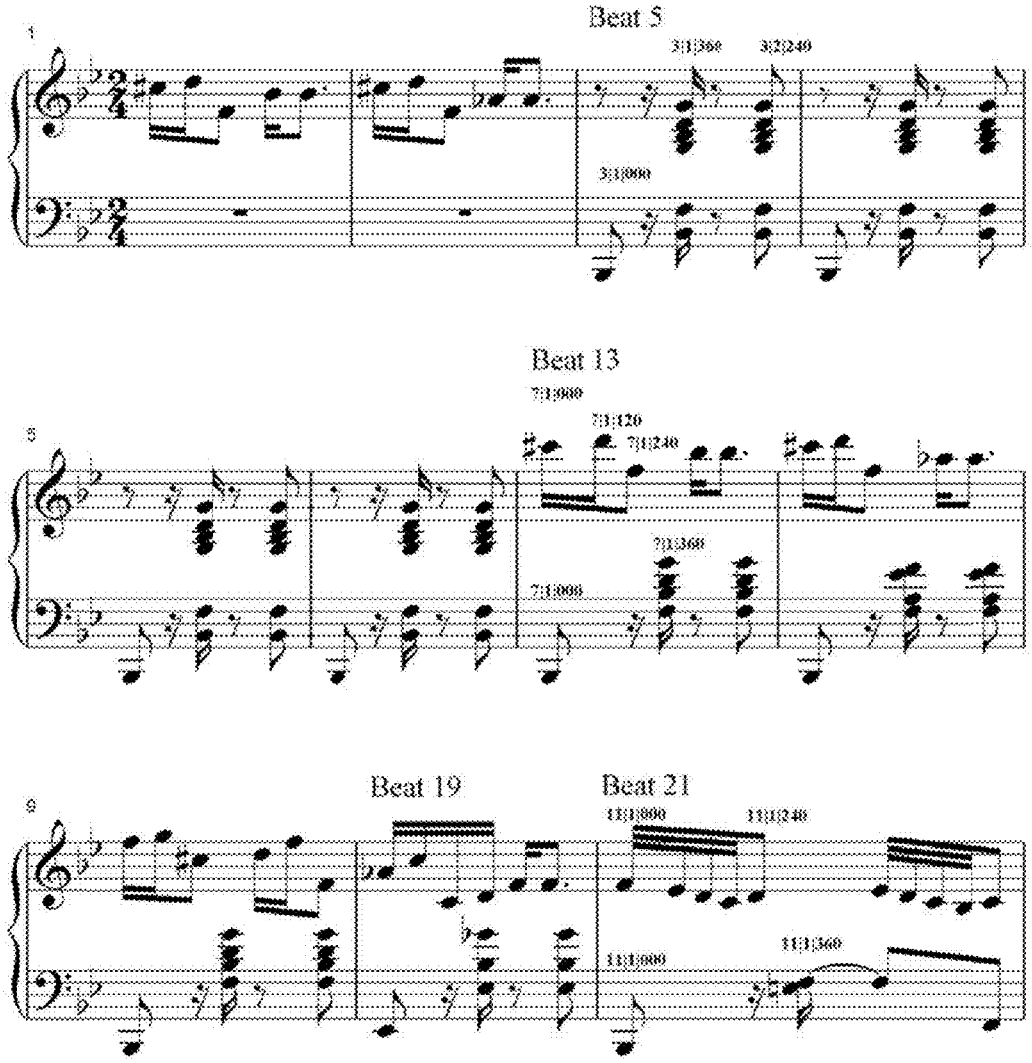
FIG. 15 is a musical score representation of Prelude No. 1 by George Gershwin, measures 1-11 (©1927 New World Music Corporation)

FIG. 15 shows the pitches and rhythms in mm. 1-11 of a source work, Gershwin's Prelude No. 1 (© 1927 New World Music Corporation). The Gershwin contains a number of different rhythmic events, and as such provides an excellent illustrative example for the methods presented here. The Discrete-time Signal Parser of FIG. 7B can be used to parse a MIDI file score by beats according to the time signature; here, it parses Gershwin's Prelude No. 1 into quarter note beats. (The bottom number of the time signature is 4, indicating that the quarter note gets one count or one beat.) Each of these quarter beats constitutes a one-beat chunk. In this short 11-measure example, there are 22 one-beat chunk events comprising the event sequence $\{e_i\}$. It is also possible to parse the Gershwin into 2-beat chunks, or in fact N-beat chunks where each N-beat chunk is considered an event $e_i$ in the original parsed event list $\{e_i\}$.

The Improved Chaotic Mapping next operates on the sequence of N-beat chunk events. Whenever $j \neq g(j)$, signifying an open hole 'receptor' event in the Hole Template of the Improved Chaotic Mapping, the Basic Rhythmic-reversal Algorithm reverses the rhythms of the receptor N-beat chunk $e_{i=j}$. But the pitches of the receptor N-beat chunk remain the same. For instance, if $j \neq g(j)$ for the first beat of the Gershwin, then the rhythmic pattern of two sixteenths followed by an eighth would be reversed to yield: eighth, sixteenth, sixteenth for that first changed beat. The notes would read C#5=eighth, D5=sixteenth, F4=sixteenth as shown in FIG. 16, part A.

There are different ways in various embodiments to reverse the rhythm of any given N-beat chunk. One reversal method of the present invention that can be applied to m. 3 of the Gershwin Prelude (a 2-beat chunk) is to "read back" the rhythmic values from right to left: eighth, eighth rest, sixteenth, sixteenth rest, eighth. The note rhythmic values would be assigned, in order, to the pitches present in m. 3 so that m. 3 of the variation would comprise: eighth=Bb1, eighth rest, sixteenth=the chord Bb2-F3-G3-Bb3-D4-G4, sixteenth rest, eighth=the chord Bb2-F3-G3-Bb3-D4-G4, as shown in FIG. 16, part B.

Another reversal method of the present invention applicable to MIDI files is to count the number of ticks separating the onset time of each pitch/chord from the onset time of the pitch/chord that follows it, here referred to as the "count back" approach. The number of ticks is found by 'looking or counting back' from a pitch/chord to the pitch/chord that immediately follows it and counting the ticks between them. The MIDI protocol allows 480 ticks per quarter note. Thus, in counting back from the last chord of m. 3 (in the source Gershwin of FIG. 15) to the downbeat of m. 4, one sees that 240 ticks separate the last chord of m. 3 from the downbeat of m. 4, as given by the MIDI time 3|2|240 assigned to the last chord of m. 3 in FIG. 15. Counting back from the second chord at 3|1|360 to the third chord of m. 3 gives 120+240=360 ticks, found by counting the number of ticks from the MIDI onset time (3|1|360) of the second chord to the MIDI onset time of the last chord at 3|2|240. Finally, 360 ticks separate the MIDI onset time of the Bb1 at 3|1|000 from the MIDI onset time of the second chord at 3|1|360. Consequently, the Basic Rhythmic-reversal Algorithm based on the "count back" approach yields the MIDI onset times 3|1|000, 3|1|240, 3|2|120 of FIG. 16, part C. These onset times are assigned to Bb1, Bb2-F3-G3-Bb3-D4-G4, and Bb2-F3-G3-Bb3-D4-G4, respectively. Note that the variation has introduced a rhythmic pattern (as reflected by the note-onset times) not found in the source Gershwin.

Rhythmic reversal can be combined with pitch reversal, so that both the rhythms of the receptor N-beat chunk $e_{i=j}$, and the pitches of the receptor N-beat chunk are reversed. Suppose that $j \neq g(j)$ for a receptor event composed of a 2-beat chunk comprising m. 3 of the Gershwin, then both the rhythm of the measure and the order of the pitches change so that the variation results in: 3|1|000=Bb2-F3-G3-Bb3-D4-G4, 3|1|240=Bb2-F3-G3-Bb3-D4-G4, and 3|2|120=Bb1, assuming a rhythmic reversal based on the "count back" approach, as shown in FIG. 16, part D.

In other embodiments, Rhythmic reversal is combined with a pitch Dynamic Inversion algorithm to reverse the rhythm and invert the pitches of the receptor N-beat chunk about a dynamic reference pitch, e.g., the last pitch/chord of the prior chunk.

As an example, suppose that the Gershwin is parsed into 2-beat chunks and the Improved Chaotic Mapping designates the 2-beat chunk comprising measure 2 as an open hole event, i.e., $2 \neq g(2)$. Then the rhythm of Event 2 must reverse, as given by the first measure of FIG. 16, part E and the pitches undergo Dynamic Inversion, as shown in the second measure of FIG. 16, part E, using the last pitch/chord of the prior chunk as the reference pitch. Here, the prior chunk is m. 1 (a 2-beat chunk), and the last pitch/chord of this chunk (chunk 1) is Bb4. Thus the pitches C#5, D5, F4, Ab4, Ab4 are now inverted about Bb4 to give G4, Gb4, Eby, C5, C5.

As an example of traditional inversion with a fixed reference pitch, again suppose that the Gershwin is parsed into 2-beat chunks and the Improved Chaotic Mapping designates the first 2-beat chunk (m. 1) as an open hole event, i.e., $1 \neq g(1)$. Then, in accordance with the Rhythmic-reversal+Pitch-inversion Algorithm, the rhythm of Event 1 (the first 2-beat chunk) must reverse, as given by the first measure of FIG. 16, part F. Then the pitches are inverted, as shown in the second measure of FIG. 16, part F, assuming middle C (C4) as the fixed reference pitch. The third measure of FIG. 16, part F shows what results if a mod 12 option is applied to the inversion about middle C. The mod 12 option transposes by K octaves any inversion that falls K octaves, plus a given interval, away from the reference pitch. Here, since the B2 of the second measure of part E lies an octave and a minor second down from the reference C4, the B2 is transposed up an octave to B3. The same procedure applies to the Bb2.

It is possible in embodiments to take the combination of Rhythmic reversal and Pitch-Dynamic Inversion one step further by using the results of the last measure of FIG. 16, part E, and reversing the order of the inverted pitches, as shown in FIG. 16, part G. Similarly, Rhythmic reversal and Pitch inversion can be taken one step further by using the results of the last measure of FIG. 16, part F, and reversing the order of the inverted pitches, as shown in FIG. 16, part H.

Of course, any embodiment of the Rhythmic-reversal Method can be applied to a series of input events or "chunks" where each chunk comprises a different number of beats, as can be created for example using the Discrete-time Signal Parser of FIG. 7B.

The Stenciling Method

In embodiments, the Stenciling Method is applicable to an input which has been parsed into events delineated by individual beats. The Improved Chaotic Mapping then operates on the sequence of N-beat chunks. Whenever $j \neq g(j)$, signifying an open hole 'receptor' event in the Hole Template of the Improved Chaotic Mapping, the N-beat chunk serving as the receptor chunk will be 'stenciled' by an appropriate rhythmic pattern selected or generated by human or machine. The Stenciling Method will stamp the note rhythms of the receptor N-beat chunk with the note rhythms of the 'stenciling' chunk.

As an example, suppose in making the variation, the Improved Chaotic Mapping returns an open hole for the thirteenth beat of the Gershwin, the first beat of measure 7, shown in FIG. 15. Suppose further that the Stenciling Method can access any rhythmic idea or motif—perhaps using the Extended-span Chaotic Mapping to select beat 5 of the Gershwin ($8^{th}$, $16^{th}$ rest, $16^{th}$) as the stenciling chunk to stamp the receptor beat 13 ($16^{th}$, 8th, $16^{th}$), also given in FIG. 15. Beat 5 has MIDI onset times 3|1|000, 3|1|360, and beat 13 has MIDI onset times 7|1|000, 7|1|120, 7|1|240, 7|1|360.

Assuming the source Gershwin Prelude is parsed into a sequence of 1-beat chunks, the Stenciling Method in embodiments takes the MIDI onset times contained in beat 5, i.e., 3|1|000, 3|1|360, and overlays this rhythm like a stencil on receptor beat 13. The MIDI times for the pitched events in beat 13 are Bb1-C#6=7|1|000, D6=7|1|120, F6=7|1|240, F3-Bb3-D4-G4=7|1|360. Those pitches in the receptor chunk (here, beat 13) that are coincident with, or 'directly touch', the note values in the stenciling chunk (beat 5) are assigned the stenciling rhythm, i.e., Bb1-C#6=7|1|000 and F3-Bb3-D4-G4=7|1|360.

The Basic Stenciling Algorithm allows only those pitches in beat 13 that are stamped by the note rhythmic values of the stenciling beat 5 (Bb1-C#6=7|1|000 and F3-Bb3-D4-G4=7|1|360) to occur in the variation; the other pitches in beat 13 are discarded (everything between the downbeat and the last $16^{th}$ of beat 13 disappear in the variation). Clearly, this will change the rhythmic and pitch structure of the piece. Different rhythms can get stamped onto receptor N-beat chunks, while some essence of the pitch and harmonic vocabulary remains. This can be highly desirable as a variation technique, because it achieves a kind of 'reduction' or 'condensation' of musical material. Yet even if the stenciling chunk contains more pitch/chord events, and hence more note rhythmic values, than the receptor chunk, the rhythm of the receptor chunk can never include more note rhythmic values than it originally possessed.

The Expanded Stenciling Algorithm first applies the Basic Stenciling Algorithm. Both algorithms are treated in FIG. 17.

As an example where the stencil contains fewer notes than the receptor, suppose in the Gershwin Prelude beat 5 stencils beat 21. Both beats 5 and 21 are shown in FIG. 17, parts A and B, respectively. Since beat 5 has fewer note events than beat 21, and since both pitch/chord events in beat 5 directly touch and are coincident with the first and last chords of beat 21, the result of beat 5 stenciling beat 21 will give the result shown in FIG. 17, part C.

When applied to MIDI files, the Basic Stenciling Method lays a stenciling chunk on a receptor chunk. Any event overlap showing coincident onset times constitutes a direct hit. Thus the result of beat 5 stamping beat 21 consists of only the chord Bb1-F4 (the result of coincident 3|1|000 and 11|1|000) and the chord E3-F3 (the result of coincident 3|1|360 and 11|1|360).

Now consider what can happen if the stenciling rhythm contains more note values than the receptor beat. Suppose beat 21, the first beat of m. 11 (FIG. 17, part B) is now the stenciling beat that will stamp beat 5, the first beat of m. 3 (FIG. 17, part A). Beat 21 includes an initial chord plus 32' notes followed by an eighth and a sixteenth. Placing the note-onset times of beat 21 over beat 5 results in just two 'direct hits': the Bb1 at the start of beat 5 and the Bb2-F3-G3-Bb3-D4-G4 chord on the fourth sixteenth of beat 5 are coincident with the stencil (FIG. 17, part D). Up to this point, the Basic Stenciling Algorithm has been applied.

But the Expanded Stenciling Algorithm goes further. It imprints the stenciling rhythm of three more $32^{nd}$ notes plus an eighth note on the receptor chunk. In general, the Expanded Stenciling Algorithm must imprint all the note rhythms present in the stenciling chunk upon the receptor chunk. Since the three extra stenciling $32^{nds}$ occur in the first half of the stenciling beat 21 and since Bb1 is the only note that sounds in the first half of the receptor beat 5, the algorithm assigns the Bb1 to each of the three $32^{nd}$ note rhythms, since it is the nearest pitch in the first half of the beat (the "nearest pitch" approach). The first half of beat 5 as it will be heard in the variation is shown in FIG. 17, part E, starting at 3|1|000.

To implement the stenciling eighth note rhythm located at 11|1|240 (in the second half of the treble part of beat 21) in FIG. 15, the algorithm must now look in the second half of receptor beat 5 to assign a pitch/chord to the stenciling eighth note of 11|1|240. In the second half of receptor beat 5, the algorithm finds the chord Bb2-F3-G3-Bb3-D4-G4, to which it assigns the timing information of the eighth note rhythm (11|1|240) but now adjusted to a commensurate location in beat 5 (i.e., 3|1|240), as marked in FIG. 17, part E.

As mentioned earlier, the Bb2-F3-G3-Bb3-D4-G4 chord found on the fourth sixteenth of beat 5, by virtue of its being coincident with the last $16^{th}$ of the stenciling chunk, is retained as is. In the variation, then, this chord will be heard as the last sixteenth of beat 5 in the variation. The final result, shown in FIG. 17, part E, shows much pitch repetition.

In various embodiments, the Expanded Stenciling Algorithm can be combined with any of several stenciling options which redress the repeated note problem of the "nearest pitch" approach. These options are illustrated in FIG. 18, using the same receptor and stenciling chunks shown in FIG. 17, parts A and B, respectively. In Option A, any repeated pitches/chords inserted by the "nearest pitch" approach of the Expanded Stenciling Algorithm are tied to one another, creating another rhythmic change, as demonstrated in FIG. 18, part A. In Option B, for those note rhythms of the stenciling beat that do not score direct hits, pitches attached to those rhythms from the source piece, or from any other source, are transplanted into the receptor, along with their associated rhythmic values. They are referred to herein as "transplanted notes", or simply the "transplant," and are indicated by horizontal brackets above the staff. In FIG. 18, part B, the pitches Eb4, D4, C4, and D4, the pitches originally attached to the non-coincident note rhythms of the stenciling beat, comprise the "transplant" for beat 5 of the variation.

Option C is the same as Option B, except that any transplanted pitches/chords are inverted about a reference pitch such as middle C. FIG. 18, part C shows the result. Option D is the same as Option B, except that any transplanted pitches/chords undergo Dynamic Inversion. Here, they are inverted about the prior pitch/chord of the variation (here, Bb1), as can be verified in FIG. 18, part D: F1, Gb1, Ab1, Gb1 with mod 12 applied. Without applying mod 12, the transplant undergoing Dynamic Inversion would fall outside the range of the piano keyboard (two octaves below F1).

Option E is similar to Option D, except that transplanted pitches/chords are inverted about the last pitch/chord of the most recent unchanged N-beat chunk of the variation (FIG. 18, part E). Here, Ab4—the last pitch of beat 4—serves as the reference pitch, assuming beat 4 occupies a blackened hole in the variation. Option F is similar to Option B, except that the order of any transplanted pitches/chords is reversed. The reversed transplant in FIG. 18, part F, is D4 C4 D4 Eb4. If the transplant contains only one note, then the algorithm can either do nothing or it can reverse the transplanted note with the variation pitch/chord that occurs before (or after) it.

Options G, H, and I are all similar to Option F. In Option G, the transplant is not only reversed but also inverted about a fixed reference pitch, e.g., middle C. The reversed-inverted transplant in FIG. 18, part G, is given by Bb3 C4 Bb3 A3. In Option H the transplant is not only reversed but also undergoes Dynamic Inversion about the most recent pitch/chord of the variation. Here, Bb1 serves as the inversion point. In FIG. 18, part H, the inverted and reversed transplant is given by Gb1 Ab1 Gb1 F1, with mod 12 applied. In Option I, the transplant is not only reversed but also undergoes Dynamic Inversion about the last pitch/chord of the most recent (prior) unchanged N-beat chunk of the variation. Here, Ab4 serves as the reference pitch. In FIG. 18, part I, the transplant is reversed, and then inverted about the last pitch/chord of the most recent (prior) unchanged N-beat chunk of the variation, resulting in the pitch sequence D5 E5 D5 Db5.

If any transplant of Options C-E and G-I contains one or more chords, the chord or chords can be inverted by first inverting the midpoint of the chord and then inverting the chord's pitches about the new midpoint.

As with the Infused Variation Methods described below, the Stenciling Method can stamp one piece with the rhythmic characteristics of another in order to infuse the first piece with rhythmic ideas from the second, or from any other source. The Stenciling Method can be used with the Improved Chaotic Mapping, or with any other method capable of generating receptor and stenciling events, such as a probabilistic scheme.

So far the Stenciling Method has been applied to a sequence of N-beat chunks, where each parse contains the same number of beats as every other parse. In embodiments, the Stenciling Method can be applied to a sequence of n-beat chunks, where n is variable. Thus the number of beats comprising each parse can be customized according to some desirable outcome.

Infused Variation Methods

Embodiments of the present invention enable a user to make Infused Variations by infusing a source piece not only with pitch/chord events from other pieces, but also with rhythmic events from one or more separate works. In embodiments, each time $j \neq g(j)$ in the variation process, the invention can supply user- or machine-generated seed event(s) from a work outside the event space of the input file, i.e., outside the original event sequence $\{e_i\}$. Such an event of the seed source can be selected based on various strategies, e.g., selection of the seed event based on a comparison of what preceded the seed event in the seed source, and what preceded the 'open hole' event in the input file.

Moreover, any seed element or sequence of seed elements can be varied using any combination of the variation techniques described above. For example, any seed can be stenciled by the open hole receptor event of the source piece so that the pitch/chord events of the seeds themselves are rhythmically varied, or the pitch/chord events of the input file can vary by infusing or stamping them with the rhythms of a seed file.

It is also possible to use a seed 'stencil' to infuse the input file. For example, for N-chunk parsing, the entire input file is overlaid by the entire seed file. Next, the Improved Chaotic Mapping, operating on the input file, produces the open and blackened holes forming the Hole Template. (The Hole Template could also be produced by a probabilistic scheme.) Any open hole N-beat chunk of the input file is stenciled by the N-beat chunk of the seed file that overlays it. Those pitch/chords of the receptor chunk that are not coincident with any pitch/chords of the seed chunk can then be retained, varied, or thrown away. (Or they could be replaced by any transplanted notes from the stencil, according to Options B-I of FIG. 18.) A similar scheme also applies to the pitch/chords of blackened hole N-beat chunks.

In embodiments, Infused Variations can occur even without the Hole Template of the Improved Chaotic Mapping. The process in various embodiments involves overlaying two files, noting all coincident events, and replacing one by the other. Those non-coincident events can either be retained, eliminated, or varied further by the Expanded Stenciling Algorithm, for example using any of the Stenciling Options A-I of FIG. 18. Any seed or receptor element can be further varied by any method, for example by Dynamic Inversion. In this way, piece A can be infused by coincident events in piece B, and vice versa.

Infused Variation of continuous inputs such as audio files can also be accomplished via the Scanning Method, which can select and implant audio seed events into an input audio file. The first step is to select an input piece and a seed piece and parse both. Whenever $j \neq g(j)$, signifying an open hole 'receptor' event in the Hole Template produced by the Improved Chaotic Mapping operating on the input file, the seed piece is scanned, according to any of the Scanning Options described above, to find a seed event that can fill the open hole of the input file.

Events from different pieces can be joined using any of various audio tools, such as beat matching technology whereby tempo adjustments are made to the input and/or seed pieces to ensure tempo compatibility; peak normalization of the input and seed files so that they both have the same relative dynamics (i.e., the signal-to-noise ratio remains unchanged from one file to the next); crossfading, including adjustment of the duration of the crossfading and/or placement of the cut point (i.e., the point where one event abuts another); masking techniques such as adding material over a cut point, e.g., inserting looping material or percussive material; equalization exchanges (switching EQs) over the cut point whereby one EQ band is faded out while another is faded in, e.g., turning the treble EQ of one event to full volume while turning the treble EQ of the following event to full volume; eliminating frequencies past a certain threshold, e.g., over the cut point; eliminating (or diminishing) the bass of one event and eliminating (or diminishing) the treble of the following event while employing some crossfading to smooth over the transition; as well as other tools known in the art.

Application of Discrete-Input Variation Methods to Continuous Inputs

In embodiments, the discrete-input variation methods described herein can be applied to continuous inputs by converting the continuous input to a discrete input. State-of-the-art audio technology such as audio-to-MIDI converters exist or can be implemented, as for instance described by Carabias-Orti, et al. (J. J. Carabias-Orti, P. Vera-Candeas, F. J. Cañadas-Quesada, and N. Ruiz-Reyes. "Music Scene-Adaptive Harmonic Dictionary for Unsupervised Note-Event Detection," IEEE Transactions on Audio, Speech, and Language Processing 18 (3), 473-486 (2010)).

FIGS. 19, 20, and 21 combine to offer a concrete example of an Audio Variation made on the level of individual notes. FIG. 19 gives a score representation of the mp3 vocal track recording of the 2008 hit song "Paparazzi" (©2008 Sony/ATV Music Publishing. June Bug Alley Music and House of Gaga Publishing, Inc.). The words and music for the song "Paparazzi" were written by Robert Fusari and Stefani Germanotta (Lady Gaga) for her debut album *The Fame* released in 2009. The song has the form A B A B C B, where the B section (mm. 17-32) represents the refrain of the song. Repeated notes (in groups of three or four), are often heard within groups of four eighth notes. These repeated notes and the rhythmic motif of four eighth notes characterize the A and B sections.

To produce the "Paparazzi" variation of FIG. 20, the Improved Chaotic Mapping was first used in conjunction with a Reverse-pitch algorithm. The reversal algorithm worked as follows: whenever $j \neq g(j)$, signifying an open hole 'receptor' event in the Hole Template produced by the Improved Chaotic Mapping operating on the input file, the pitch sequence was reversed. The result was then varied again using the Improved Chaotic Mapping but now in conjunction with the Interval Method (with the interval of a minor third up) as the designated variation procedure.

The block diagram of FIG. 21 demonstrates how to create an Audio Vocal Track Variation where individual notes are changed, as for example heard in the "Paparazzi" variation of FIG. 20. If the audio vocal track of Block [1] contains reverb, then the reverb can later cause unwanted noise when the Audio Variation is heard. Equalization can lessen the reverb in the source vocal track recording; a compressor can then amplify the signal above a given threshold. Still, even if some unwanted reverb noise is heard in the varied vocal track, it will be masked when the varied vocal track is mixed with the synthesizer and beat tracks.

The Audio Vocal Track [1] enters an Audio-to-MIDI converter [2], which identifies the individual pitches and their onset times in the mp3 vocal track recording. The pitch sequence $\{p_i\}$ and onset time sequence $\{n_i\}$ are provided to [3]. If no pitch detector is available, the mp3 vocal track pitch sequence $\{p_i\}$ can be produced by hand, either by using an existing score and/or by ear.

Used in conjunction with one or more designated variation procedures [4], the Improved Chaotic Mapping [5] and/or another modification scheme operates on the pitch sequence $\{p_i\}$ of the source song and produces the pitch sequence of the variation $\{p'_j\}$ [6].

The MidiTime-to-AudioTime converter [7] converts the sequence of MIDI onset times $\{n_i\}$ to audio equivalent times $\{t_{i=j}\}$. Two indices are initialized to i=1 and j=1 [8]. Since some of the $p'_j$ correspond to changed pitches in the source audio vocal track while other $p'_j$ denote unchanged pitches from the source audio vocal track, the $p_i$ and $p'_j$ are compared [9]. If $p_i = p'_j$, for i=j, then the algorithm does nothing to the Audio Vocal Track [1], but if $p_i \neq p'_j$, a state-of-the-art pitch detector locates the pitch $p_i$ occurring at audio time $t_{i=j}$, and a pitch shifter is then employed to pitch shift $p_i$ to $p'_j$ in the Audio Vocal Track including any additional equalization adjustments to the shifted pitch [10]. Equalization adjustment may be necessary to eliminate any unwanted background noise that was pitch shifted as well. The indices are incremented [11] and the process continues, until the end-of-file has been reached.

When the end-of-file is reached [12], an Audio Vocal Track exists with a pitch sequence that differs from the original [13]. State-of-the-art audio technology is used [14] to smoothly stitch (meld) each changed pitch to the previous and succeeding pitches in the modified Audio Vocal Track [13]. The audio edits can include short crossfades, changes in the durations of neighboring notes, adjustments to pitch intonation and vibrato, and adjustments to front and back ends of pitch events. After the stitching process, the algorithm produces the completed variation of the source piece [15], which is sent to the mixer [16], amplifier [17], and speakers [18] so that it can be heard.

Given state-of-the-art audio technology—including but not limited to Audio-to-MIDI conversion, MidiTime-to-AudioTime conversion, as well as operators capable of identifying, accessing, moving, elongating/shortening, removing, shifting, and detecting duration of individual note events in an audio file—and the block diagram of FIG. 21, it is also possible to produce Rhythmic and Rhythmic-pitch Audio Variations (via the Rhythmic-reversal Method and Stenciling Method Algorithms), as well as Infused Variations on the level of individual note events and/or groups of notes, such as N-beat chunks.

These results enabling Pitch, Rhythmic-pitch, and Infused Variations can further extend to other forms of continuous-time signals, e.g., film, video, spoken word art, video games, prose, poetry, image, and so on, as can all other variation techniques discussed herein, such as the Improved Chaotic Mapping, the Extended-span Chaotic Mapping, Dynamic Inversion, the Interval Method, Scanning Method, Rhythmic-reversal Method, and the Stenciling Method. All of the above can be adjusted to suit non-Western styles as well.

Figure 22A:
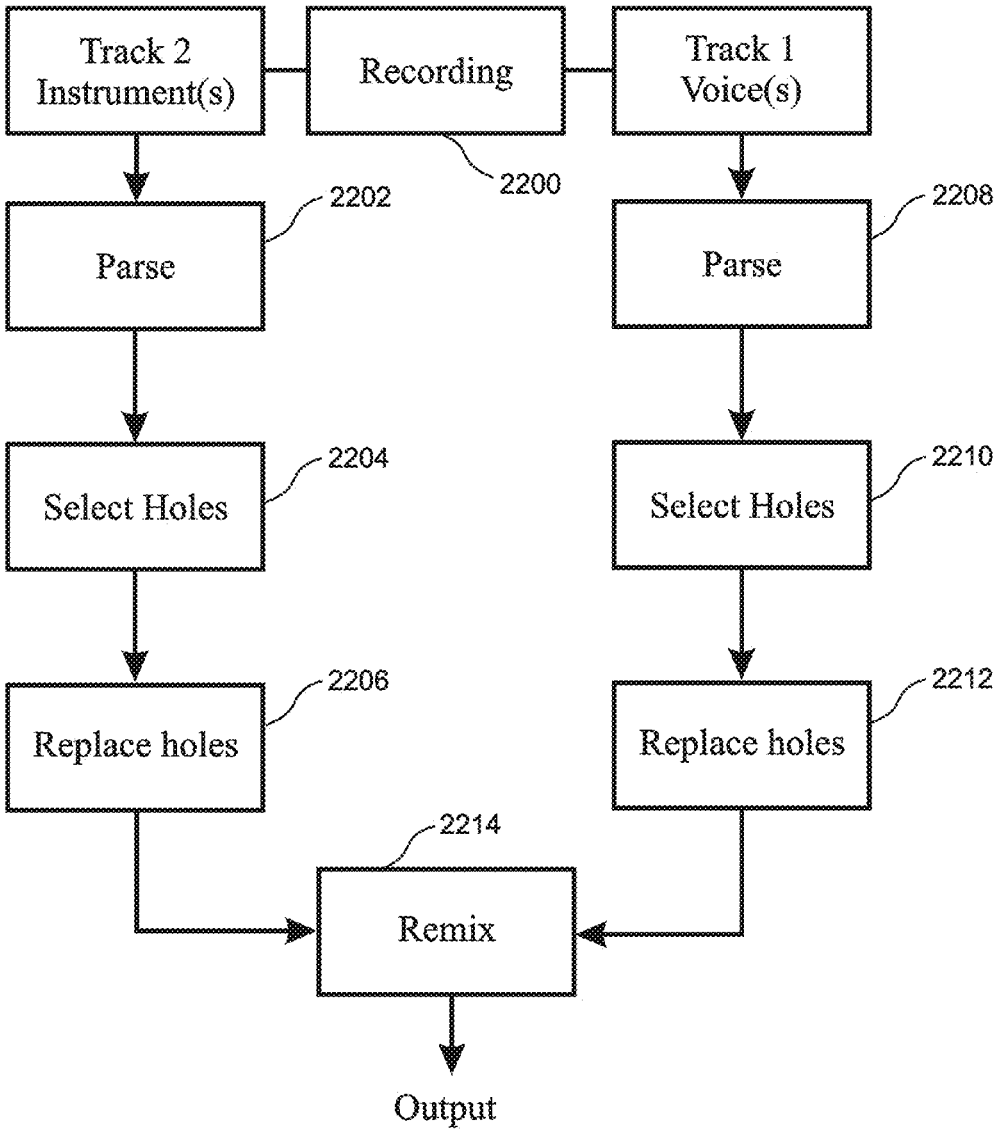
FIG. 22A is a flow diagram illustrating an embodiment in which the instrumental and voice tracks from a musical recording are separately varied according to the present invention and then remixed.
Figure 22B:
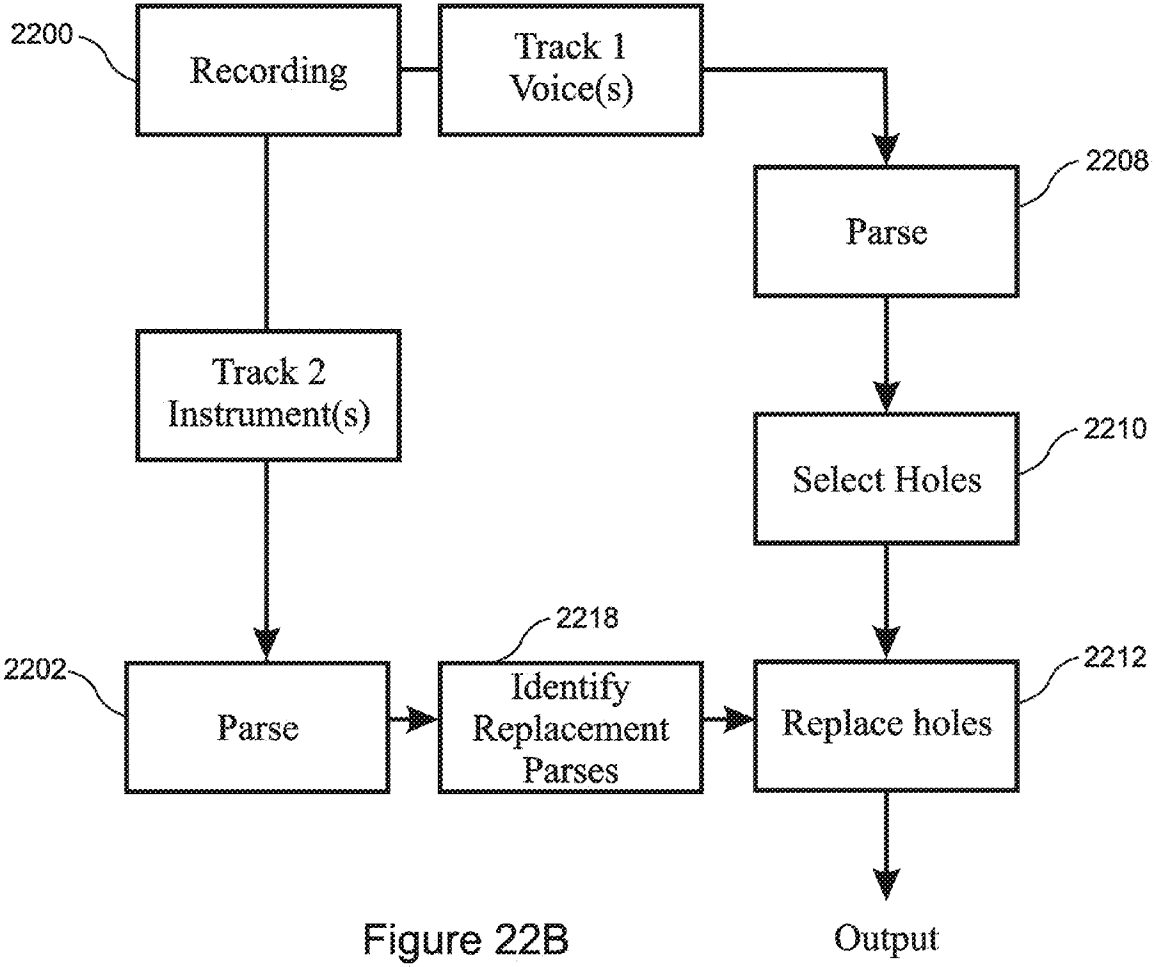
FIG. 22B is a flow diagram illustrating an embodiment in which the voice track of a recording is used as the input source for variation, and the instrumental track from the same composition is used as a seed source for the variation according to the present invention.

With reference to FIGS. 22A and 22B, separate tracks from a musical recording 2200 (e.g. voice, accompanying instruments, and percussion) can be treated as separate input sources for variation according to the present invention and then recombined to create a "remixed" variant. With reference to FIG. 22A, the tracks can be separately parsed 2202, 2208, holes can be selected 2204, 2210 and filled 2206, 2212, and then the new, variant tracks can be combined to create a remix 2214. Or, with reference to FIG. 22B, one or more tracks can be used as a seed source for another track or group of tracks 2216 from the same recording 2200. In embodiments, a website or other forum is provided for composers, artists, bands, and such like to post the separate tracks from their recordings, so that "fans" can remix them and create individualized and differentiated works.

Figure 22C:
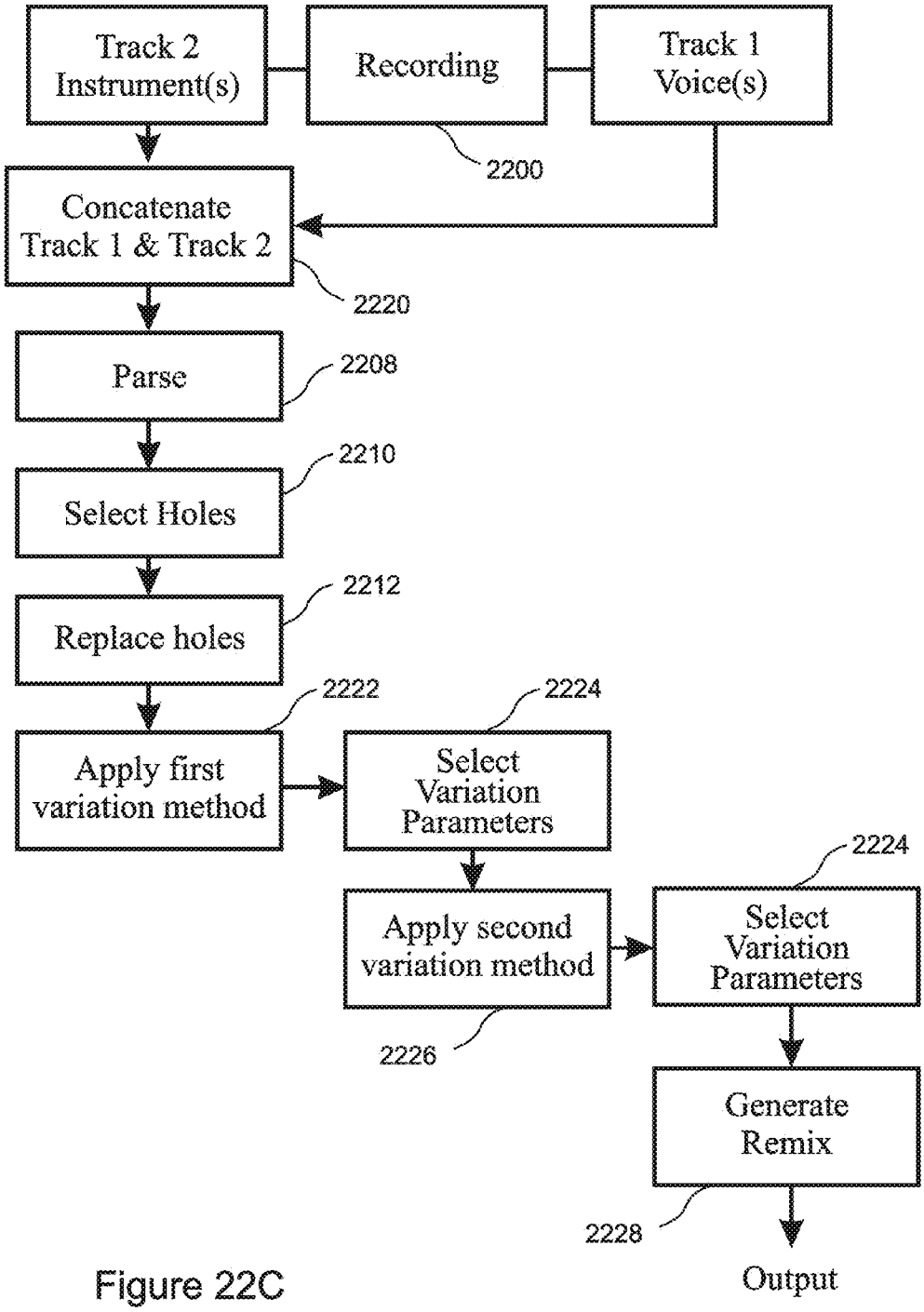
FIG. 22C is a flow diagram illustrating an embodiment in which the voice and instrumental tracks are concatenated and then used as an input to which two separate variation methods are applied to form a remix of the recording.

With reference to FIG. 22C, embodiments of the present invention can be used to generate a remix by concatenating two tracks or two groups of tracks 2220 to make one Vocal-Instrumental file which can then be parsed 2208. In the embodiment of FIG. 22C, after the holes are selected 2210 and replaced 2212, a first variation method is applied 2222, such as ESCM (Extended-Span Chaotic Mapping), after which variation parameters are selected 2224 and a second variation method, such as ICM (Improved Chaotic Mapping, with a designated variation procedure such as Look Forward with Banning), is applied 2226. Subsequently, variation parameters are once again selected 2224, and a remix is generated 2228.

Figure 22D:
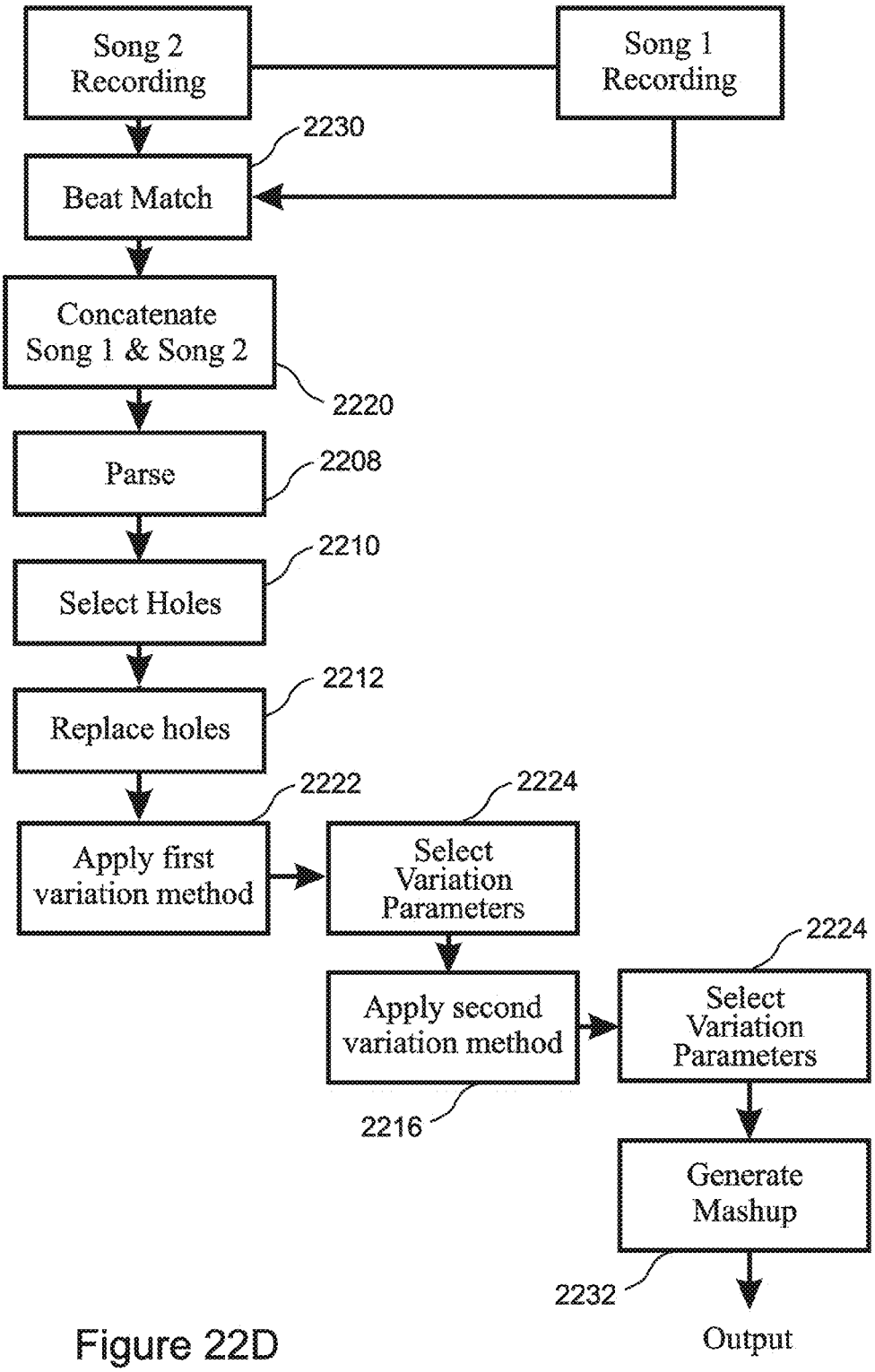
FIG. 22D is a flow diagram illustrating an embodiment similar to FIG. 22C, except that two separate recordings are adjusted by applying beat matching or some other technique known in the art, for example a tool commonly used by disk jockeys, and then concatenated as the input to which two separate variation methods are applied to form a mash-up of the two recordings.

FIG. 22D demonstrates how to generate a mash-up 2232 of two different songs by applying typical DJ tools such as beat matching the songs, and then concatenating them 2220 for input to a variation process similar to FIG. 22C.

Music variations created using the present invention can be uploaded to websites, including social media sites and digital music services such as Pandora and Spotify. In embodiments, a website can be programmed to generate and play a new variation of a composition each time the website is visited. Similarly, a mobile app can implement the present invention to change specific songs on a playlist, e.g., to rejuvenate a play list or create playlists where the original songs are varied so that they can change from one hearing to the next.

Figure 23:
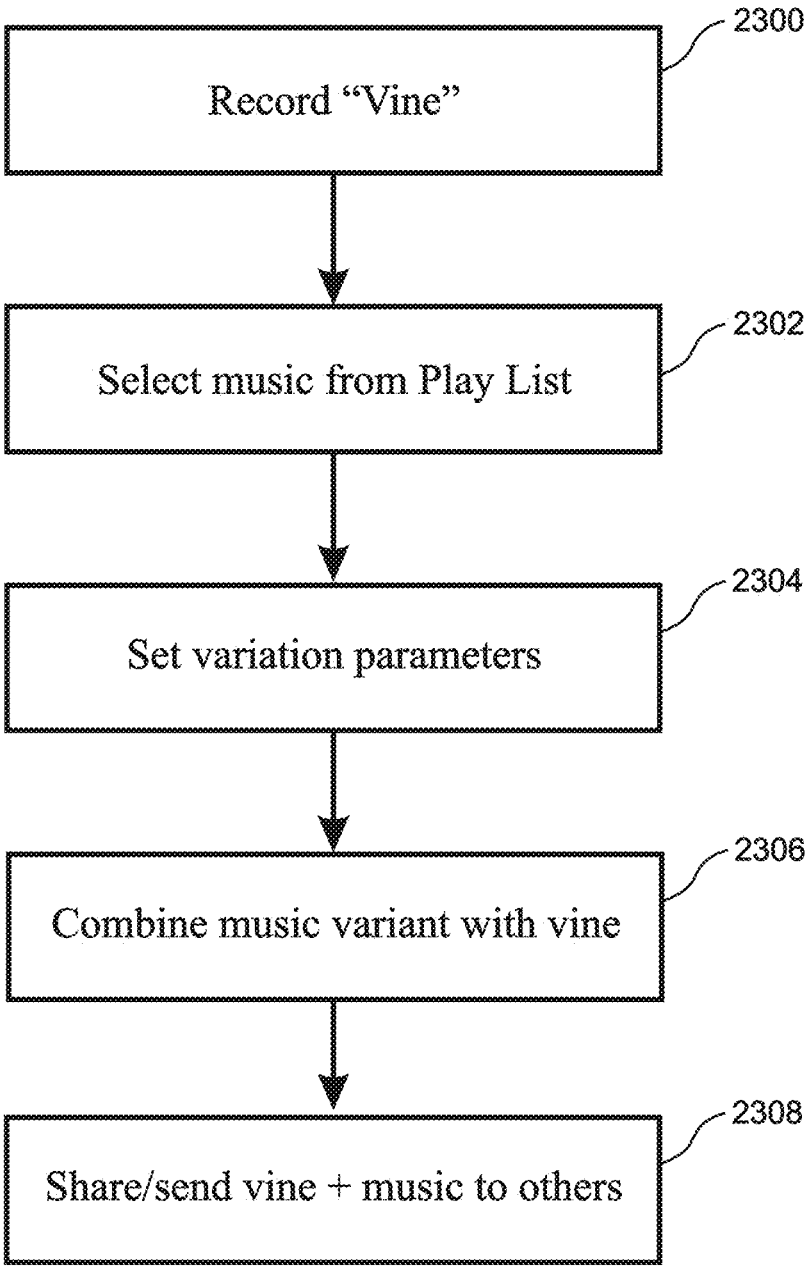
FIG. 23 is a flow diagram illustrating combination of a variant of a composition with a short video for sharing with others in an embodiment of the present invention.

Music variations can also be combined with graphical works such as photographs or videos. For example, with reference to FIG. 23, a user can take a "selfie" or other photograph, or a short video such as a "vine" 2300, using a hand-held device, select a recording from a play list 2302 on the device, set adjustable parameters that will control the type and degree of variation 2304, and then use the present invention to create a novel variation of the recording 2306. The combined recording and vine can then be shared/forwarded to a friend 2308 or to a social network.

Figure 24:
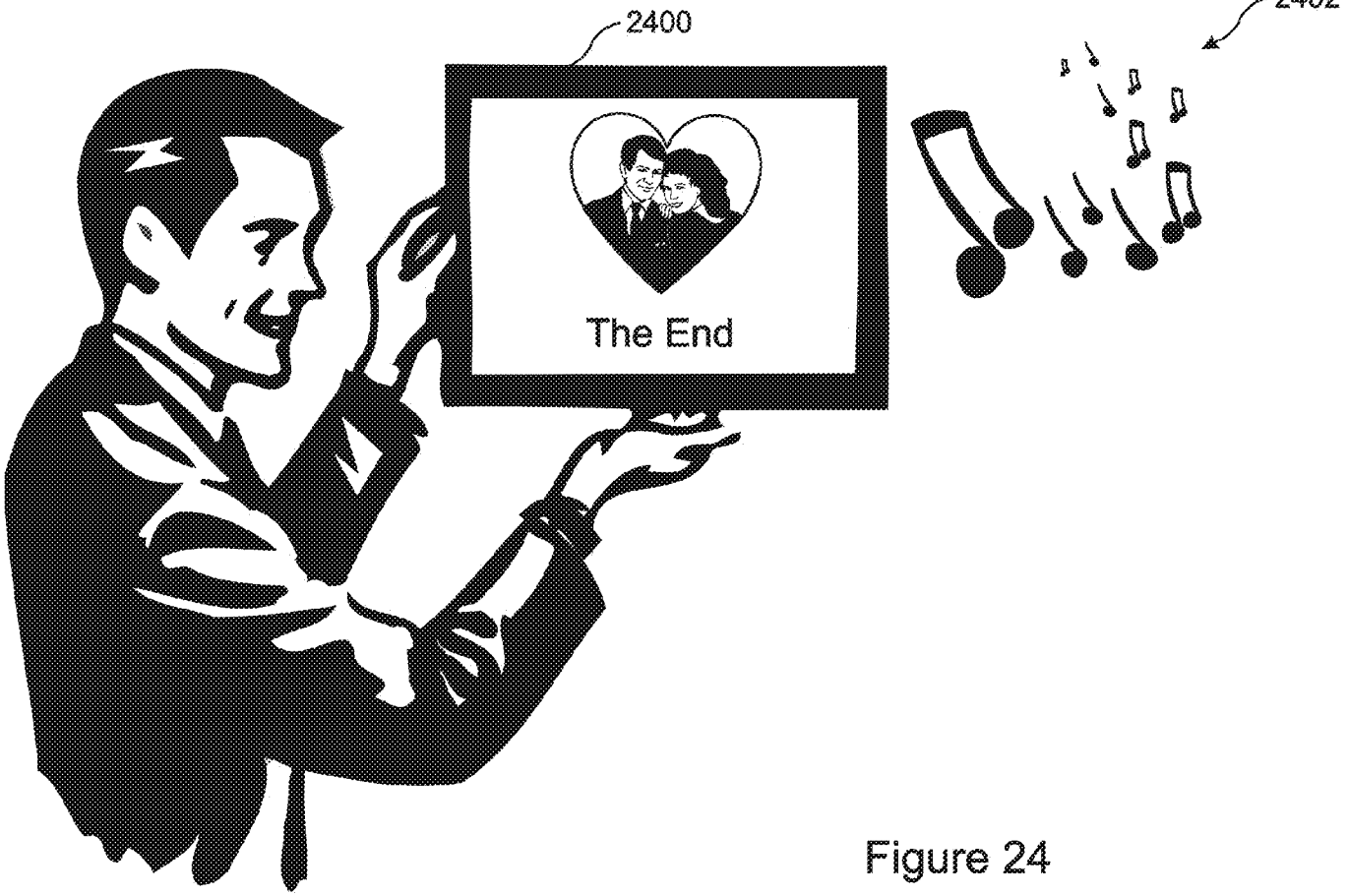
FIG. 24 illustrates a user giving a storyboard presentation in which the graphics are accompanied by variants of a musical composition created using the present invention.

With reference to FIG. 24, in embodiments a composer can create short variations of a musical input 2400 using the present invention that will accompany the graphics in a presentation of a concept such as a business proposal, artistic concept, or project plan, so as to win approval and commitment to the project before investing the time and effort required to create a full accompanying score. In other embodiments, short musical variations created using the present invention can be included with a PowerPoint or similar presentation, so as to add an audible component to a business presentation. In some of these embodiments, the present invention is embedded within the software used to generate the presentation, to facilitate the creation by the presenter of unique auditory elements.

The present invention can enhance social interactions in other ways. For example, with reference to FIG. 25, a greeting card 2500 can include a small chip that is accessible via the web or via a computing device, so that the user can store thereupon a unique and personal composition 2502 created using the present invention, to be played when the card is opened. The user can further include a recording of his or her own voice, or of another acoustic input, to further personalize the message. For example, a Valentine's Day card could include a custom variant of a romantic song where a recording of the sender's voice speaking the recipient's name is used as a seed source. Or the sender could record himself/herself sing the Happy Birthday song and use the recording as a seed source to vary a well-known composition (e.g. theme from Star Wars) to be played by a birthday card. In similar embodiments, a sender can make a variant of a greeting card's song or of a song of special importance to the sender and receiver.

In other embodiments of the present invention, an e-card hosting website enables a sender to produce a unique and personal composition 2502 created using the present invention, to be played when the card is opened. The sender can further include a recording of his or her own voice, or of a synthesized voice, or of another acoustic or electronic input, to further personalize the message. For synthesized voices, the invention enables the user to vary the synthesized voice track, thereby changing the text, pitch or speed of the voice, etc.

Figure 26:
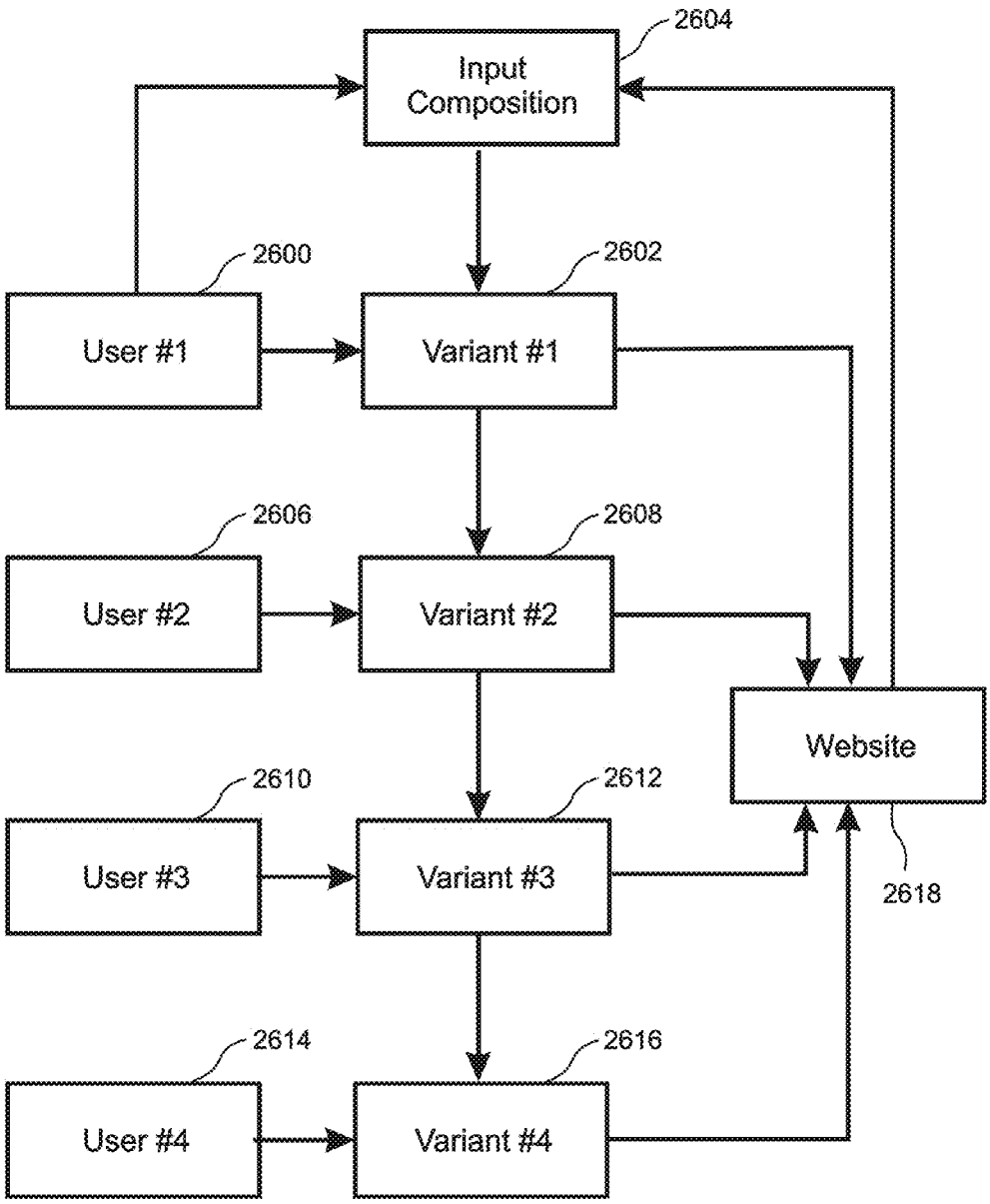
FIG. 26 is a flow diagram illustrating the hosting by a website of a chain of successive variants of a musical composition created according to an embodiment of the present invention.

With reference to FIG. 26, websites can host "chains" of compositions where individuals create and post successive variations of a starting composition. In other words, a first user 2600 can select a source input composition 2604 from the website 2618 and create a first variant 2602 thereof, a second user 2606 can create a second variant 2608 that is a variant of the first variant 2602, a third user 2610 can create a third variant 2612 that is a variant of the second variant 2608, a fourth user 2614 can create a fourth variant 2616 that is a variant of the third variant 2612, and so forth. Each of the variants 2602, 2608, 2612, 2616 is stored by the website 2618, so that a visitor to the website 2618 can enjoy listening to the succession of variations, which may begin as small changes to the input composition 2604, and then evolve to variations where the input composition 2604 is hardly recognizable.

Figure 27:
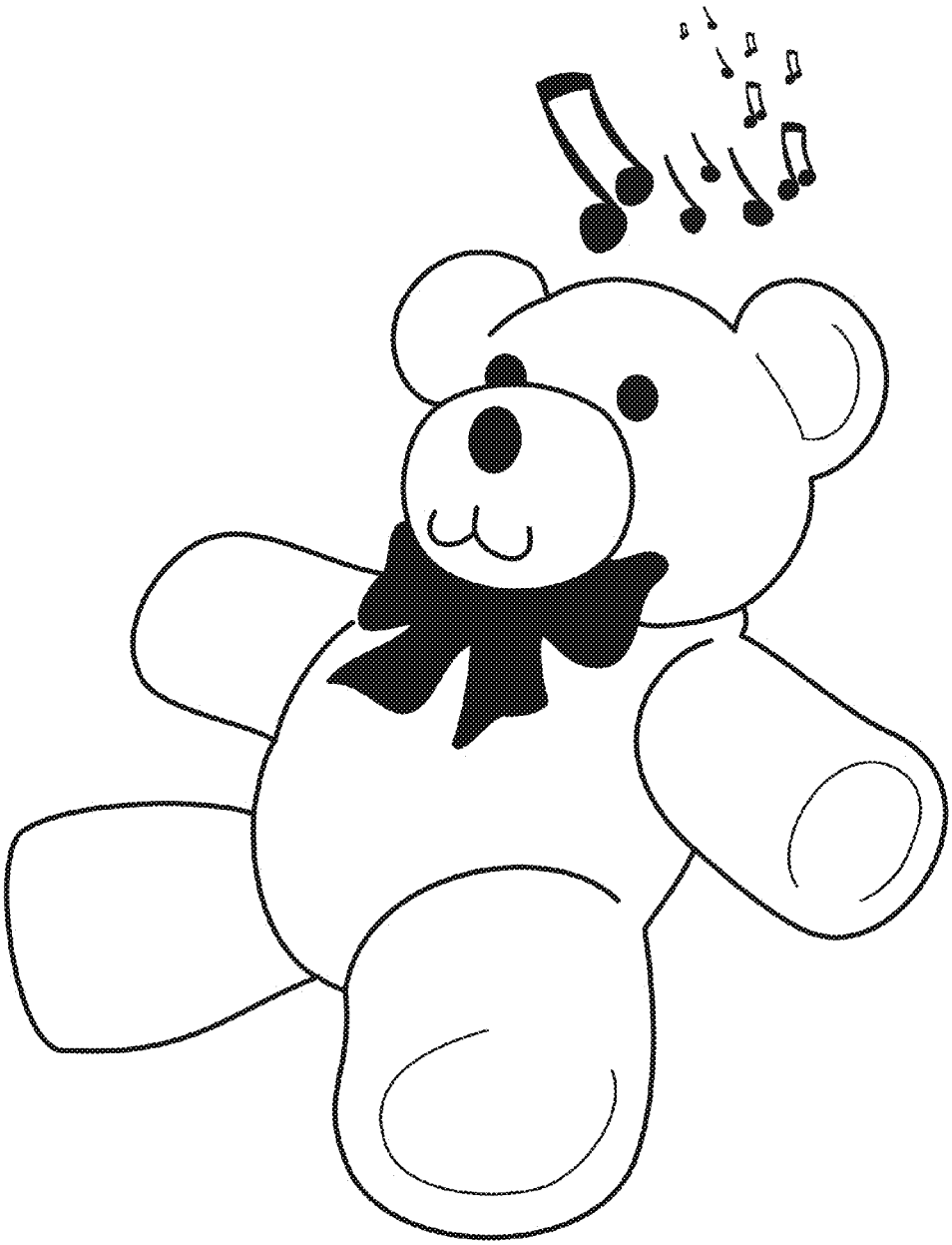
FIG. 27 illustrates a child's toy that plays a different variant of a musical composition each time it is activated.

With reference to FIG. 27, embodiments of the present invention can be integrated with children's toys that play music, e.g., nursery rhymes, so that the songs contained therein are varied, e.g., each time someone picks up the toy.

Figure 28:
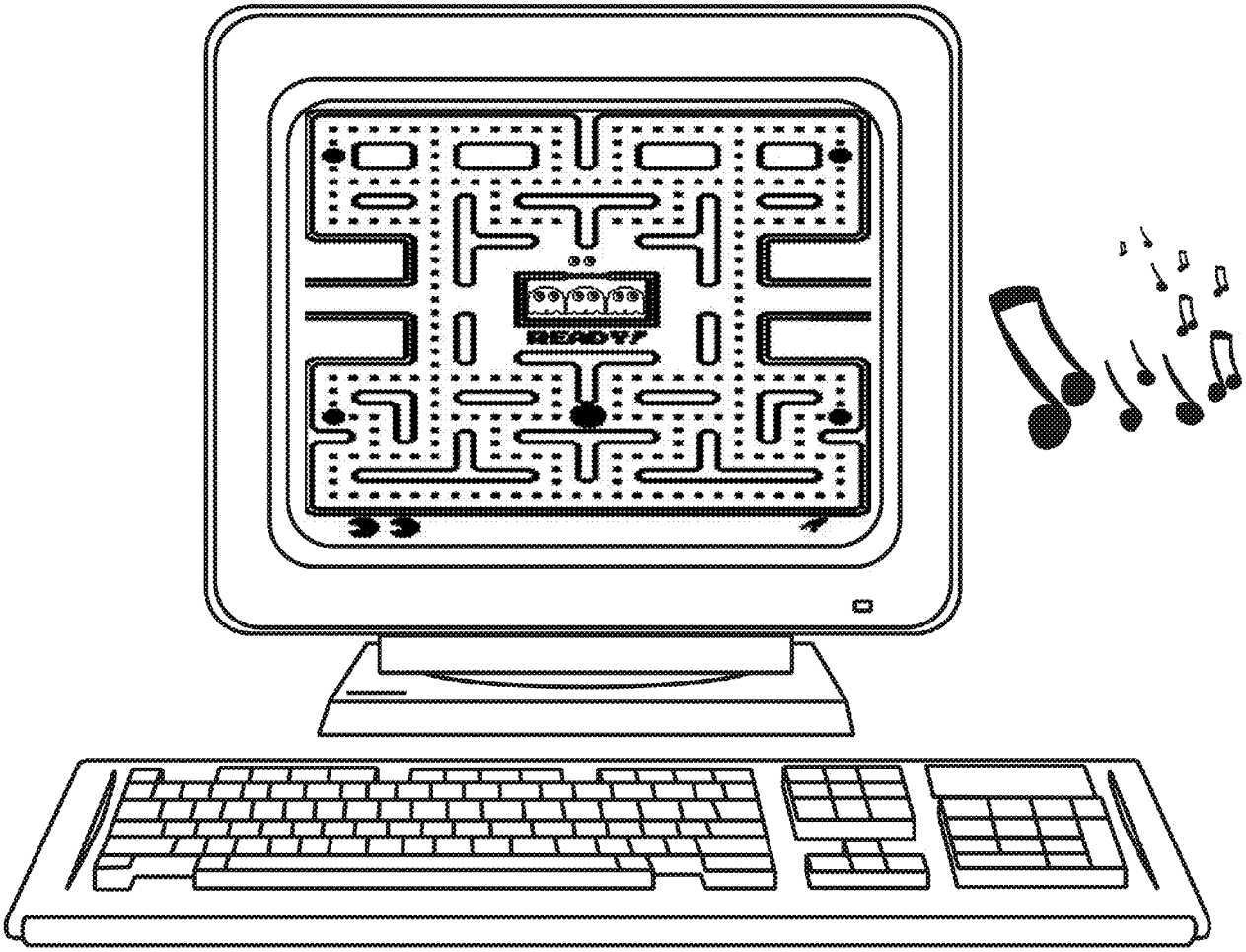
FIG. 28 illustrates a video game that employs the present invention to vary sound tracks that accompany various actions in the game.

Video games typically feature sound tracks that accompany the actions of a hero, heroine, or the user. For example, theme music is often associated with actions of the hero or even with the user. With reference to FIG. 28, embodiments of the present invention can be incorporated into video games. For example, every time the hero appears or completes a heroic action, the present invention can be used to play a different variant of a theme. In some of these embodiments, particularly pleasing variations can be saved by the user as a kind of hero's music portfolio, to be called upon in future games.

Figure 29:
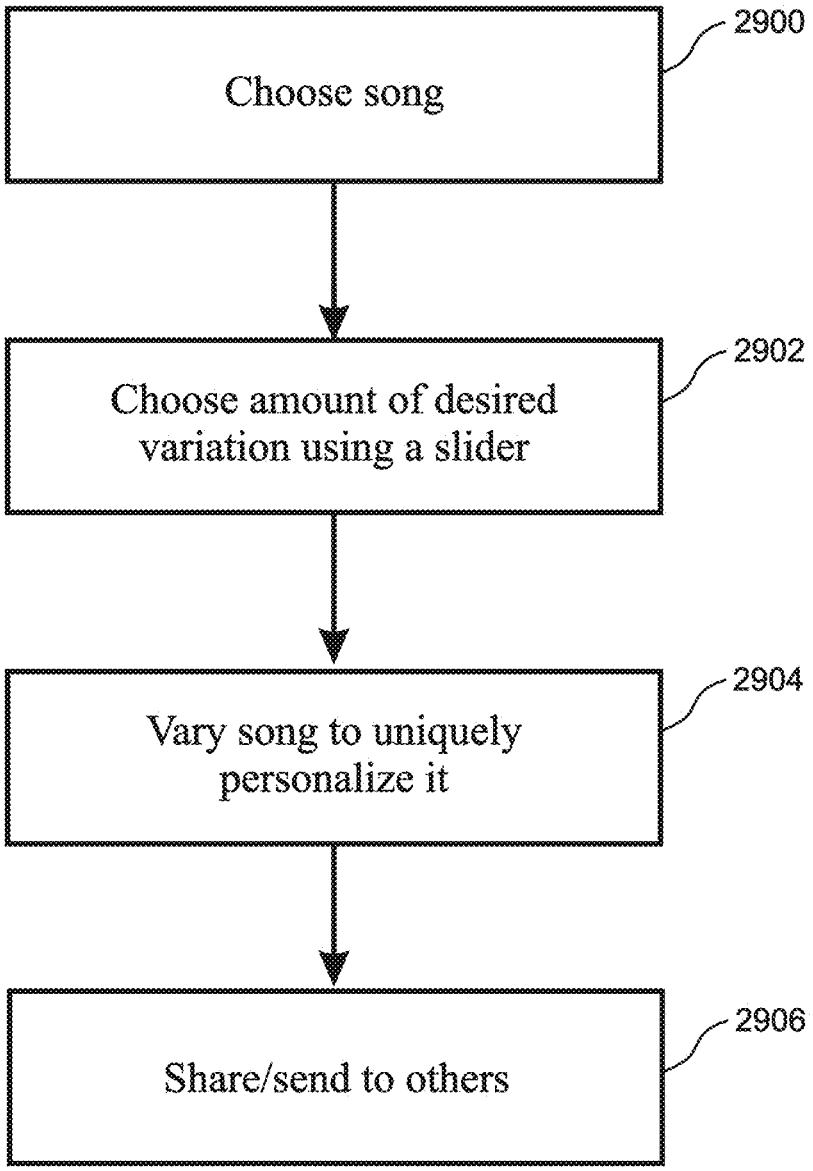
FIG. 29 is a flow diagram illustrating a simple mobile device app that enables users to personalize their music and share with others.

FIG. 29 presents a flow diagram illustrating a simple mobile device app that enables users to personalize their music and share it with others. The user chooses a song 2900 and then moves a slider to indicate the degree of variation to be applied to the song 2902, ranging from "a little" to "a lot." The app uses the present invention to change the song into a personal statement created by the user 2904, who can then send/share it with friends or other recipients 2906.

Figure 30:
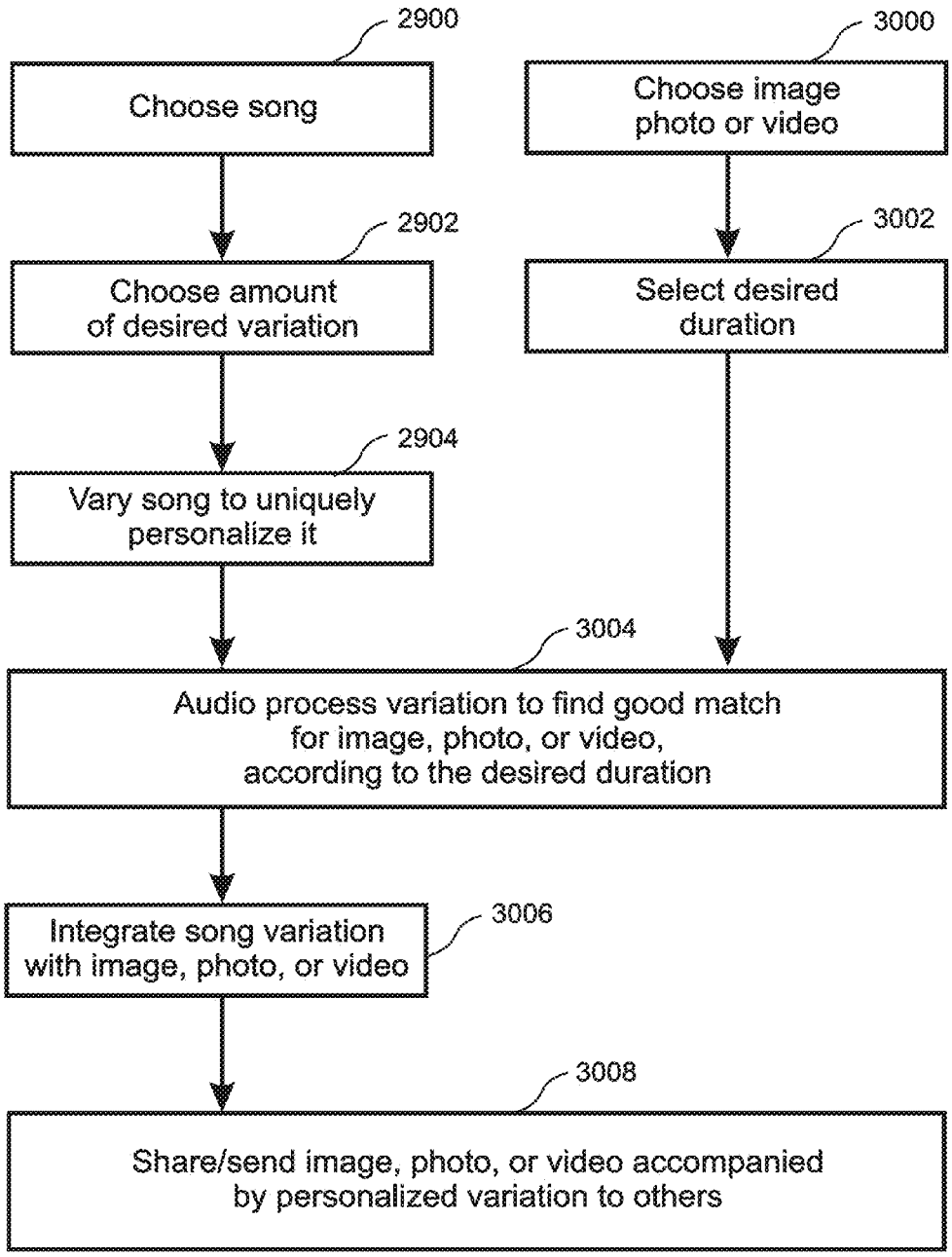
FIG. 30 is a flow diagram illustrating a mobile device app or website that affixes a personalized version of a song to a photo, image, or video, so that the user can send/share it with friends or other recipients.

FIG. 30 presents a flow diagram illustrating a mobile device app or website that affixes a personalized version of a song to a graphical element such as a photo, image, or video, so that the user can send/share it with others. In parallel with choosing a song 2900, choosing an amount of variation 2902, and varying the song to uniquely personalize it 2904, the user also chooses an image, photo, or video 3000 and selects a desired duration for the eventual audio and graphical element combination 3002. The selected song is then varied according to the present invention to find a good match to the image, photo, or video according to the desired duration 3004, after which the song variation is integrated with the graphical element 3006 and the combined song variation and graphical element is sent to be shared with friends or other recipients 3008.

Figure 31:
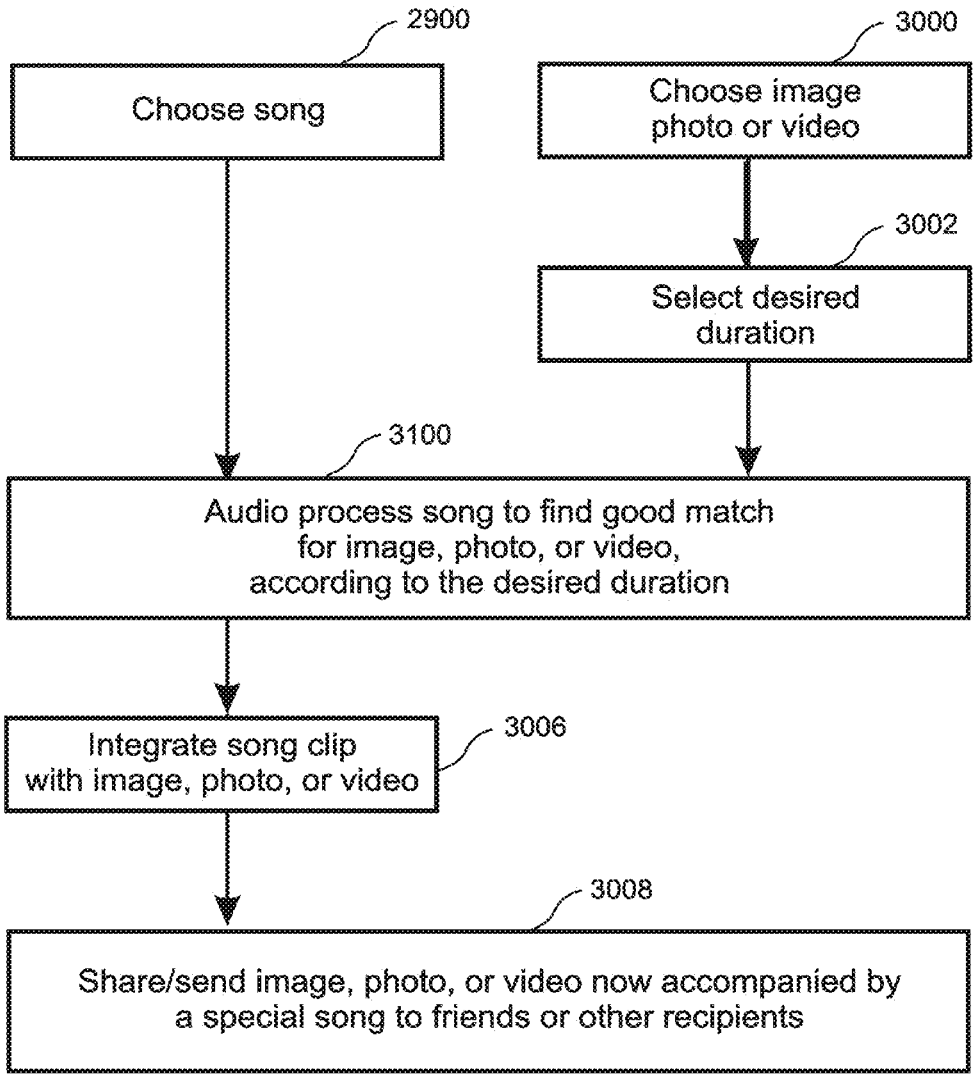
FIG. 31 is a flow diagram illustrating a mobile device app or website that affixes a favorite or chosen song to a photo, image, or video, so that the user can send/share it with others.

FIG. 31 presents a flow diagram illustrating an embodiment similar to FIG. 30, where a mobile device app or website audio processes a song to find a good match to a photo, video, or other graphical element 3100, that the user either submits or chooses from a selection 3000, and then affixes the song to the graphical element 3006, so that the user can send/share it with others 3008.

Figure 25:
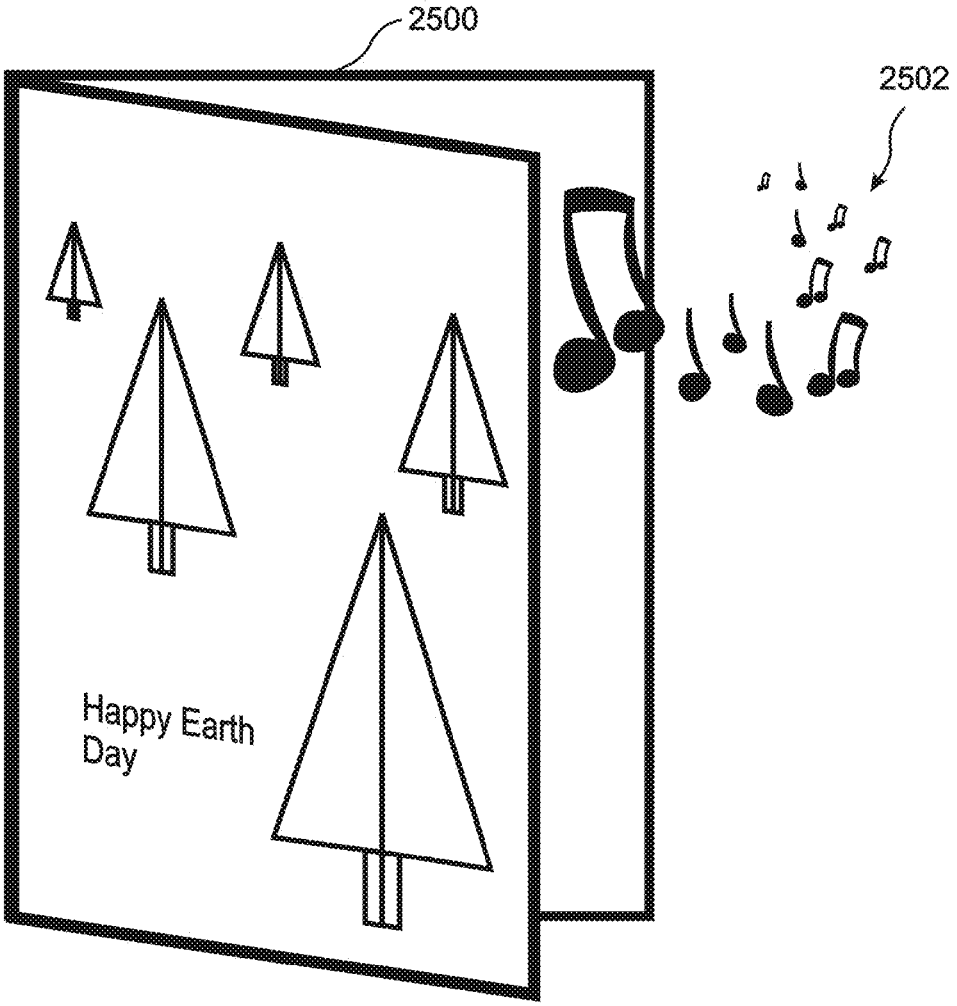
FIG. 25 illustrates a greeting card that plays a variant of a musical composition created using the present invention when the card is opened.

In embodiments, the present invention is implemented in a small electronic chip that can be included in a larger item, such as a hand-held device (smart phone, iPod, iPad, tablet, etc), an MP3 player, a greeting card, or wearable technology such as a smart watch, smartband, or wearable computer. In some of these embodiments, the item is thereby enabled to play variations of music stored therein. For example, the chip can be instructed to create a new variant of a composition every time it is played on an MP3 player. With reference to FIG. 25, in other embodiments, the chip is included in a greeting card, so that the sender can create a unique composition to be played when the card is opened without resort to a website or separate computer. In some of these embodiments, the chip can be programmed to play a different variation each time the card is opened. In still other embodiments a mobile device can be programmed in hardware or software to allow a ringtone to change with each incoming call.

The foregoing description of the embodiments of the invention has been presented for the purposes of illustration and description. It is not intended to be exhaustive or to limit the invention to the precise form disclosed. Many modifications and variations are possible in light of this disclosure. It is intended that the scope of the invention be limited not by this detailed description, but rather by the claims appended hereto.

What is claimed is:

1. A method practiced by a computing device for transforming an input musical composition into a variant musical composition, whereby the variant composition differs from but maintains a recognizable similarity to the input musical composition, the method comprising:

accepting from a user an input musical composition;

parsing by the computing device of the input musical composition into an ordered sequence of original elements $\{N_i\}$, the original elements being sequentially indexed by successive integer values of an index i from 1 to a maximum value $i_{max}$;

for each value of i, the computing device using a hole selecting algorithm to determine if $N_i$ is a candidate for substitution, herein referred to as a "hole element";

using a substitution algorithm, for at least one hole element the computing device providing a substitution element and replacing the hole element with the substitution element, the resulting ordered set of original and substituted elements constituting the variant composition; and causing an output device to present the variant composition to a recipient.

2. The method of claim 1, wherein the input musical composition includes a plurality of tracks, and the method further includes:

applying the method separately to at least two of the tracks of the input musical composition so as to create variants thereof; and recombining the variants to create a remixed musical composition.

3. The method of claim 1, wherein the input musical composition includes a plurality of tracks, said plurality of tracks being posted on a website, the website being configured to enable visitors to the website to access subsets of the tracks and to create therefrom a remixed musical composition.

4. The method of claim 1, wherein:

the input musical composition includes a subset of a plurality of tracks included in a musical recording, said musical recording further including at least one seed track that is not included in said subset; and the substitution element is an element $M_s$ derived from said at least one seed track of the musical recording, the substitution creating a remixed musical composition.

5. The method of claim 1, wherein the input musical composition includes a concatenation of at least two tracks, said at least two tracks being a subset of a plurality of tracks included in a musical recording.

6. The method of claim 1, wherein the input musical composition includes a plurality of tracks, said plurality of tracks being a concatenation of at least a first subset of tracks from a first musical recording and a second subset of tracks from a second musical recording.

7. The method of claim 1, further comprising combining the variant composition with a graphical element.

8. The method of claim 7, wherein the graphical element is a static graphical image.

9. The method of claim 7, wherein the graphical element is a video or a part of a video.

10. The method of claim 7, wherein the graphical element is a film or a part of a film.

11. The method of claim 7, wherein the graphical element is a video game or a part of a video game.

12. The method of claim 7, wherein the graphical element is a presentation slide element or presentation slide deck.

13. The method of claim 7, further comprising forwarding the combined variant composition and graphical element to at least one recipient.

14. The method of claim 7, wherein the graphical element is an element of a storyboard that describes a proposal for a musically accompanied graphical work.

15. The method of claim 14, wherein the musically accompanied graphical work is a musically accompanied video.

16. The method of claim 7, wherein the graphical element is a slide presentation created by a presentation software application.

17. The method of claim 16, wherein the presentation software application is configured to perform the steps of parsing, using the selection algorithm, and using the substitution algorithm.

18. The method of claim 1, wherein the input musical composition is associated with a website, and the website is configured, each time a user visits a designated page of the website, to:

repeat the steps of using the hole selecting algorithm and using the substitution algorithm to create a new variant of the input musical composition; and play the new variant to the user.

19. The method of claim 1, wherein the input musical composition is associated with software, the software being configured, each time a user opens it, to:

repeat the steps of using the hole selecting algorithm and using the substitution algorithm to create a new variant of the input musical composition; and play the new variant to the user.

20. The method of claim 1, further comprising storing the variant composition in a digital device included in a greeting card, the digital device being configured to play the variant composition when the greeting card is opened.

21. The method of claim 1, wherein a digital device is configured to perform the steps of parsing, using the hole selecting algorithm, and using the substitution algorithm.

22. The method of claim 21, wherein the digital device is included in a greeting card, a toy, an MP3 player, a cellular telephone, or a hand-held or wearable electronic device.

23. The method of claim 21, wherein the digital device is configured to repeat the steps of using the hole selecting algorithm and using the substitution algorithm each time a musical composition is accessed, so that a new variant composition is played each time the composition is accessed.

24. The method of claim 1, wherein the method is practiced by an application running in hardware or software on a hand-held or wearable electronic device.

25. The method of claim 1, wherein the method is practiced by a computing device that is accessible via a network to a hand-held or wearable electronic device.

26. The method of claim 1, wherein the method is practiced by a computing module included in a hand-held or wearable electronic device.

27. The method of claim 26, wherein the hand-held or wearable electronic device is configurable to play a new variant of the input musical composition each time the input musical composition is selected.

28. The method of claim 26, wherein the computing module included in a hand-held or wearable electronic device is configurable to play a new variant of the input musical composition each time the input musical composition is selected.

29. The method of claim 26, wherein a plurality of tracks from an input musical composition are accessible to a hand-held or wearable electronic device, and the hand-held or wearable electronic device is configured to enable the user to access subsets of the tracks and to create therefrom a remixed musical composition.

30. The method of claim 26, wherein:

the input musical composition includes a subset of a plurality of tracks included in a musical recording, said musical recording further including at least one seed track that is not included in said subset; and the substitution element is an element $M_s$ derived from the at least one seed track of the musical recording, the substitution creating a remixed musical composition.

31. The method of claim 1, wherein the method is practiced via a website or computing device.

32. The method of claim 1, wherein the method is practiced by a video game so as to play a new variant of a musical theme each time specified criteria are met during play of the game.

33. The method of claim 1, wherein the steps of using the hole selecting algorithm and using the substitution algorithm are repeated in a chain sequence, whereby the input musical composition for each repetition is a variant composition created by a previous repetition.

34. The method of claim 33, wherein the steps of using the hole selecting algorithm and using the substitution algorithm are performed by a website, the website being configured to store the variant compositions and make them available to visitors of the website.

35. The method of claim 33, wherein the steps of using the hole selecting algorithm and using the substitution algorithm are performed by a hand-held or wearable electronic device, the device being configured to send the variant composition to another person to keep the chain of variations going from recipient to recipient.

* * * * *